US007600756B2

(12) United States Patent
Verdes

(10) Patent No.: US 7,600,756 B2
(45) Date of Patent: Oct. 13, 2009

(54) CUBIC LOGIC TOY

(76) Inventor: Panayotis Verdes, Next to Hotel Amalia, GR-211 00 New Tiryntha, Nafplio (GR)

( * ) Notice: Subject to any disclaimer, the term of this patent is extended or adjusted under 35 U.S.C. 154(b) by 216 days.

(21) Appl. No.: 10/555,013

(22) PCT Filed: May 13, 2004

(86) PCT No.: PCT/GR2004/000027

§ 371 (c)(1),
(2), (4) Date: Oct. 10, 2006

(87) PCT Pub. No.: WO2004/103497

PCT Pub. Date: Dec. 2, 2004

(65) Prior Publication Data

US 2007/0057455 A1 Mar. 15, 2007

(30) Foreign Application Priority Data

May 21, 2003 (GR) ..... 20030100227

(51) Int. Cl.
*A63F 9/08* (2006.01)

(52) U.S. Cl. ..... 273/153 S

(58) Field of Classification Search ..... 273/153 S, 273/153 R

See application file for complete search history.

(56) References Cited

U.S. PATENT DOCUMENTS

D4,793 S 4/1871 Loyd (Continued)

FOREIGN PATENT DOCUMENTS

BE 887 875 1/1981

(Continued)

*Primary Examiner*—Steven Wong
(74) *Attorney, Agent, or Firm*—Birch, Stewart, Kolasch and Birch, LLP

(57) ABSTRACT

This is an invention that concerns the construction of three-dimensional logic toys, which have the shape of a normal solid, substantially cubic in shape, and N number of layers in each direction of the three-dimensional rectangular Cartesian coordinate system, said layers consisting of smaller separate pieces. Their sides that form part of the solid's external surface are substantially cubic. The said pieces can rotate in layers around the three-dimensional axes of the coordinates; their visible rectangular surfaces can be colored or they can bare shapes, letters or numbers. The construction is based on the configuration of the internal surfaces of the separate pieces using planar, spherical and mainly right conical surfaces, coaxial to the semi-axis of the coordinates, the number of which is κ per semi-axis. The advantage of this construction is that by the use of these κ conical surfaces per semi-axis, two solids arise each time; the first has an even (N=2κ) number of layers per direction visible to the user, whereas the second has the next odd (N=2κ+1) number of visible layers per direction. As a result, by using a unified method and way of construction, for the values of κ from 1 to 5, we can produce in total eleven logic toys whose shape is a normal geometric solid, substantially cubic in shape. These solids are the Cubic Logic Toys No N, where N can take values from N=2 to N=11. The invention became possible after we have solved the problem of connecting the corner piece with the interior of the cube, so that it can be self-contained, can rotate unobstructed around the axes of the three-dimensional rectangular Cartesian coordinate system and, at the same time, can be protected from being dismantled. This invention is unified and its advantage is that, with a new different internal configuration, we can construct—apart from the already known cubes 2×2×2, 3×3×3, 4×4×4, 5×5×5 which have already been constructed in many different ways and by different people—the next cubes from N=6 up to N=11. Finally, the most important advantage is that it eliminates the operational disadvantages that the already existing cubes have, except for the Rubik cube, i.e. 3×3×3.

11 Claims, 47 Drawing Sheets

U.S. PATENT DOCUMENTS

| | | | | |
|---|---|---|---|---|
| D156,338 | S | | 12/1949 | Holcomb |
| 3,222,072 | A | | 12/1965 | Dreyer |
| 3,565,442 | A | | 2/1971 | Klein |
| 3,565,443 | A | | 2/1971 | Klein |
| 3,845,959 | A | | 11/1974 | Kosarek |
| D235,075 | S | | 5/1975 | Baynes |
| 4,344,623 | A | * | 8/1982 | Isobe ..... 273/153 S |
| D268,427 | S | | 3/1983 | Grushkin |
| 4,378,116 | A | * | 3/1983 | Rubik ..... 273/153 S |
| 4,378,117 | A | | 3/1983 | Rubik et al. |
| 4,405,131 | A | | 9/1983 | Horvath |
| 4,407,502 | A | | 10/1983 | Paulos |
| 4,409,750 | A | | 10/1983 | Silbermintz |
| 4,421,311 | A | | 12/1983 | Sebesteny et al. |
| 4,424,971 | A | | 1/1984 | Clark |
| 4,427,197 | A | * | 1/1984 | Doose ..... 273/153 S |
| 4,428,581 | A | | 1/1984 | Nagorny et al. |
| 4,432,548 | A | | 2/1984 | Kassan |
| 4,437,667 | A | | 3/1984 | Miller |
| 4,451,039 | A | | 5/1984 | Hewlett, Jr. |
| 4,461,480 | A | | 7/1984 | Mitchell |
| 4,474,377 | A | | 10/1984 | Ashley |
| 4,478,418 | A | | 10/1984 | Sherman, Jr. |
| 4,494,756 | A | | 1/1985 | Winer |
| 4,496,155 | A | | 1/1985 | Goldfarb et al. |
| 4,511,144 | A | | 4/1985 | Roberts |
| 4,513,970 | A | | 4/1985 | Opresco et al. |
| 4,529,201 | A | | 7/1985 | Nadel |
| 4,540,177 | A | * | 9/1985 | Horvath ..... 273/153 S |
| 4,558,866 | A | | 12/1985 | Alford |
| 4,586,713 | A | | 5/1986 | Abu-Shumays et al. |
| 4,593,907 | A | | 6/1986 | Abu-Shumays et al. |
| 4,593,908 | A | | 6/1986 | Ibrahim |
| 4,600,199 | A | | 7/1986 | Krell et al. |
| 4,667,961 | A | | 5/1987 | Abu-Shumays et al. |
| 4,674,750 | A | | 6/1987 | Abu-Shumays et al. |
| 4,706,956 | A | | 11/1987 | Abu-Shumays et al. |
| 4,836,549 | A | | 6/1989 | Flake |
| 4,872,682 | A | | 10/1989 | Kuchimanchi et al. |
| 5,193,809 | A | | 3/1993 | Hrsel et al. |
| D334,599 | S | | 4/1993 | Burke |
| D340,093 | S | | 10/1993 | Hrsel et al. |
| D350,164 | S | | 8/1994 | Ophir |
| 5,344,147 | A | | 9/1994 | Lee et al. |
| 5,386,993 | A | | 2/1995 | Apsan et al. |
| 5,433,448 | A | | 7/1995 | Raphael et al. |
| D366,506 | S | | 1/1996 | Lindquist et al. |
| 5,722,657 | A | | 3/1998 | Cabrera et al. |
| 5,785,319 | A | | 7/1998 | Frauhiger |
| 5,816,571 | A | | 10/1998 | Chen et al. |
| 5,823,530 | A | | 10/1998 | Yang et al. |
| 5,826,871 | A | * | 10/1998 | Li ..... 273/153 S |
| D408,061 | S | | 4/1999 | Borg |
| D412,541 | S | | 8/1999 | Tam et al. |
| 5,992,850 | A | * | 11/1999 | Li ..... 273/153 S |
| 6,056,290 | A | | 5/2000 | Holloway |
| 6,062,978 | A | | 5/2000 | Martino et al. |
| D426,587 | S | | 6/2000 | Phillips |
| 6,129,356 | A | | 10/2000 | Li |
| 6,186,860 | B1 | | 2/2001 | Liao et al. |
| 6,196,544 | B1 | | 3/2001 | Rachofsky |
| 6,217,023 | B1 | | 4/2001 | Kremer et al. |
| 6,241,249 | B1 | | 6/2001 | Wang et al. |
| D447,521 | S | | 9/2001 | Meadows et al. |
| 6,422,560 | B1 | | 7/2002 | Harbaugh |
| 6,513,808 | B2 | | 2/2003 | Fang et al. |
| 6,523,825 | B2 | | 2/2003 | Francis et al. |
| D475,094 | S | | 5/2003 | Ko et al. |
| 6,626,431 | B2 | | 9/2003 | Possidento |
| 6,644,665 | B1 | | 11/2003 | Brooks |
| 6,712,358 | B1 | | 3/2004 | Dimitriou et al. |
| D491,235 | S | | 6/2004 | Fang et al. |
| D495,378 | S | | 8/2004 | Sugden et al. |
| 6,769,690 | B1 | | 8/2004 | Khoudary et al. |
| 6,974,130 | B2 | | 12/2005 | Sugden et al. |
| D528,607 | S | | 9/2006 | Sugden |
| 7,100,917 | B2 | | 9/2006 | Wang et al. |
| 7,165,768 | B2 | | 1/2007 | Fang et al. |
| 7,255,345 | B2 | | 8/2007 | Wood et al. |
| D559,921 | S | | 1/2008 | Webster et al. |
| D560,256 | S | | 1/2008 | Webster et al. |
| D560,257 | S | | 1/2008 | Webster et al. |
| D568,418 | S | | 5/2008 | Webster et al. |
| 2005/0006842 | A1 | | 1/2005 | Pitcher |
| 2005/0133994 | A1 | | 6/2005 | Narasimhan |
| 2005/0269770 | A1 | | 12/2005 | Mak |
| 2007/0267813 | A1 | | 11/2007 | Horowitz |

FOREIGN PATENT DOCUMENTS

| | | | |
|---|---|---|---|
| CA | 1 188 342 | | 6/1985 |
| DE | 31 11 381 | A | 10/1982 |
| DE | 3111382 | | 10/1982 |
| DE | 31 25 817 | A | 1/1983 |
| DE | 31 33 235 | A | 3/1983 |
| EP | 0103047 | | 3/1984 |
| FR | 2 787 033 | A | 6/2000 |
| GB | 2 205 253 | A | 12/1988 |
| SU | 980 739 | A | 12/1982 |
| WO | WO-83/01203 | A | 4/1983 |

* cited by examiner

CUBIC LOGIC TOY

This invention refers to the manufacturing of three-dimensional logic toys, which have the form of a normal geometric solid, substantially cubic, which has N layers per each direction of the three-dimensional rectangular Cartesian coordinate system, the centre of which coincides with the geometric centre of the solid. The layers consist of a number of smaller pieces, which in layers can rotate around the axes of the three-dimensional rectangular Cartesian coordinate system.

Such logic toys either cubic or of other shape are famous worldwide, the most famous being the Rubik cube, which is considered to be the best toy of the last two centuries.

This cube has three layers per each direction of the three-dimensional rectangular Cartesian coordinate system and it could otherwise be named as 3×3×3 cube, or even better as cube No 3, having on each face 9 planar square surfaces, each one coloured with one of the six basic colours, that is in total 6×9=54 coloured planar square surfaces, and for solving this game the user should rotate the layers of the cube, so that, finally, each face of the cube has the same colour.

From what we know up to now, except for the classic Rubik cube, that is the cube No 3, the 2×2×2 cube with two layers per direction, (or otherwise called cube No 2), the 4×4×4 cube with four layers per direction, (or otherwise called cube No 4) and the 5×5×5 cube with five layers per direction, (or otherwise called cube No 5) have also been manufactured.

However, with the exception of the well-known Rubik cube, that is the cube No 3, which does not present any disadvantages during its speed cubing, the other cubes have disadvantages during their speed cubing and the user should be very careful, otherwise the cubes risk having some of their pieces destroyed or being dismantled.

The disadvantages of the cube 2×2×2 are mentioned in the U.S. Rubik invention N4378117, whereas those of the cubes 4×4×4 and 5×5×5 on the Internet site www.Rubiks.com, where the user is warned not to rotate the cube violently or fast.

As a result, the slow rotation complicates the competition of the users in solving the cube as quickly as possible.

The fact that these cubes present problems during their speed Cubing is proved by the decision of the Cubing champion organisation committee of the Cubing championship, which took place in August 2003 in Toronto Canada, according to which the main event was the users' competition on the classic Rubik cube, that is on cube No 3, whereas the one on the cubes No 4 and No 5 was a secondary event. This is due to the problems that these cubes present during their speed Cubing.

The disadvantage of the slow rotation of these cubes' layers is due to the fact that apart from the planar and spherical surfaces, cylindrical surfaces coaxial with the axes of the three-dimensional rectangular Cartesian coordinate system have mainly been used for the configuration of the internal surfaces of the smaller pieces of the cubes' layers. However, although the use of these cylindrical surfaces could secure stability and fist rotation for the Rubik cube due to the small number of layers, N=3, per direction, when the number of layers increases there is a high probability of some smaller pieces being damaged or of the cube being dismantled, resulting to the disadvantage of slow rotation. This is due to the fact that the 4×4×4 and 5×5×5 cubes are actually manufactured by hanging pieces on the 2×2×2 and 3×3×3 cubes respectively. This way of manufacturing, though, increases the number of smaller pieces, having as a result the above-mentioned disadvantages of these cubes.

What constitutes the innovation and the improvement of the construction according to the present invention is that the configuration of the internal surfaces of each piece is made not only by the required planar and spherical surfaces that are concentric with the solid geometrical centre, but mainly by right conical surfaces. These conical surfaces are coaxial with the semi-axes of the three-dimensional rectangular Cartesian coordinate system, the number of which is k per semi-axis, and consequently 2k in each direction of the three dimensions.

Thus, when N=2κ even number, the resultant solid has N layers per direction visible to the toy user, plus one additional layer, the intermediate layer in each direction, that is not visible to the user, whereas when N=2κ+1, odd number, then the resultant solid has N layers per direction, all visible to the toy user.

We claim that the advantages of the configuration of the internal surfaces of every smaller piece mainly by conical surfaces instead of cylindrical, which are secondarily used only in few cases, in combination with the necessary planar and spherical surfaces, are the following:

A) Every separate smaller piece of the toy consists of three discernible separate parts. The first part that is outermost with regard to the geometric centre of the solid, substantially cubic in shape, the second intermediate part, which has a conical sphenoid shape pointing substantially towards the geometric centre of the solid, its cross section being either in the shape of an equilateral spherical triangle or of an isosceles spherical trapezium or of any spherical quadrilateral, and its third part that is innermost with regard to the geometric centre of the solid, which is close to the solid geometric centre and is part of a sphere or of a spherical shell, delimited appropriately by conical or planar surface or by cylindrical surfaces only when it comes to the six caps of the solid. It is obvious, that the first outermost part is missing from the separate smaller pieces as it is spherically cut when these are not visible to the user.

B) The connection of the corner separate pieces of each cube with the solid interior, which is the most important problem to the construction of three-dimensional logic toys of that kind and of that shape, is ensured, so that these pieces are completely protected from dismantling.

C) With this configuration, each separate piece extends to the appropriate depth in the interior of the solid and it is protected from being dismantled, on the one hand by the six caps of the solid, that is the central separate pieces of each face, and on the other hand by the suitably created recesses-protrusions, whereby each separate piece is intercoupled and supported by its neighbouring pieces said recesses-protrusions being such as to create, at the same time, general spherical recesses-protrusions between adjacent layers. These recesses-protrusions both intercouple and support each separate piece with its neighbouring, securing, on the one hand, the stability of the construction and, on the other hand, guiding the pieces during the layers' rotation around the axes. The number of these recesses-protrusions could be more than 1 when the stability of the construction requires it, as shown in the drawings of the present invention.

D) Since the internal parts of the several separate pieces are conical and spherical, they can easily rotate in and above conical and spherical surfaces, which are surfaces made by rotation and consequently the advantage of the fast and unhindered rotation, reinforced by the appropriate rounding of the edges of each separate piece, is ensured.

E) The configuration of each separate piece's internal surfaces by planar spherical and conical surfaces is more easily made on the lathe.

F) Each separate piece is self-contained, rotating along with the other pieces of its layer around the corresponding axis in the way the user desires.

G) According to the way of manufacture suggested by the present invention, two different solids correspond to each value of k. The solid with N=2κ, that is with an even number of visible layers per direction, and the solid with N=2κ+1 with the next odd number of visible layers per direction. The only difference between these solids is that the intermediate layer of the first one is not visible to the user, whereas the intermediate layer of the second emerges at the toy surf-ace. These two solids consist, as it is expected, of exactly the same number of separate pieces, that is $T=6N^2+3$, where N can only be an even number, e.g. N=2κ. Therefore, the total number of separate pieces can also be expressed and $T=6(2\kappa)^2+3$.

H) The great advantage of the configuration of the separate pieces internal surfaces of each solid with conical surfaces in combination with the required planar and spherical surfaces, is that whenever an additional conical surface is added to every semi-axis of the three-dimensional rectangular Cartesian coordinate system, then two new solids are produced, said solids having two more layers than the initial ones.

Thus, when κ=1, two cubes with N=2κ=2×1=2 and N=2κ+1=2×1+1=3 arise, that is the cubic logic toys No2 and No3, when κ=2, the cubes with N=2κ=2×2=4 and N=2κ+1=2×2+1=5 arise, that is the cubic logic toys No4 and No5, e.t.c. and, finally, when k=5 the cubes N=2κ=2×5=10 and N=2κ+1=2×5+1=11 are produced, that is the cubic logic toys No 10 and No 11, where the present invention stops.

The fact that when a new conical surface is added two new solids are produced is a great advantage as it makes the invention unified.

As it can easily be calculated, the number of the possible different places that each cube's pieces can take, during rotation, increases spectacularly as the number of layers increases, but at the same time the difficulty in solving the cube increases.

The reason why the present invention finds application up to the cube N=11, as we have already mentioned, is due to the increasing difficulty in solving the cubes when more layers are added as well as due to geometrical constraints and practical reasons.

The geometrical constraints are the following:

a) According to the present invention, in order to divide the cube into equal N layers we have already proved that N should verify the inequality $\sqrt{2}(a/2-a/N)<a/2$. Having solved the inequality, it is obvious that the whole values of N are N<6,82. This is possible when N=2, N=3, N=4, N=5 and N=6 and as a result the cubic logic toys No2, No3, No4, No5 and No6, whose shape is ideally cubic, are produced.

b) The constraint in the value of N<6,82 can be overcome if the planar faces of the cube become spherical parts of long radius. Therefore, the final solid with N=7 and more layers loses the classical geometrical cubic shape, that with six planar surfaces, but from N=7 to N=11 the six solid faces are no longer planar but spherical, of long radius compared to the cube dimensions, the shape of said spherical surfaces being almost planar, as the rise of the solid faces from the ideal level, is about 5% of the side length of the ideal cube.

Although the shape of the resultant solids from N=7 to N=11 is substantially cubic, according to the Topology branch the circle and the square are exactly the same shapes and subsequently the classic cube continuously transformed to substantially cubic is the same shape as the sphere. Therefore, we think that it is reasonable to name all the solids produced by the present invention cubic logic toys No N, as they are manufactured in exactly the same unified way, that is by using conical surfaces.

The practical reasons why the present invention finds application up to the cube N=11 are the following:

a) A cube with more layers than N=11 would be hard to rotate due to its size and the large number of its separate pieces.

b) When N>10, the visible surfaces of the separate pieces that form the acmes of the cube lose their square shape and become rectangular. That's why the invention stops at the value N=11 for which the ratio of the sides b/a of the intermediate on the acmes rectangular is 1, 5.

Finally, we should mention that when N=6, the value is very close to the geometrical constraint N<6,82. As a result, the intermediate sphenoid part of the separate pieces, especially of the corner ones, will be limited in dimensions and must be either strengthened or become bigger in size during construction. That is not the case if the cubic logic toy No 6 is manufactured in the way the cubic logic toys with N≧7 are, that is with its six faces consisting of spherical parts of long radius. That's why we suggest two different versions in manufacturing the cubic logic toy No6; version No6*a* is of a normal cubic shape and version No6*b* is with its aces consisting of spherical parts of long radius. The only difference between the two versions is in shape since they consist of exactly the same number of separate pieces.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

This invention has been possible since the problem of connecting the corner cube piece with the solid interior has been solved, so that the said corner piece can be self-contained and rotate around any semi-axis of the three-dimensional rectangular Cartesian coordinate system, be protected during rotation by the six caps of the solid, that is the central pieces of each face, to secure that the cube is not dismantled.

Figure 1:
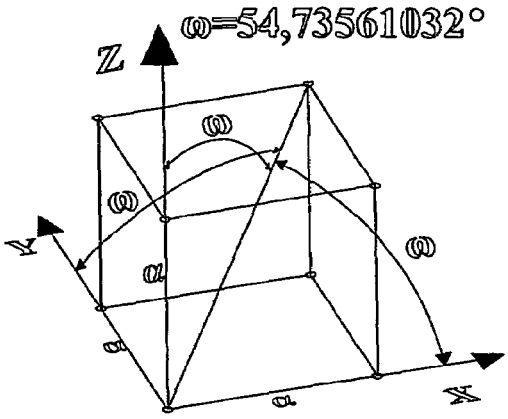
FIGS. 1.1 to 1.7 show views of components of a cubic logic toy according to an exemplary embodiment of the present invention.
Figure 1:
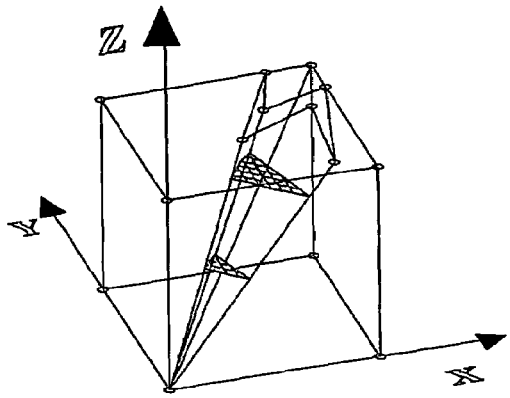
Figure 1:
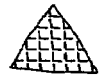
Figure 1:
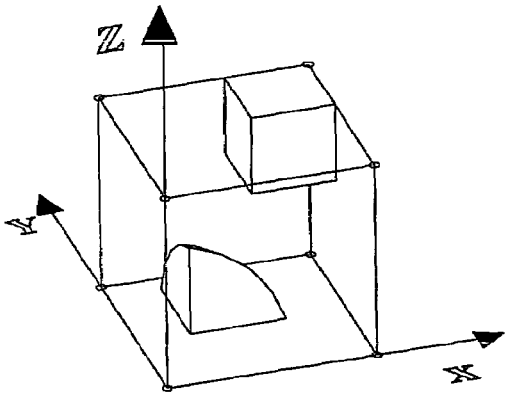
Figure 1:
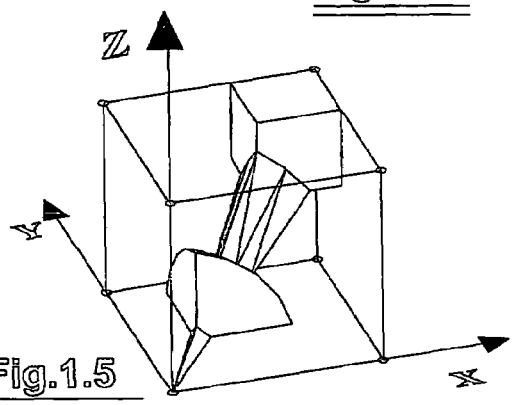
Figure 1:
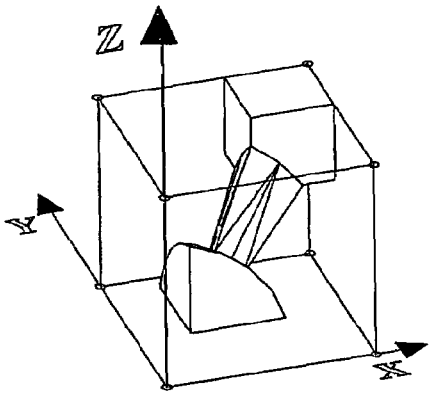
Figure 1:
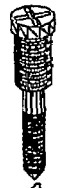
Figure 1:
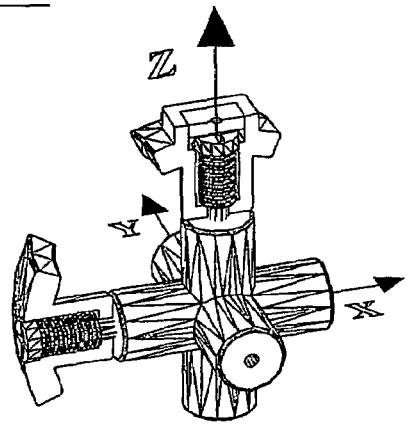

I. This solution became possible based on the following observations:

a) The diagonal of each cube with side length a forms with the semi-axes OX, OY, OZ, of the three-dimensional rectangular Cartesian coordinate system angles equal to $\tan \omega = \alpha\sqrt{2}/\alpha$, $\tan \omega = \sqrt{2}$, therefore $\omega = 54{,}735610320°$ (FIG. 1.1).

b) If we consider three right cones with apex to the beginning of the coordinates, said right cones having axes the positive semi-axes OX, OY, OZ, their generating line forming with the semi-axes OX, OY, OZ an angle $\phi > \omega$, then the intersection of these three cones is a sphenoid solid of continuously increasing thickness, said sphenoid solid's apex being located at the beginning of the coordinates (FIG. 1.2), of equilateral spherical triangle cross section (FIG. 1.3) when cut by a spherical surface whose centre coincides with the coordinates beginning. The length of the sides of the said spherical triangle increases as we approach the cube apex. The centre-axis of the said sphenoid solid coincides with the diagonal of the cube.

The three side surfaces of that sphenoid solid are parts of the surfaces of the mentioned cones and, as a result, the said sphenoid solid can rotate in the internal surface of the corresponding cone, when the corresponding cone axis or the corresponding semi-axis of the three-dimensional rectangular Cartesian coordinate system rotates.

Thus, if we consider that we have ⅛ of a sphere with radius R, the centre of said sphere being located at the coordinates beginning, appropriately cut with planes parallel to the planes XY, YZ, ZY, as well as a small cubic piece, whose diagonal coincides with the initial cube diagonal (FIG. 1.4), then these three pieces (FIG. 1.5) embodied into a separate piece give us the general form and the general shape of the corner pieces of all the present invention cubes (FIG. 1.6).

Figure 2:
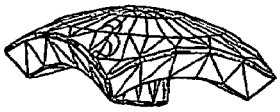
FIGS. 2.1 to 2.10 show views of a cubic logic toy according to another exemplary embodiment of the present invention.
Figure 2:
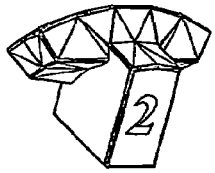
Figure 2:
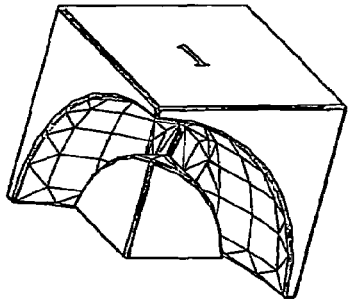
Figure 2:
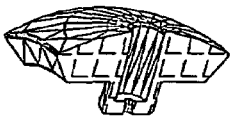
Figure 2:
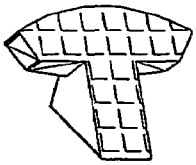
Figure 2:
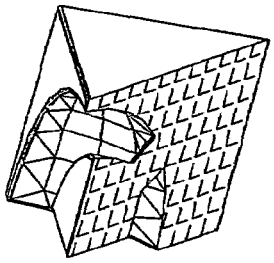
Figure 2:
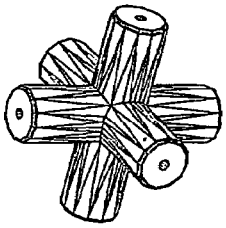
Figure 2:
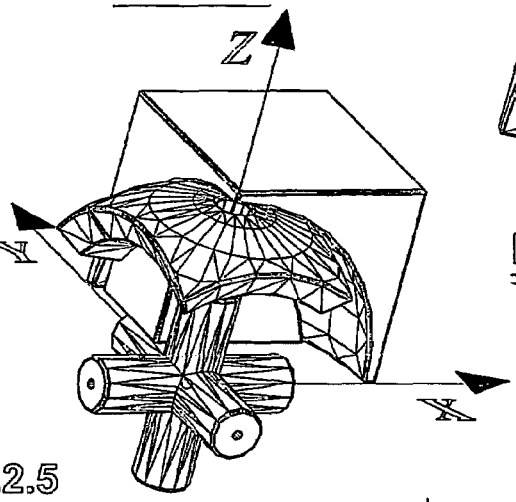
Figure 2:
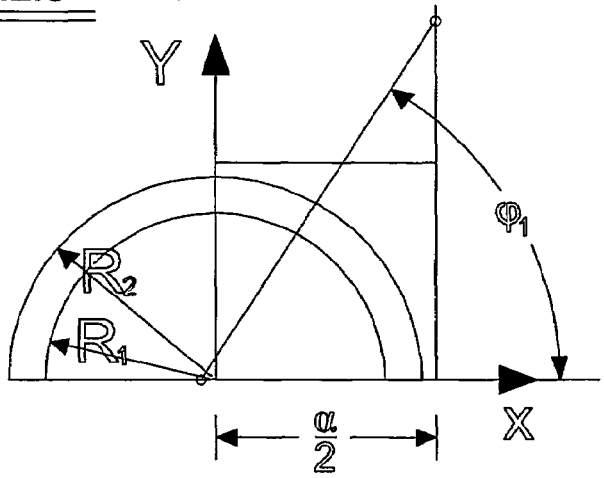
Figure 2:
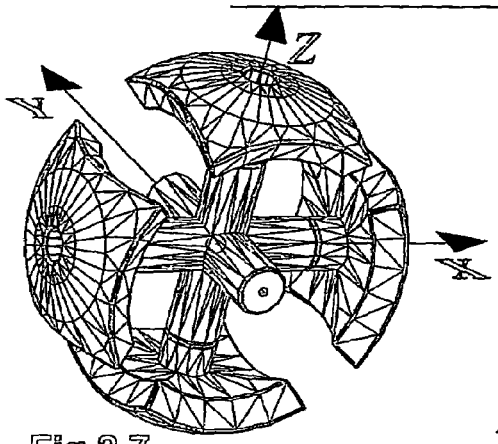
Figure 2:
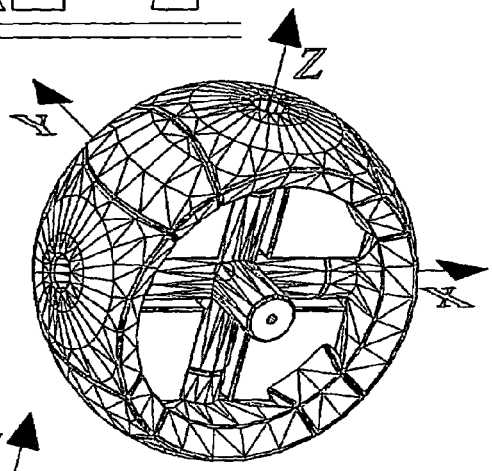
Figure 2:
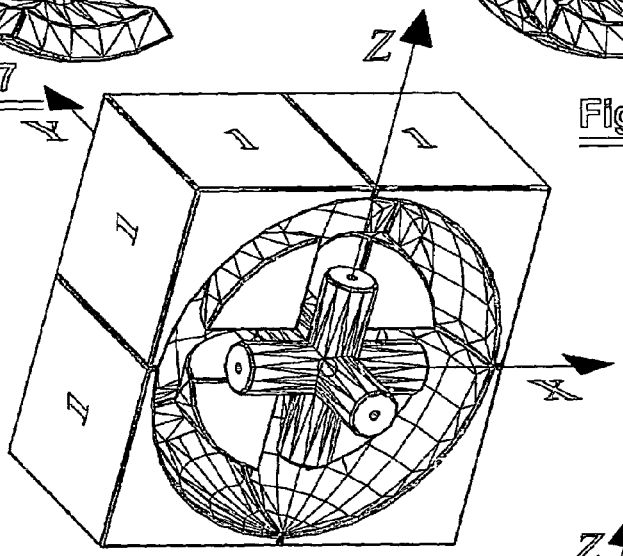
Figure 2:
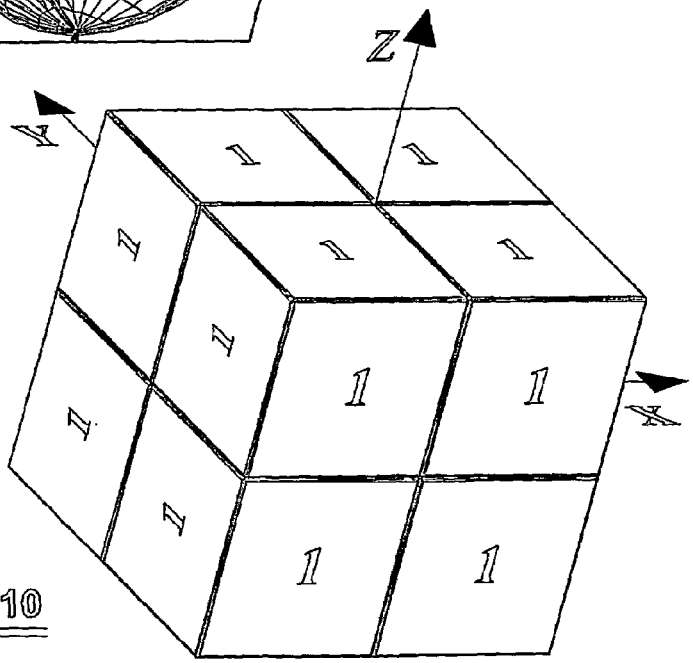

It is enough, therefore, to compare the FIG. 1.6 with the FIGS. 2.1, 3.1, 4.1, 5.1, 6*a*.1, 6*b*.1 7.1, 8.1, 9.1, 10.1, 11.1, in order to find out the unified manufacturing way of the corner piece of each cube according to the present invention. In the above-mentioned figures one can clearly see the three discernible parts of the corner pieces; the first part which is substantially cubic, the second part which is of a conical sphenoid shape and the third part which is a part of a sphere. Comparing the figures is enough to prove that the invention is unified although it finally produces more than one solids.

The other separate pieces are produced exactly the same way and their shape that depends on the pieces' place in the final solid is alike. Their conical sphenoid part, for the configuration of which at least four conical surfaces are used, can have the same cross section all over its length or different cross-section per parts. Whatever the case, the shape of the cross-section of the said sphenoid part is either of an isosceles spherical trapezium or of any spherical quadrilateral. The configuration of this conical sphenoid part is such so as to create on each separate piece the above-mentioned recesses-protrusions whereby each separate piece is intercoupled and supported by its neighbouring pieces. At the same time, the configuration of the conical sphenoid part in combination with the third lower part of the pieces creates general spherical recesses-protrusions between adjacent layers, securing the stability of the construction and guiding the layers during rotation around the axes. Finally, the lower part of the separate pieces is a piece of a sphere or of spherical shell.

It should also be clarified that the angle $\phi 1$ of the first cone k1 should be greater than 54,73561032° when the cone apex coincides with the coordinates beginning. However, if the cone apex moves to the semi-axis lying opposite to the semi-axis which points to the direction in which the surface widens, then the angle $\phi 1$ could be slightly less than 54,73561032° and this is the case especially when the number of layers increases.

We should also note that the separate pieces of each cube are fixed on a central three-dimensional solid cross whose six legs are cylindrical and on which we screw the six caps of each cube with the appropriate screws. The caps, that is the central separate pieces of each face, whether they are visible or not, are appropriately formed having a hole (FIG. 1.7) through which the support screw passes after being optionally surrounded with appropriate springs (FIG. 1.8). The way of supporting is similar to the support of the Rubik cube.

Finally, we should mention that after the support screw passes through the hole in the caps of the cubes, especially in the ones with an even number of layers, it is covered with a flat plastic piece fitted in the upper cubic part of the cap.

The present invention is fully understood by anyone who has a good knowledge of visual geometry. For that reason there is an analytic description of FIGS. from 2 to 11 accompanying the present invention and proving that:

a) The invention is a unified inventive body.

b) The invention improves the up to date manufactured in several ways and by several inventor cubes, that is 2×2×2, 4×4×4 and 5×5×5 cubes, which, however, present problems during their rotation.

c) The classic and functioning without problems Rubik cube, i.e. the 3×3×3 cube, is included in that invention with some minor modifications.

d) It expands for the first time worldwide, from what we know up to now, the logic toys series of substantially cubic shape up to the number No 11, i.e. the cube with 11 different layers per direction.

Finally, we should mention that, because of the absolute symmetry, the separate pieces of each cube form groups of similar pieces, the number of said groups depending on the number $\kappa$ of the conical surfaces per semi-axis of the cube, and said number being a triangle or triangular number. As it is already known, triangle or triangular numbers are the numbers that are the partial sums of the series $\Sigma = 1+2+3+4+\ldots+\nu$, i.e. of the series the difference between the successive terms of which is 1. In this case the general term of the series is $\nu = \kappa + 1$.

In FIGS. 2 to 11 of the present invention one can easily see:

a) The shape of all the different separate pieces each cube is consisted of.

b) The three discernible parts of each separate piece; the first outermost part which is substantially cubic, the second intermediate part which is of a conical sphenoid shape and the third innermost part which is a part of a sphere or of a spherical shell.

c) The above-mentioned recesses-protrusions on the different separate pieces whenever necessary.

d) The above-mentioned between adjacent layers general spherical recesses-protrusions, which secure the stability of construction and guide the layers during rotation around the axes.

II. Thus, when $\kappa = 1$ and $N = 2k = 2\times1 = 2$, i.e. for the cubic logic toy No 2, we have only (3) three different kinds of separate pieces. The corner piece 1 (FIG. 2.1) and in total eight similar pieces, all visible to the toy user, the intermediate piece 2 (FIG. 2.2) and in total twelve similar pieces, all of non visible to the toy user and piece 3, the cap of the cube, and in total six similar pieces all non visible to the toy user.

Finally, piece 4 is the non-visible central, three-dimensional solid cross that supports the cube (FIG. 2.4).

In FIGS. 2.1.1, 2.2.1, 2.2.2 and 2.3.1 we can see the cross sections of these pieces.

In FIG. 2.5 we can see these three different kinds of pieces of the cube, placed at their position along with the non-visible central three-dimensional solid cross that supports the cube.

In FIG. 2.6 we can see the geometrical characteristics of the cubic logic toy No 2 where $R_1$ and $R_2$ generally represents the radiuses of concentric spherical surfaces that are necessary for the configuration of the internal surfaces of the cube's separate pieces.

In FIG. 2.7 we can see the position of the separate central pieces of the intermediate non-visible layer in each direction on the non-visible central three-dimensional solid cross that supports the cube.

In FIG. 2.8 we can see the position of the separate pieces of the intermediate non-visible layer in each direction on the non-visible central three-dimensional solid cross that supports the cube.

In FIG. 2.9 we can see the position of the separate pieces of the first layer in each direction on the non-visible central three-dimensional solid cross that supports the cube.

Finally, in FIG. 2.10 we can see the final shape of the cubic logic toy No 2. The cubic logic toy No 2 consists of twenty-seven (27) separate pieces in total along with the non-visible central three-dimensional solid cross that supports the cube.

III. When $\kappa=1$ and $N=2\kappa+1=2\times1+1=3$, i.e. the cubic logic toy No 3, we have again (3) three kinds of different, separate pieces. The corner piece 1, (FIG. 3.1) and in total eight similar pieces, all visible to the toy user, the intermediate piece 2 (FIG. 3.2) and in total twelve similar pieces, all visible to the user, and finally piece 3, (FIG. 3.3) the cube cap, and in total six similar pieces, all visible to the toy user. Finally, the piece 4 is the non-visible central three-dimensional solid cross that supports the cube (FIG. 3.4).

Figure 3:
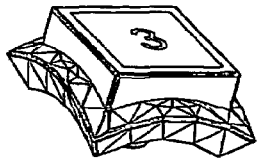
FIGS. 3.1 to 3.10 show views of a cubic logic toy according to another exemplary embodiment of the present invention.
Figure 3:
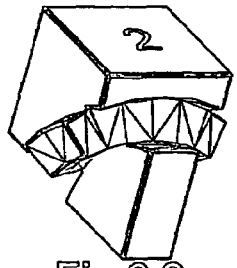
Figure 3:
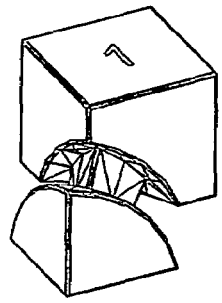
Figure 3:
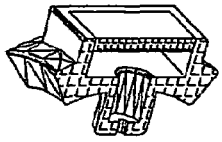
Figure 3:
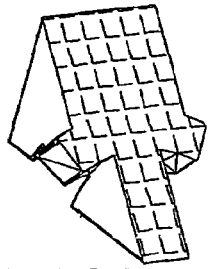
Figure 3:
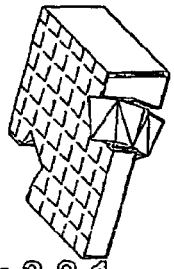
Figure 3:
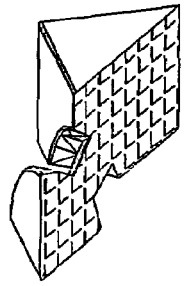
Figure 3:
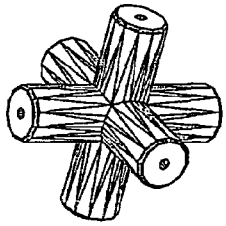
Figure 3:
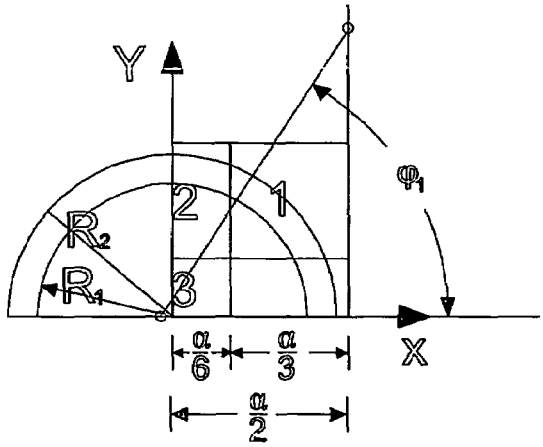
Figure 3:
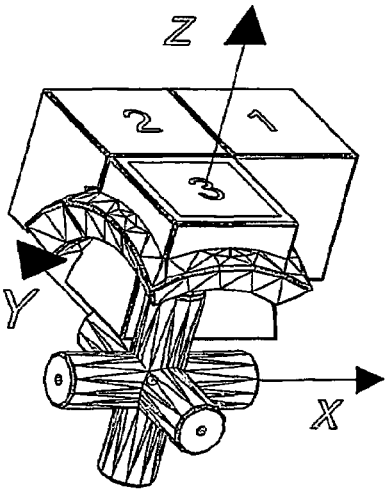
Figure 3:
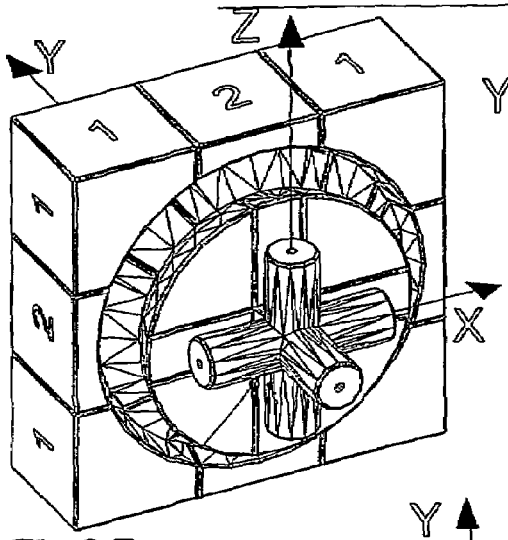
Figure 3:
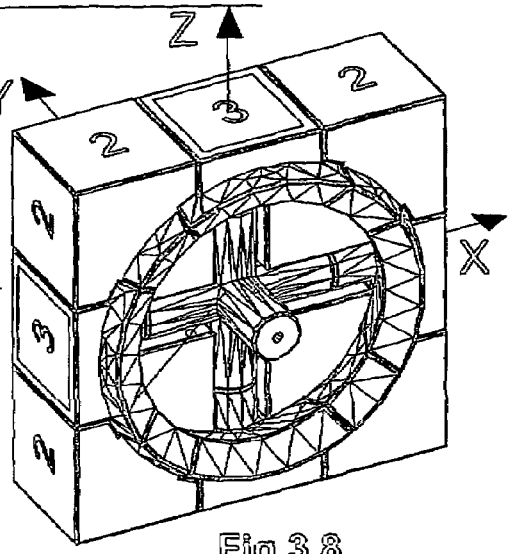
Figure 3:
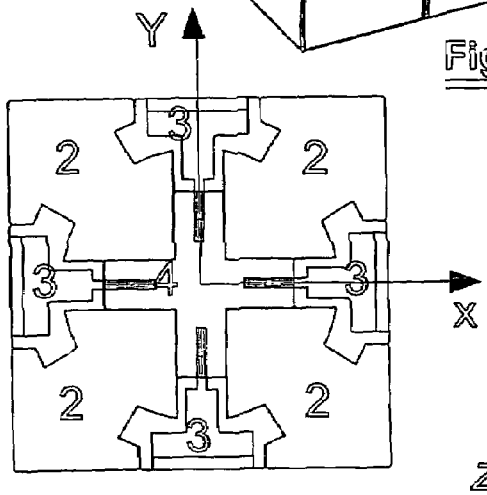
Figure 3:
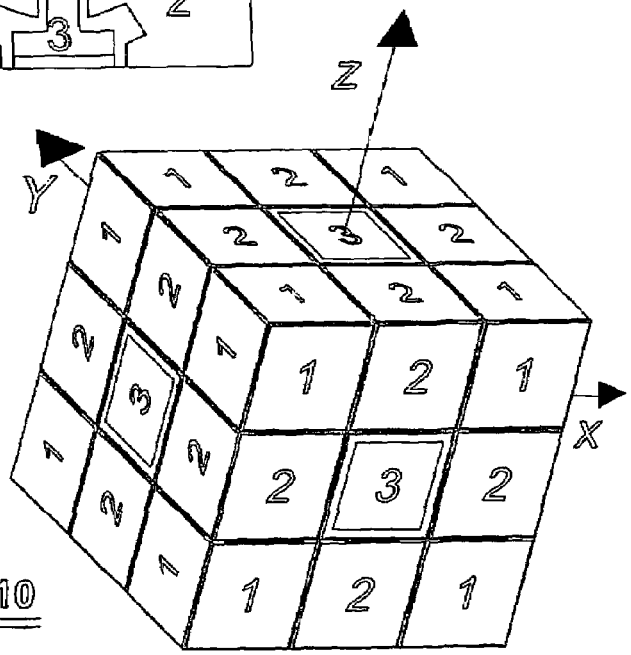

In FIGS. 3.1.1, 3.2.1, 3.2.2, 3.3.1 we can see the cross-sections of these different separate pieces by their symmetry planes.

In FIG. 3.5 we can see these three different pieces placed at their position along with the non-visible central three-dimensional solid cross that supports the cube.

In FIG. 3.6 we can see the geometrical characteristics of the cubic logic toy No 3.

In FIG. 3.7 we can see the internal face of the first layer along with the non-visible central three-dimensional solid cross that supports the cube.

In FIG. 3.8 we can see the face of the intermediate layer in each direction along with the non-visible central three-dimensional solid cross that supports the cube.

In FIG. 3.9 we can see the section of that intermediate layer by an intermediate symmetry plane of the cube.

Finally, in FIG. 3.10 we can see the final shape of the cubic logic toy No 3. The cubic logic toy No 3 consists of twenty-seven (27) separate pieces in total along with the non-visible central three-dimensional solid cross that supports the cube.

By comparing the figures of the cubic logic toys No 2 and No 3, it is clear that the non-visible intermediate layer of the toy No 2 becomes visible in the toy No 3 while both the cubes consist of the same total number of separate pieces. Besides, this has already been mentioned as one of the advantages of the present invention and it proves that it is unified. At this point, it is useful to compare the figures of the separate pieces of the cubic logic toy No 3 with the figures of the separate pieces of the Rubik cube.

The difference between the figures is that the conical sphenoid part of the separate pieces of this invention does not exist in the pieces of the Rubik cube. Therefore, if we remove that conic sphenoid part from the separate pieces of the cubic logic toy No 3, then the figures of that toy will be similar to the Rubik cube figures.

In fact, the number of layers N=3 is small and, as a result, the conical sphenoid part is not necessary, as we have already mentioned the Rubik cube does not present problems during its speed cubing. The construction, however, of the cubic logic toy No 3 in the way this invention suggests, has been made not to improve something about the operation of the Rubik cube but in order to prove that the invention is unified and sequent.

However, we think that the absence of that conical sphenoid part in the Rubik cube, which is the result of the mentioned conical surfaces introduced by the present invention, is the main reason why, up to now, several inventors could not conclude in a satisfactory and without operating problems way of manufacturing these logic toys.

Finally, we should mention that only for manufacturing reasons and for the easy assembling of the cubes when N=2 and N=3, the last but one sphere, i.e. the sphere with $R_1$ radius, shown in FIGS. 2.6 and 3.6, could be optionally replaced by a cylinder of the same radius only for the configuration of the intermediate layer whether it is visible or not, without influencing the generality of the method.

IV. When $\kappa=2$ and $N=2\kappa=2\times2=4$, i.e. for the cubic logic toy No 4, there are (6) six different kinds of separate pieces. Piece 1, (FIG. 4.1) and in total eight similar pieces, all visible to the user, piece 2, (FIG. 4.2) and in total twenty four similar pieces, all visible to the user, piece 3, (FIG. 4.3) and in total twenty four similar pieces, all visible to the user, piece 4, (FIG. 4.4) and in total twelve similar pieces, all non-visible to the user, piece 5, (FIG. 4.5) and in total twenty four similar pieces, all non-visible to the user and piece 6, (FIG. 4.6), the cap of the cubic logic toy No 4, and in total six similar pieces, all non-visible to the user. Finally, in FIG. 4.7 we can see the non-visible central three-dimensional solid cross that supports the cube.

Figure 4:
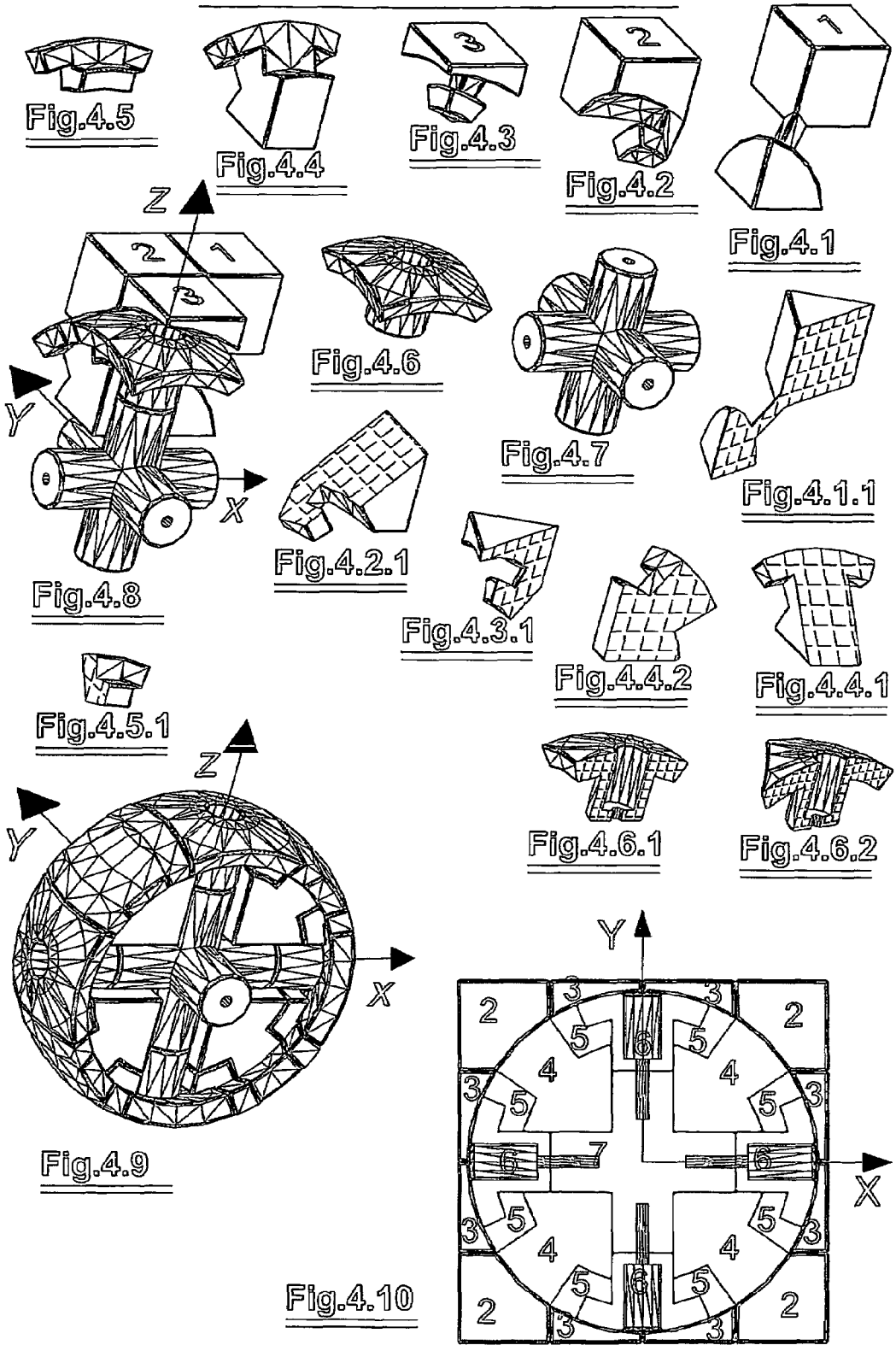
FIGS. 4.1 to 4.16 show views of a cubic logic toy according to another exemplary embodiment of the present invention.
Figure 4:
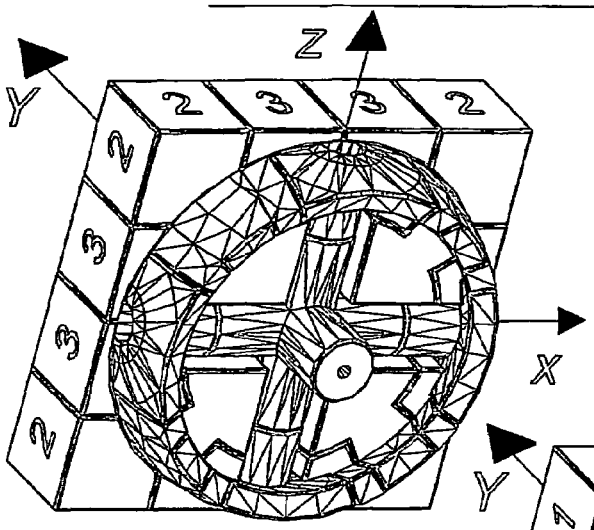
Figure 4:
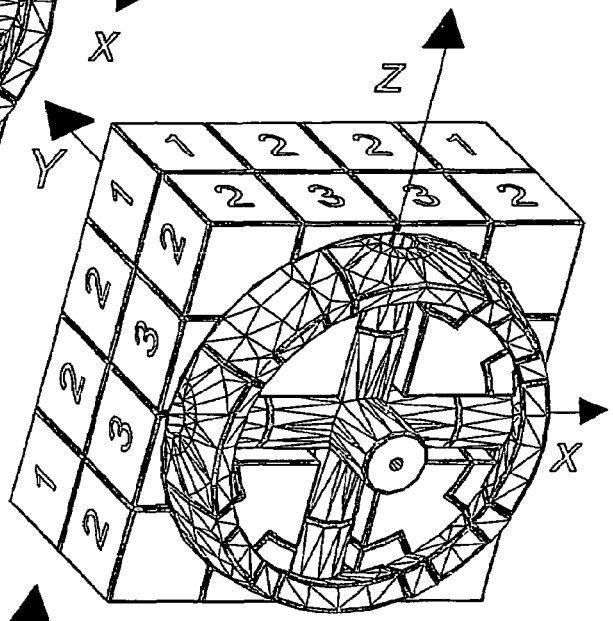
Figure 4:
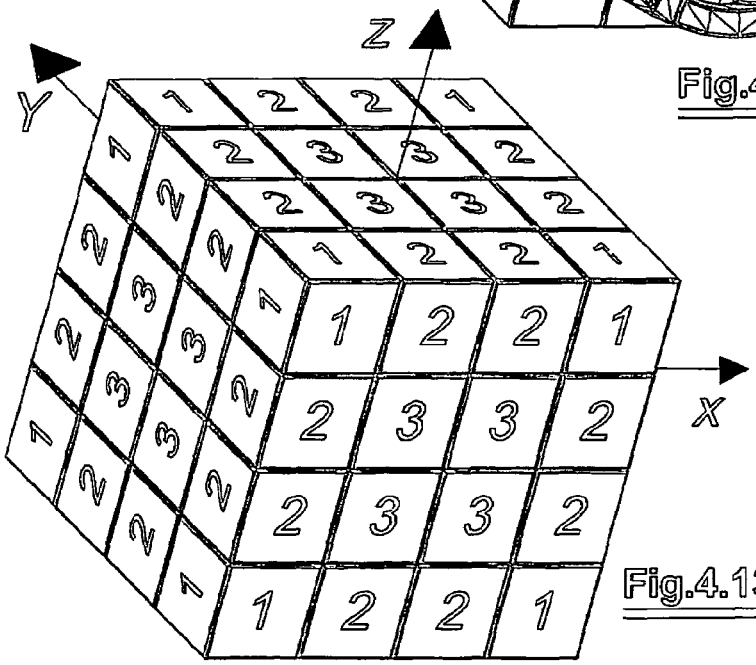
Figure 4:
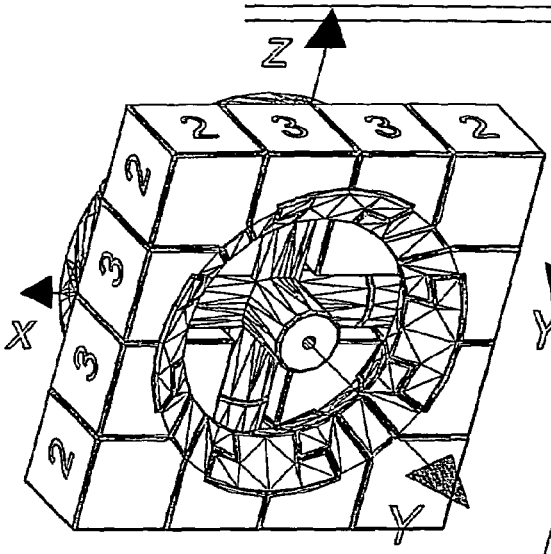
Figure 4:
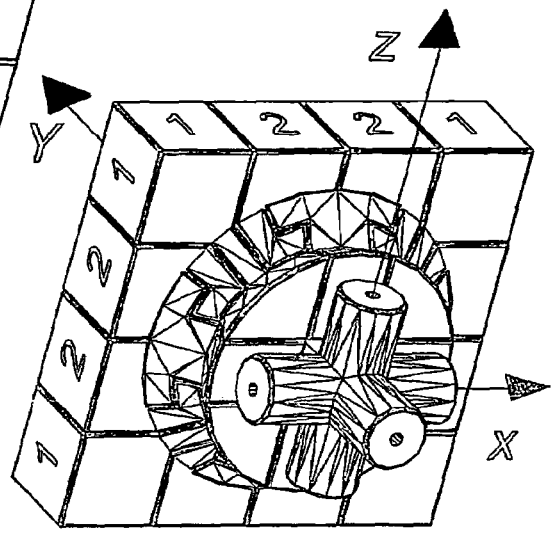
Figure 4:
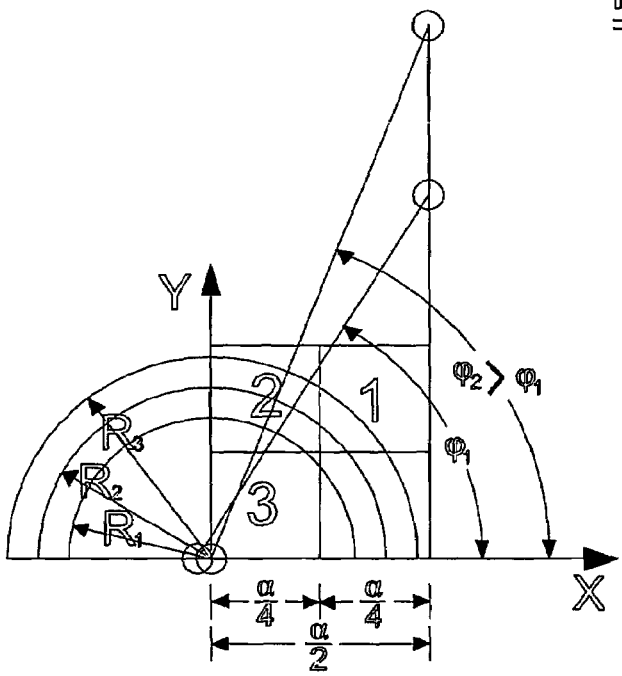

In FIGS. 4.1.1, 4.2.1, 4.3.1, 4.4.1, 4.4.2, 4.5.1, 4.6.1 and 4.6.2 we can see the cross sections of these different separate pieces.

In FIG. 4.8 we can see at an axonometric projection these different pieces placed at their positions along with the non-visible central three-dimensional solid cross that supports the cube No 4.

In FIG. 4.9 we can see the intermediate non-visible layer in each direction along with the non-visible central three-dimensional solid cross that supports the cube.

In FIG. 4.10 we can see the section of the pieces of the intermediate non-visible layer by an intermediate symmetry plane of the cube, as well as the projection of the pieces of the second layer of the cube on the said intermediate layer.

In FIG. 4.11 we can see at an axonometric projection the non-visible intermediate layer and the supported on it, second layer of the cube.

In FIG. 4.12 we can see at an axonometric projection the fist and the second layer along with the intermediate non-visible layer and the non-visible central three-dimensional solid cross that supports the cube.

In FIG. 4.13 we can see the final shape of the cubic logic toy No 4.

In FIG. 4.14 we can see the external face of the second layer with the intermediate non-visible layer and the non-visible central three-dimensional solid cross that supports the cube.

In FIG. 4.15 we can see the internal face of the first layer of the cube with the non-visible central three-dimensional solid cross that supports the cube.

Finally, in FIG. 4.16 we can see the geometrical characteristics of the cubic logic toy No 4, for the configuration of the internal surfaces of the separate pieces of which, two conical surfaces per semi-direction of the three-dimensional rectangular Cartesian coordinate system have been used. The cubic logic toy No 4 consists of ninety-nine (99) separate pieces in total along with the non-visible central three-dimensional solid cross that supports the cube.

V. When $\kappa=2$ and $N=2\kappa+1=2\times2+1=5$, i.e. for the cubic logic toy No 5, there are again (6) six different kinds of separate pieces, all visible to the user. Piece 1, (FIG. 5.1) and in total eight similar pieces, piece 2, (FIG. 5.2) and in total twenty four similar pieces, piece 3, (FIG. 5.3) and in total twenty four similar pieces, piece 4, (FIG. 5.4) and in total twelve similar pieces, piece 5, (FIG. 5.5) and in total twenty four similar pieces, and piece 6, (FIG. 4.6) the cap of the cubic logic toy No 5 and in total six similar pieces. Finally, in FIG. 5.7 we can see the non-visible central three-dimensional solid cross that supports the cube.

Figure 5:
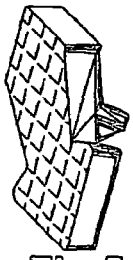
FIGS. 5.1 to 5.17 show views of a cubic logic toy according to another exemplary embodiment of the present invention.
Figure 5:
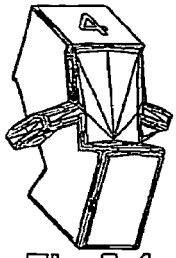
Figure 5:
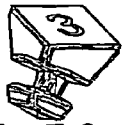
Figure 5:
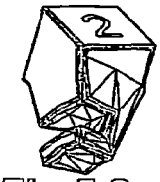
Figure 5:
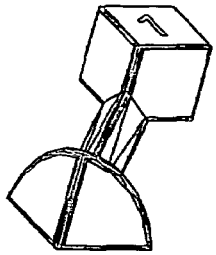
Figure 5:
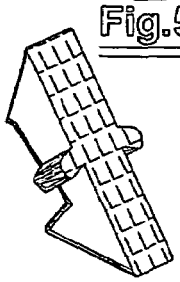
Figure 5:
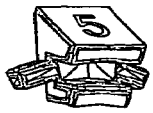
Figure 5:
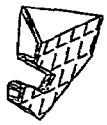
Figure 5:
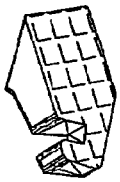
Figure 5:
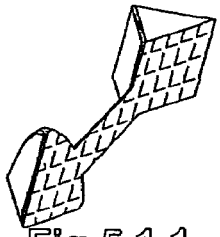
Figure 5:
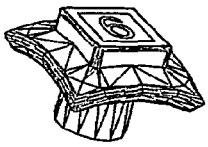
Figure 5:
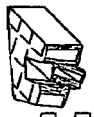
Figure 5:
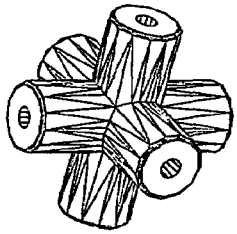
Figure 5:
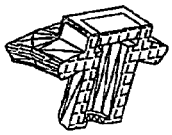
Figure 5:
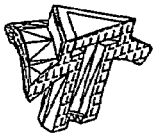
Figure 5:
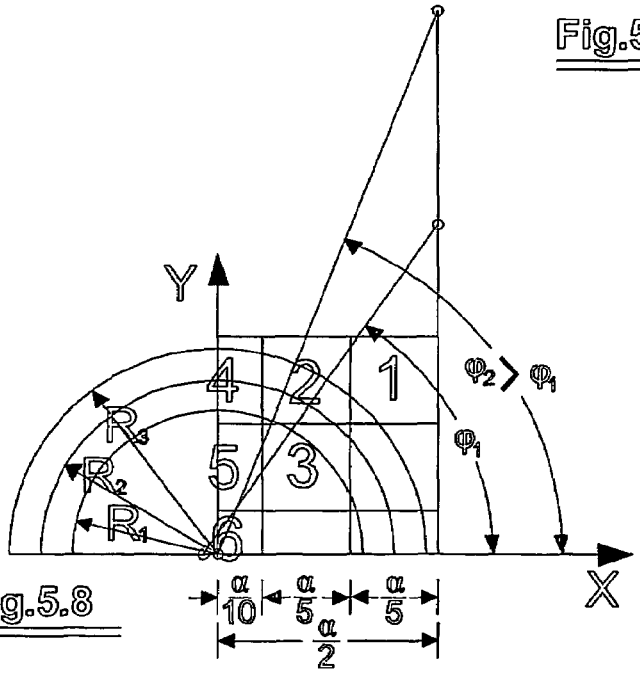
Figure 5:
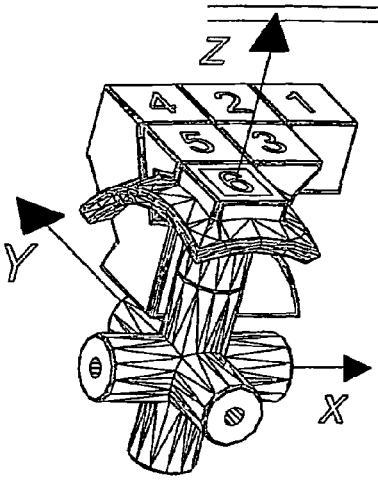
Figure 5:
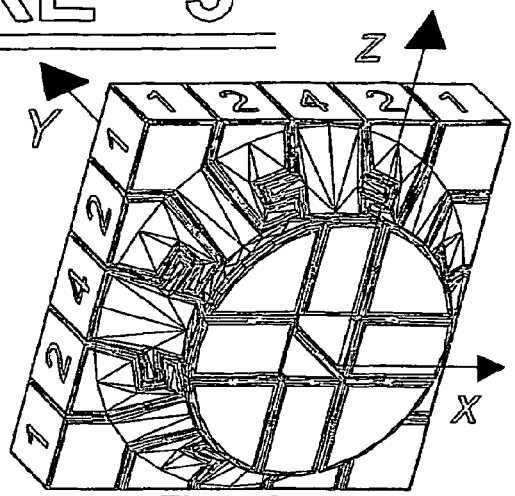
Figure 5:
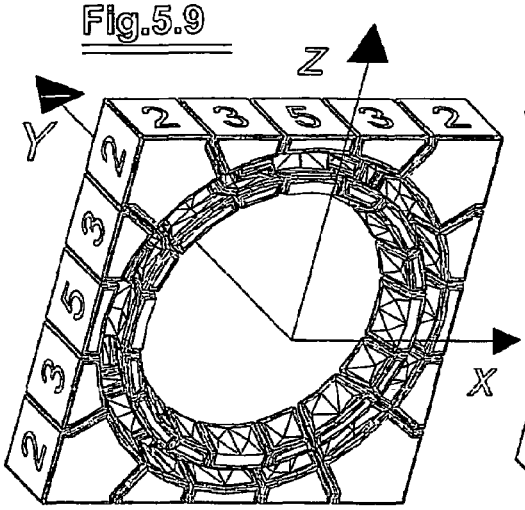
Figure 5:
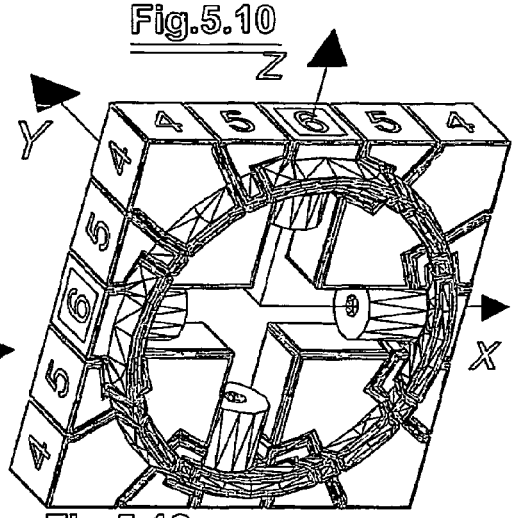
Figure 5:
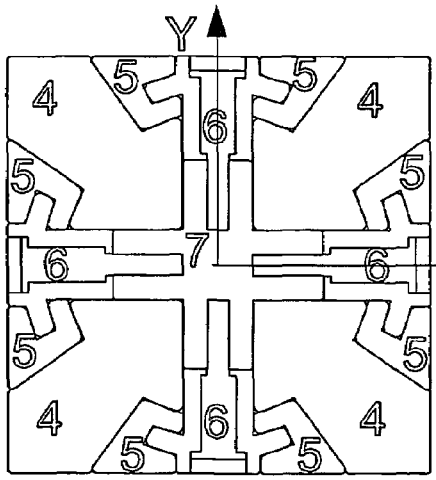
Figure 5:
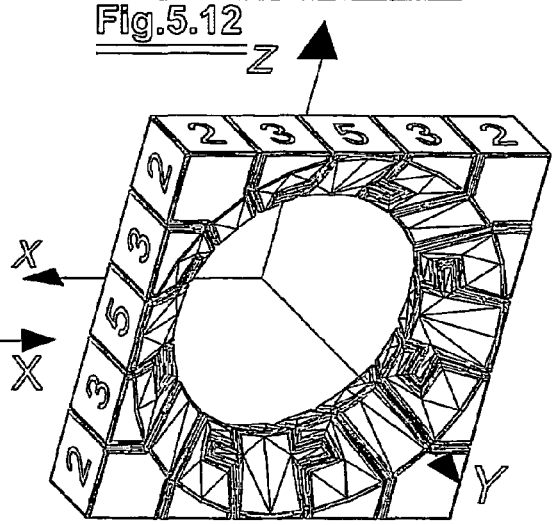
Figure 5:
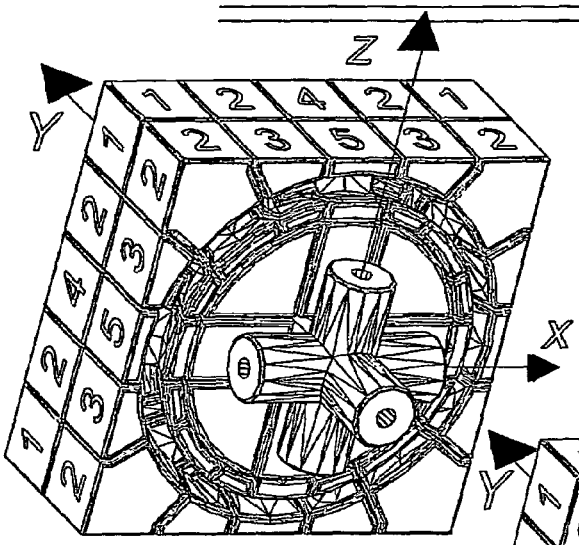
Figure 5:
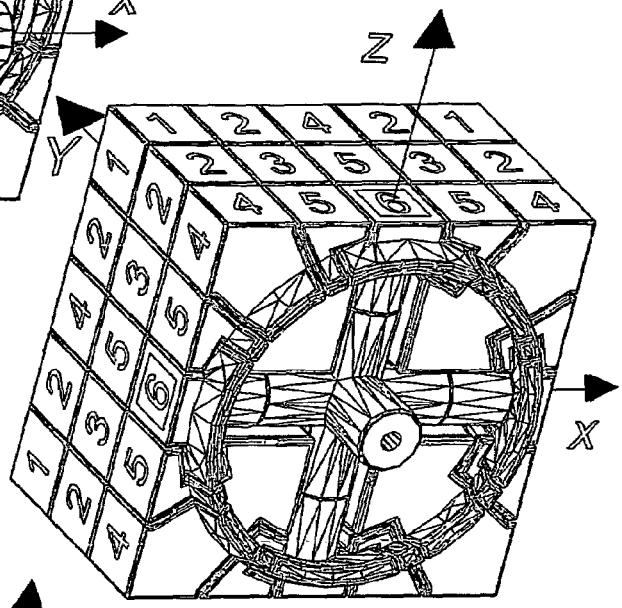
Figure 5:
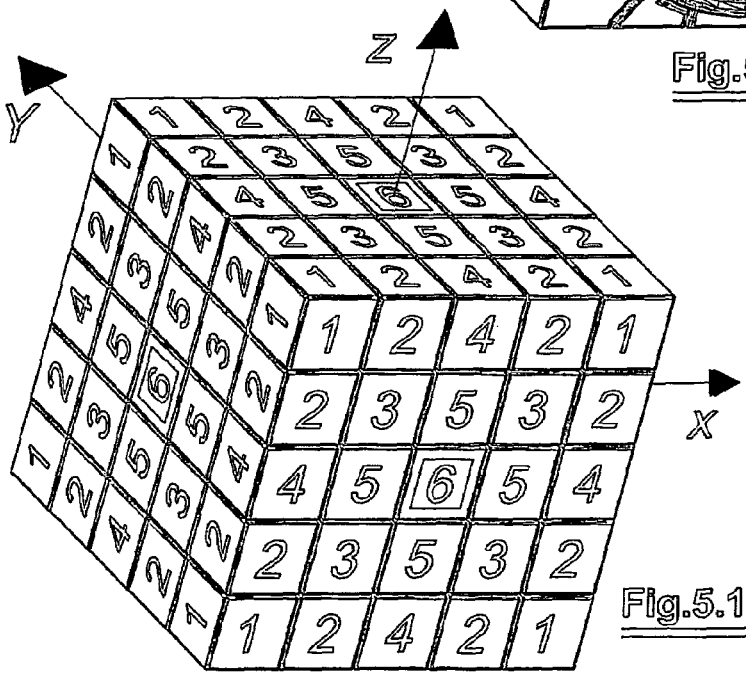

In FIGS. 5.1.1, 5.2.1, 5.3.1, 5.4.1, 5.4.2, 5.5.1, 5.6.1, 5.6.2 we can see the cross sections of these different separate pieces.

In FIG. 5.8 we can see the geometrical characteristics of the cubic logic toy No 5, for the configuration of the internal surfaces of the separate pieces of which, two conical surfaces per semi-direction of the three-dimensional rectangular Cartesian coordinate system have been used.

In FIG. 5.9 we can see at an axonometric projection these six different pieces placed at their position along with the non-visible central three-dimensional solid cross that supports the cube.

In FIG. 5.10 we can see the internal face of the first layer of the cubic logic toy No 5.

In FIG. 5.11 we can see the internal face of the second layer and in FIG. 5.14 its external face.

In FIG. 5.12 we can see the face of the intermediate layer of the cubic logic toy No 5 along with the non-visible central three-dimensional solid cross that supports the cube.

In FIG. 5.13 we can see the section of the pieces of the intermediate layer of the cube No 5 and the section of the non-visible central three-dimensional solid cross that supports the cube by an intermediate symmetry plane of the cube.

In FIG. 5.15 we can see the first and the second layer with the non-visible central three-dimensional solid cross that supports the cube.

In FIG. 5.16 we can see the first, the second and the intermediate layer with the non-visible central three-dimensional solid cross that supports the cube.

Finally, in FIG. 5.17 we can see the final shape of the cubic logic toy No 5.

The cubic logic toy No 5 consists of ninety-nine (99) separate pieces in total along with the non-visible central three-dimensional solid cross that supports the cube, the same number of pieces as in the cubic logic toy No 4.

VI.a When $\kappa=3$, that is when we use three conical surfaces per semi axis of the three-dimensional rectangular Cartesian coordinate system and $N=2\kappa=2\times3=6$ that is for the cubic logic toy No **6*a***, whose final shape is cubic, we have (10) different kinds of separate pieces, of which only the first six are visible to the user, whereas the next four are not.

Piece 1 (FIG. **6*a*.1) and in total eight similar pieces, piece 2 (FIG. 6*a*.2) and in total twenty-four similar pieces, piece 3 (FIG. 6*a*.3) and in total twenty-four similar pieces, piece 4 (FIG. 6*a*.4) and in total twenty-four similar pieces, piece 5 (FIG. 6*a*.5) and in total forty-eight similar pieces, piece 6 (FIG. 6*a*.6) and in total twenty-four similar pieces, up to this point all visible to the user of the toy. The non-visible, different pieces that form the intermediate non visible layer in each direction of the cubic logic toy No 6*a* are: piece 7 (FIG. 6*a*.7) and in total twelve similar pieces, piece 8 (FIG. 6*a*.8) and in total twenty-four similar pieces, piece 9 (FIG. 6*a*.9) and in total twenty-four similar pieces and piece 10 (FIG. 6*a*.10) and in total six similar pieces, the caps of the cubic logic toy No 6*a*. Finally, in FIG. 6*a*.11 we can see the non-visible central three-dimensional solid cross that supports the cube No 6*a***.

In FIG. **6*a*.1.1, 6*a*.2.1, 6*a*.3.1, 6*a*.4.1, 6*a*.5.1, 6*a*.6.1, 6*a*.7.1, 6*a*.7.2, 6*a*.8.1, 6*a*.9.1, 6*a*.10.1 and 6*a*.10.2 we can see the cross-sections of the ten separate, different pieces of the cubic logic toy No 6*a***.

In FIG. **6*a*.12 we can see these ten different pieces of the cubic logic toy No 6*a***, placed at their position along with the non visible central three-dimensional solid cross that supports the cube.

In FIG. **6*a*.13 we can see the geometrical characteristics of the cubic logic toy No 6*a***, where for the configuration of the internal surfaces of its separate pieces three conical surfaces have been used per semi direction of the three-dimensional rectangular Cartesian coordinate system.

In FIG. **6*a*.14 we can see the internal face of the first layer of the cubic logic toy No 6*a*** along with the non visible central three-dimensional solid cross that supports the cube.

Figure 6A:
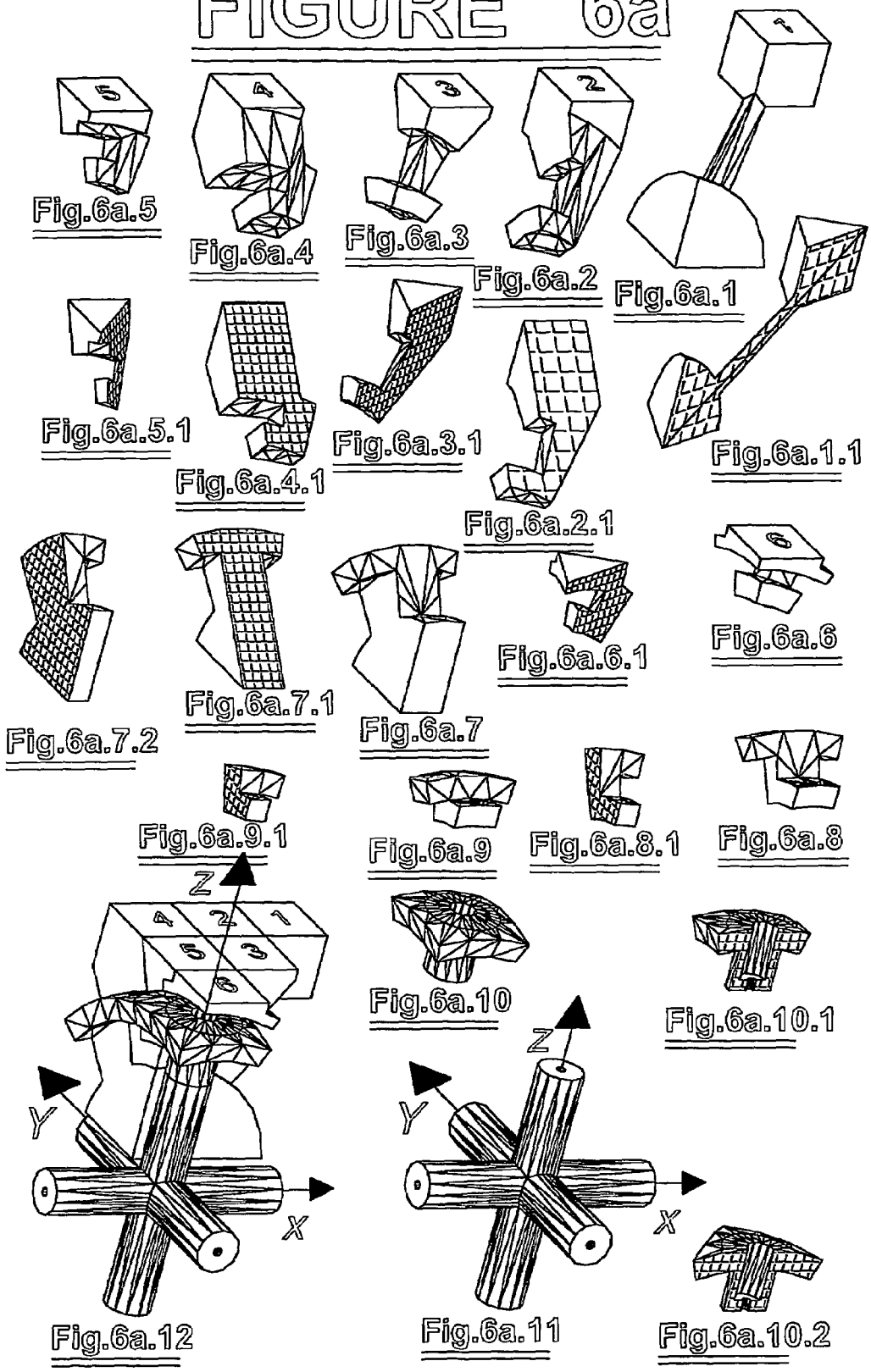
FIGS. 6*a*.1 to 6*a*.22 show views of a cubic logic toy according to another exemplary embodiment of the present invention.
Figure 6A:
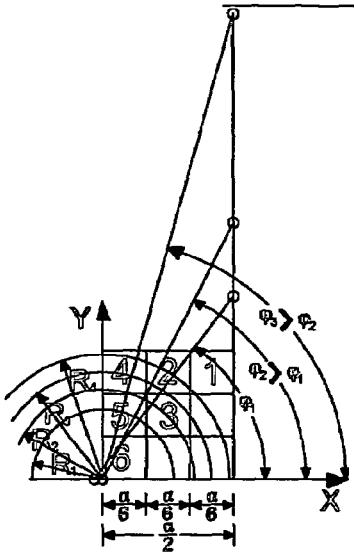
Figure 6A:
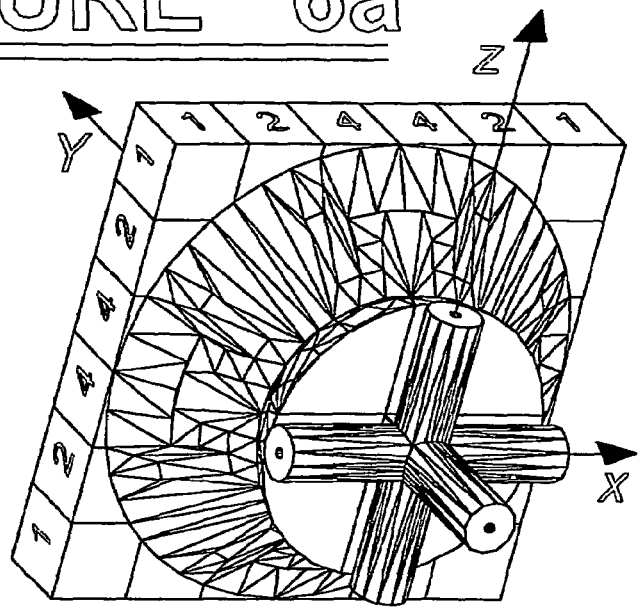
Figure 6A:
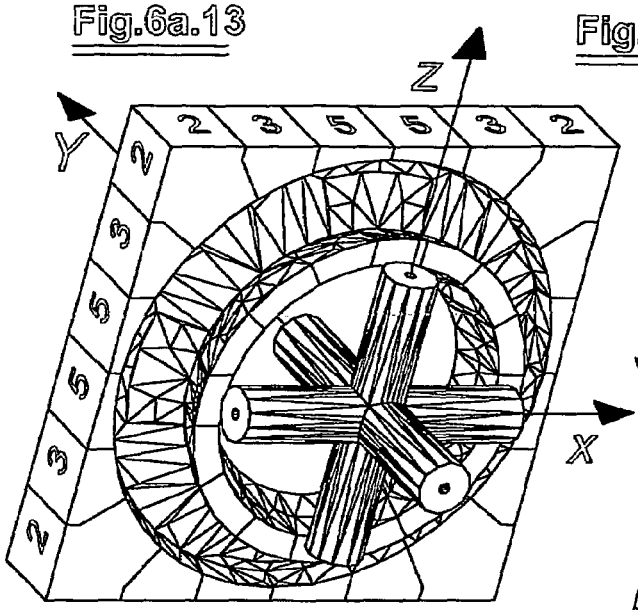
Figure 6A:
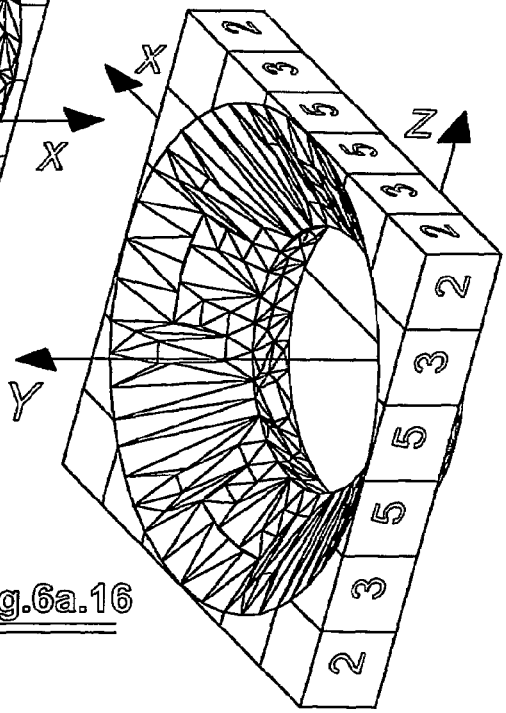
Figure 6A:
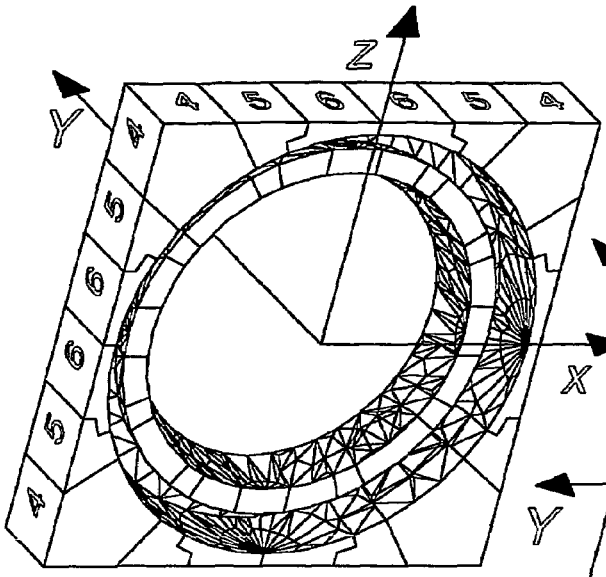
Figure 6A:
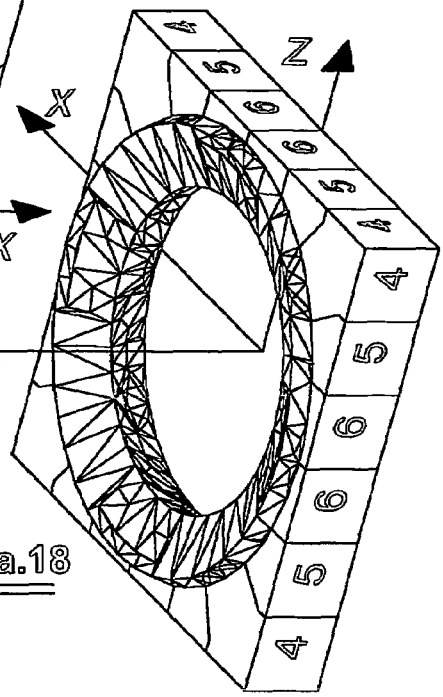
Figure 6A:
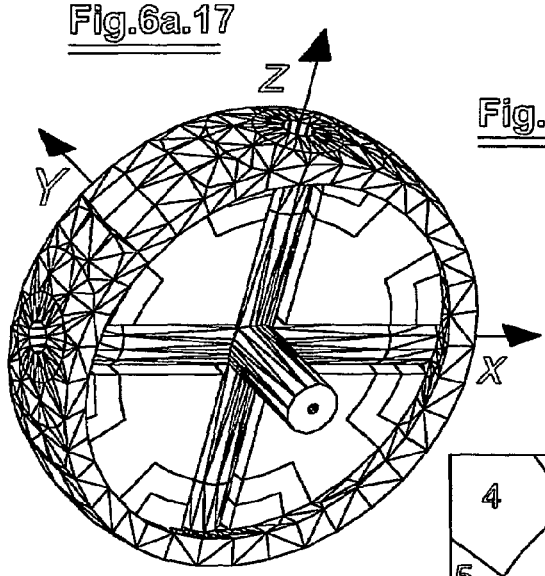
Figure 6A:
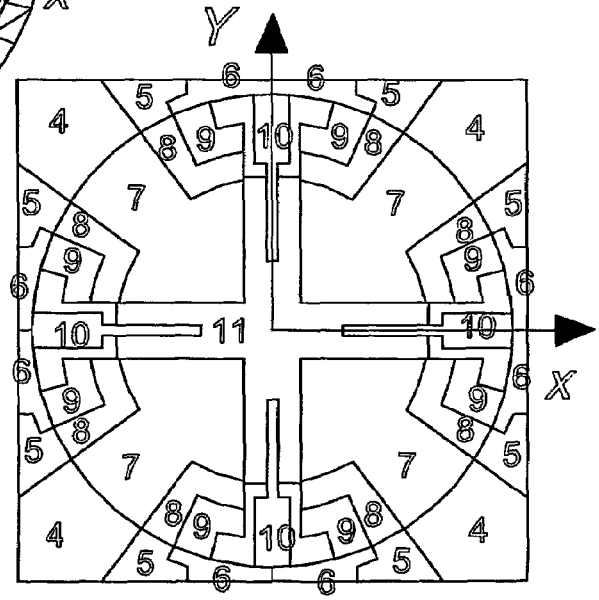
Figure 6A:
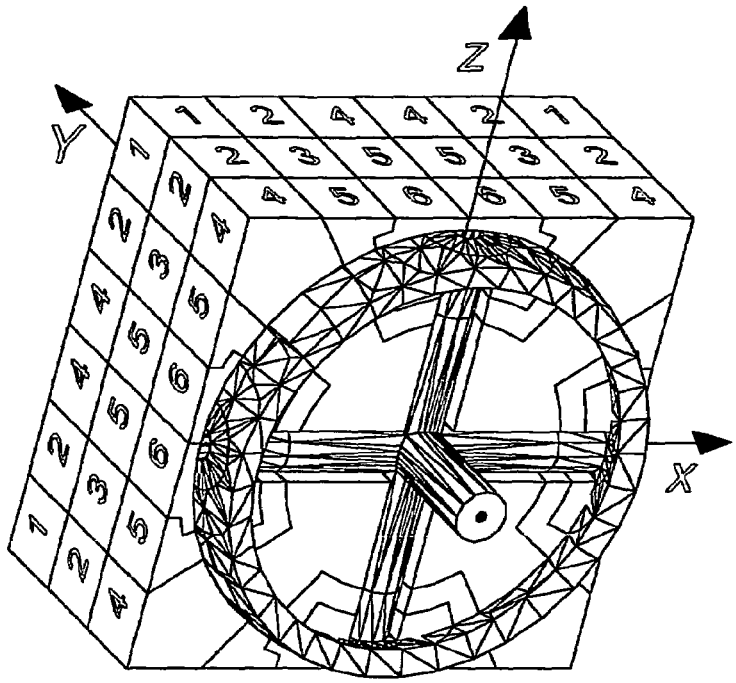
Figure 6A:
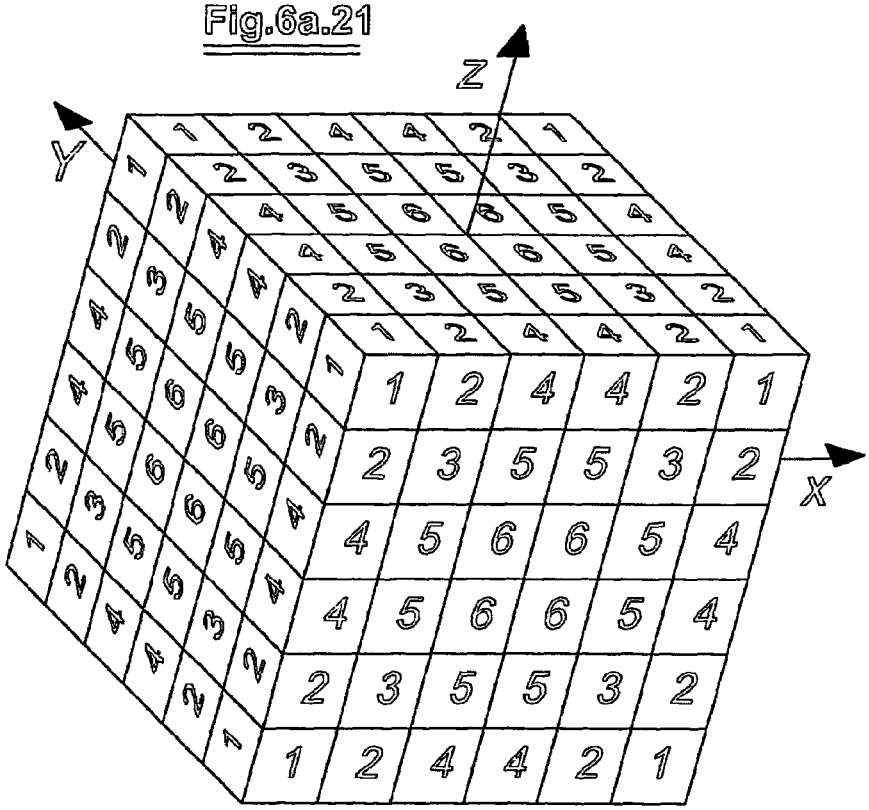

In FIG. **6*a*.15 we can see the internal face and in FIG. 6*a*.16 we can see the external face of the second layer of the cubic logic toy No 6*a***.

In FIG. **6*a*.17 we can see the internal face and in FIG. 6*a*.18 we can see the external face of the third layer of the cubic logic toy No 6*a***.

In FIG. **6*a*.19** we can see the face of the non-visible intermediate layer in each direction along with the non-visible central three-dimensional solid cross that supports the cube.

In FIG. **6*a*.20 we can see the sections of the separate pieces of the intermediate layer as well as of the non visible central three dimensional solid cross that supports the cube by an intermediate symmetry plane of the cube, and we can also see the projection of the separate pieces of the third layer on this plane, said third layer being supported on the intermediate layer of the cubic logic toy No 6*a***.

In FIG. **6*a*.21** we can see at an axonometric projection the first three layers that are visible to the user, as well as the intermediate non visible layer in each direction and the non visible central three-dimensional solid cross that supports the cube.

Finally, in FIG. **6*a*.22 we can see the final shape of the cubic logic toy No 6*a***.

The cubic logic toy No **6*a*** consists of two hundred and nineteen (219) separate pieces in total along with the non-visible central three-dimensional solid cross that supports the cube.

VI.b When $\kappa=3$, that is when we use three conical surfaces per semi axis of the three-dimensional rectangular Cartesian coordinate system and $N=2\kappa=2\times3=6$, that is for the cubic logic toy No **6*b***, whose final shape is substantially cubic, its faces consisting of spherical surfaces of long radius, we have (10) different kinds of separate pieces, of which only the first six are visible to the user, whereas the next four are not.

Piece 1 (FIG. **6*b*.1) and in total eight similar pieces, piece 2 (FIG. 6*b*.2) and in total twenty-four similar pieces, piece 3 (FIG. 6*b*.3) and in total twenty-four similar pieces, piece 4 (FIG. 6*b*.4) and in total twenty-four similar pieces, piece 5 (FIG. 6*b*.5) and in total forty eight similar pieces, piece 6 (FIG. 6*b*.6) and in total twenty-four similar pieces, up to this point all visible to the user. The non visible different pieces that form the intermediate non visible layer in each direction of the cubic logic toy No 6*b* are: piece 7 (FIG. 6*b*.7) and in total twelve similar pieces, piece 8 (FIG. 6***b*.8) and in total twenty-four similar pieces, piece 9 (FIG. 6*b*.9) and in total twenty-four similar pieces and piece 10 (FIG. 6*b*.10) and in total six similar pieces, the caps of the cubic logic toy No 6*b*. Finally, in FIG. 6*b*.11 we can see the non-visible central three-dimensional solid cross that supports the cube No 6*b*.

Figure 6B:
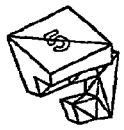
FIGS. 6*b*.1 to 6*b*.22 show views of a cubic logic toy according to another exemplary embodiment of the present invention.
Figure 6B:
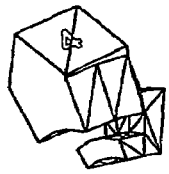
Figure 6B:
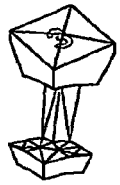
Figure 6B:
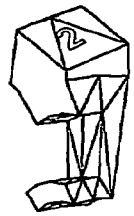
Figure 6B:
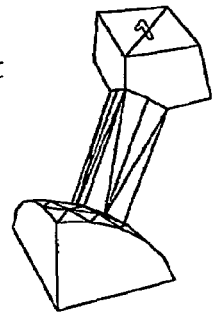
Figure 6B:
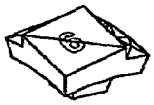
Figure 6B:
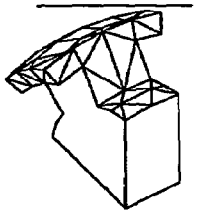
Figure 6B:
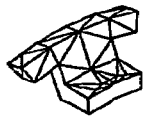
Figure 6B:
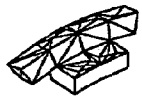
Figure 6B:
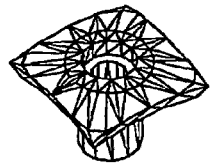
Figure 6B:
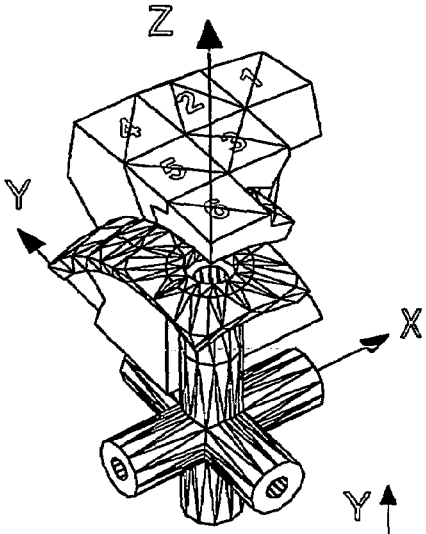
Figure 6B:
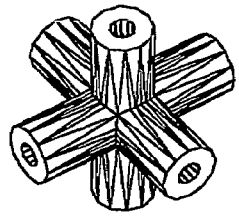
Figure 6B:
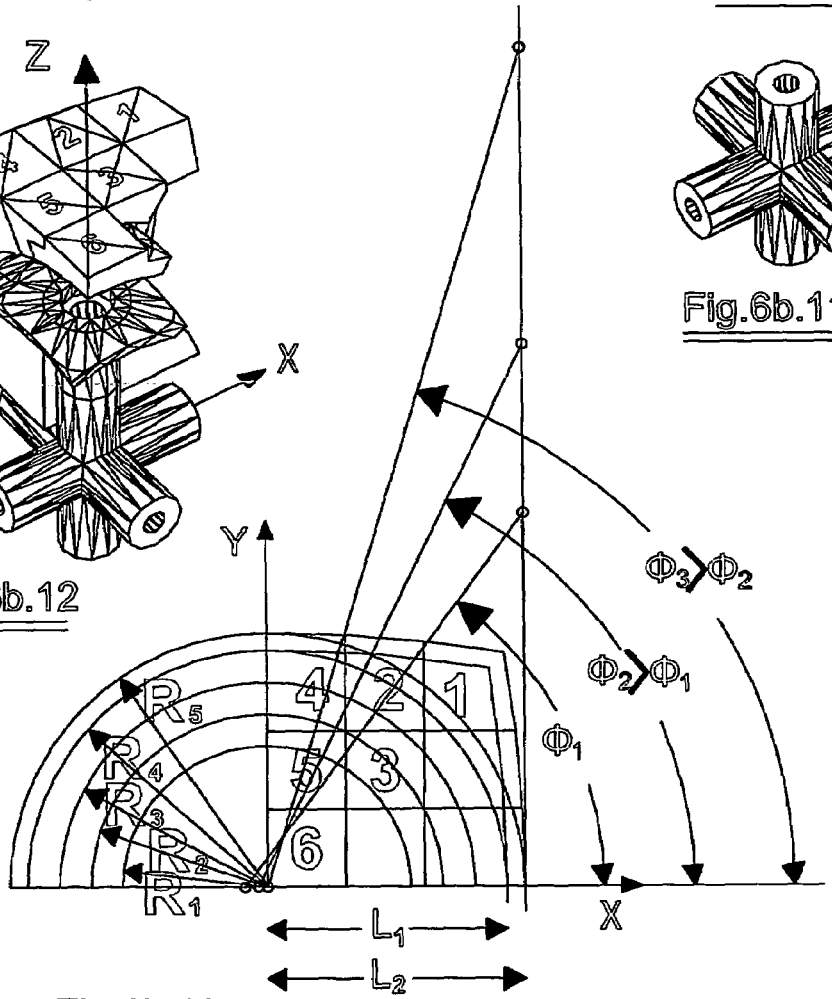
Figure 6B:
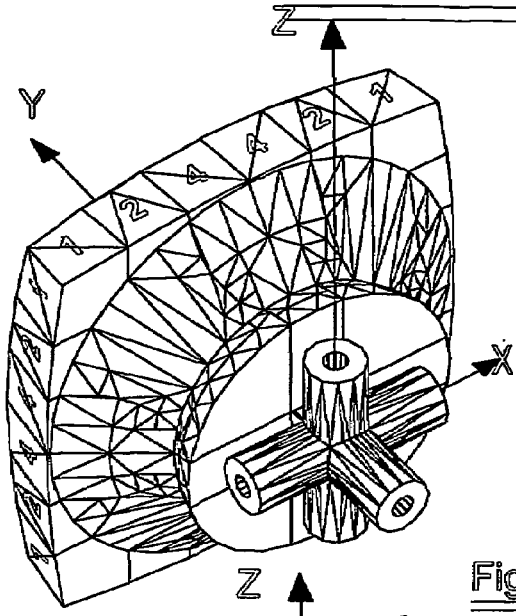
Figure 6B:
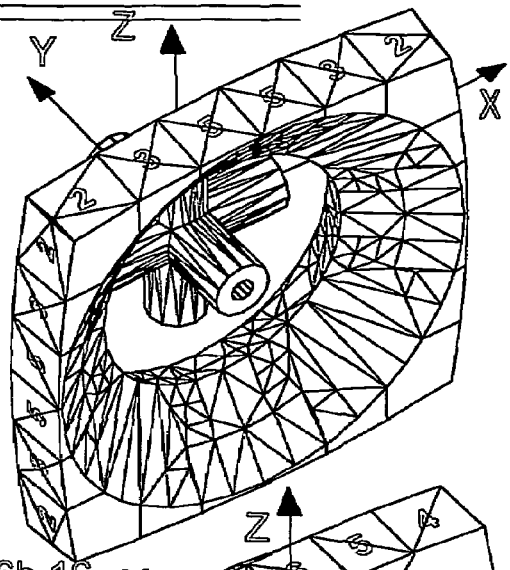
Figure 6B:
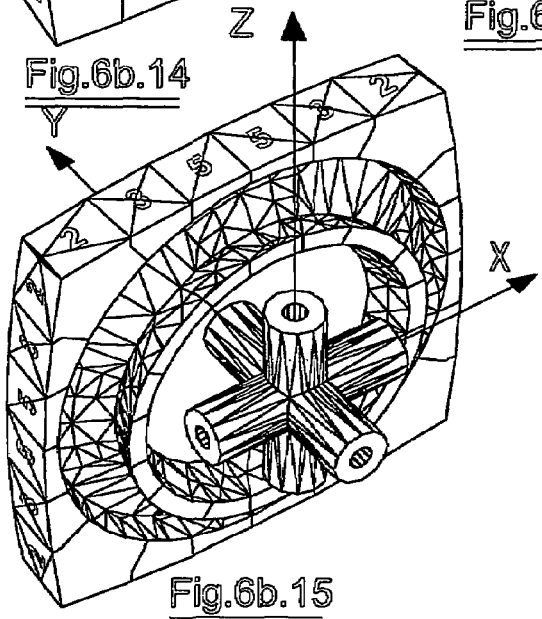
Figure 6B:
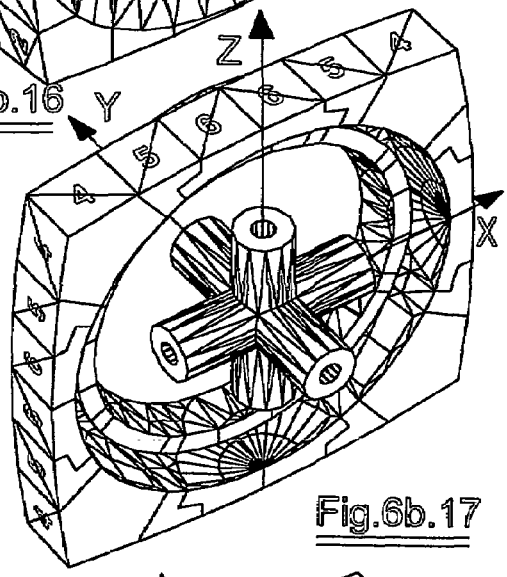
Figure 6B:
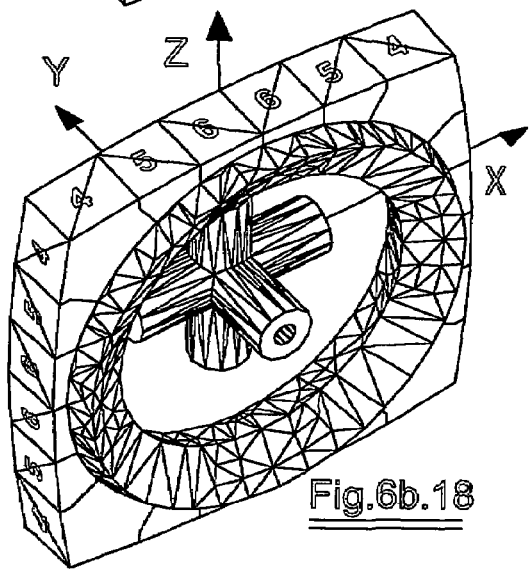
Figure 6B:
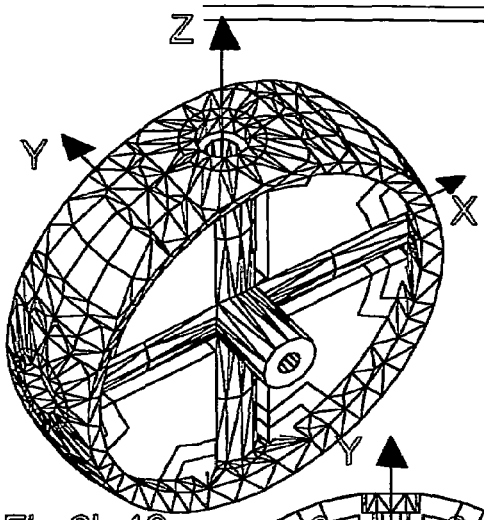
Figure 6B:
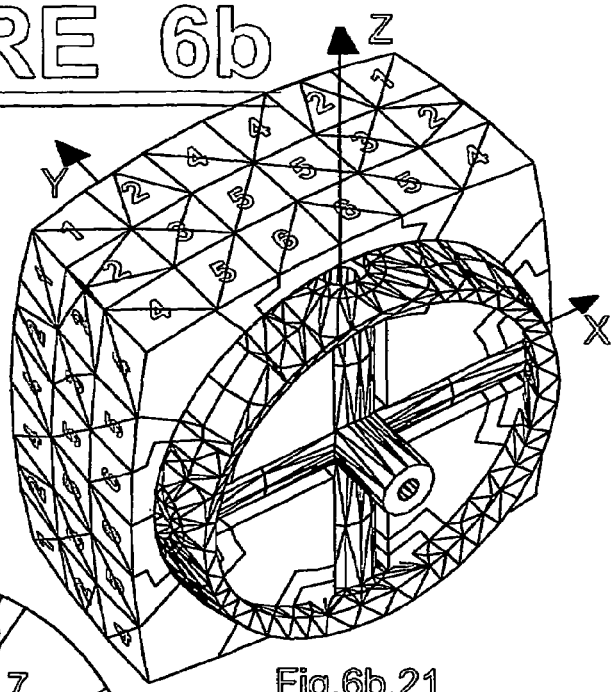
Figure 6B:
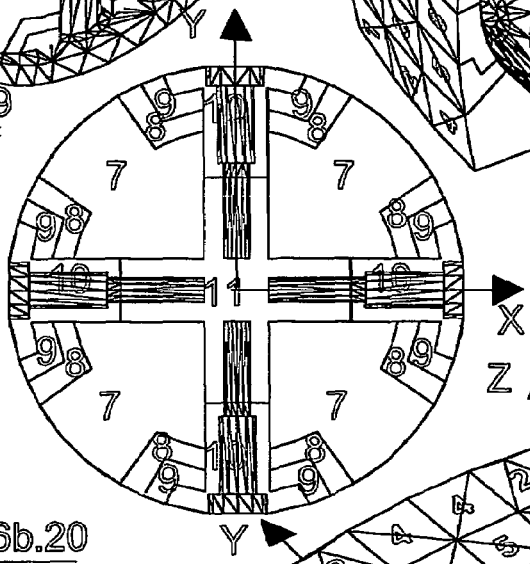
Figure 6B:
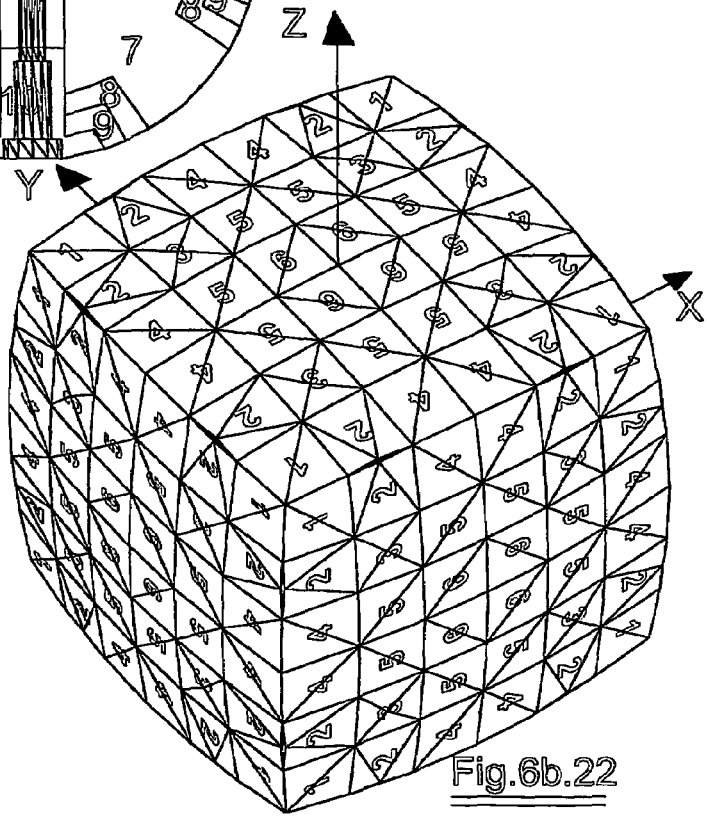

In FIG. 6*b*.12 we can see the ten different pieces of the cubic logic toy No 6*b*, placed at their position along with the non visible central three-dimensional solid cross that supports the cube.

In FIG. 6*b*.13 we can see the geometrical characteristics of the cubic logic toy No 6*b*, for the configuration of the internal surfaces of the separate pieces of which three conical surfaces have been used per semi direction of the three-dimensional rectangular Cartesian coordinate system.

In FIG. 6*b*.14 we can see the internal face of the first layer of the cubic logic toy No 6*b* along with the non visible central three-dimensional solid cross that supports the cube.

In FIG. 6*b*.15 we can see the internal face and in FIG. 6*a*.16 we can see the external face of the second layer of the cubic logic toy No 6*b*.

In FIG. 6*b*.17 we can see the internal face and in FIG. 6*b*.18 we can see the external face of the third layer of the cubic logic toy No 6*b*.

In FIG. 6*b*.19 we can see the face of the non-visible intermediate layer in each direction along with the non-visible central three-dimensional solid cross that supports the cube.

In FIG. 6*b*.20 we can see the section of the separate pieces of the intermediate layer as well as of the non-visible central three-dimensional solid cross that supports the cube by an intermediate symmetry plane of the cube.

In FIG. 6*b*.21 we can see at an axonometric projection the first three layers that are visible to the user, as well as the intermediate non-visible layer in each direction and the non visible central s three-dimensional solid cross that supports the cube.

Finally, in FIG. 6*b*.22 we can see the final shape of the cubic logic toy No 6*b*.

The cubic logic toy No 6*b* consists of two hundred and nineteen (219) separate pieces in total along with the non-visible central three-dimensional solid cross that supports the cube. We have already mentioned that the only difference between the two versions of the cube No6 is in their final shape.

VII. When $\kappa=3$, that is when we use three conical surfaces per semi axis of the three-dimensional rectangular Cartesian coordinate system and $N=2\kappa+1=2\times3+1=7$, that is for the cubic logic toy No 7, whose final shape is substantially cubic, its faces consisting of spherical surfaces of long radius, we have again (10) different kinds of separate pieces, which are all visible to the user of the toy.

Piece 1 (FIG. 7.1) and in total eight similar pieces, piece 2 (FIG. 7.2) and in total twenty-four similar pieces, piece 3 (FIG. 7.3) and in total twenty-four similar pieces, piece 4 (FIG. 7.4) and in total twenty-four similar pieces, piece 5 (FIG. 7.5) and in total forty eight similar pieces, piece 6 (FIG. 7.6) and in total twenty-four similar pieces, piece 7 (FIG. 7.7) and in total twelve similar pieces, piece 8 (FIG. 7.8) and in total twenty-four similar pieces, piece 9 (FIG. 7.9) and in total twenty-four similar pieces and piece 10 (FIG. 7.10) and in total six similar pieces, the caps of the cubic logic toy No 7.

Figure 7:
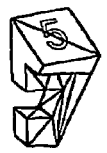
FIGS. 7.1 to 7.22 show views of a cubic logic toy according to another exemplary embodiment of the present invention.
Figure 7:
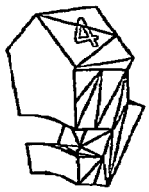
Figure 7:
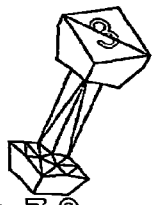
Figure 7:
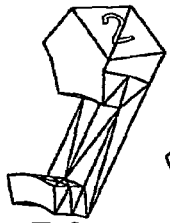
Figure 7:
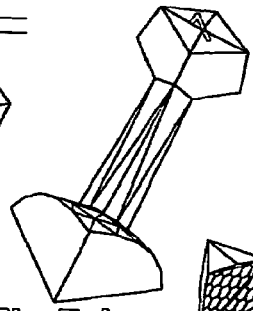
Figure 7:
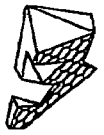
Figure 7:
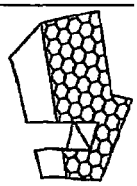
Figure 7:
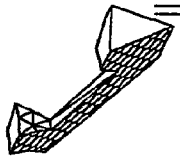
Figure 7:
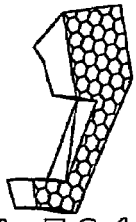
Figure 7:
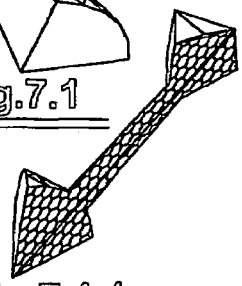
Figure 7:
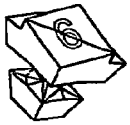
Figure 7:
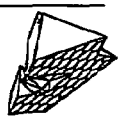
Figure 7:
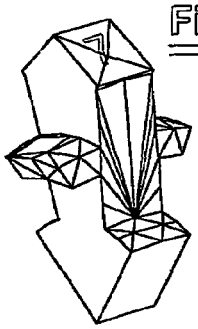
Figure 7:
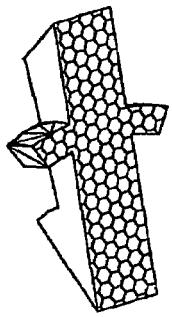
Figure 7:
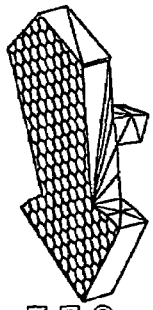
Figure 7:
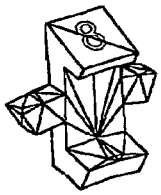
Figure 7:
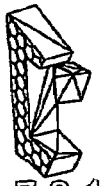
Figure 7:
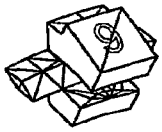
Figure 7:
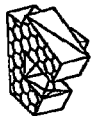
Figure 7:
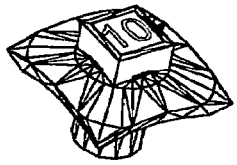
Figure 7:
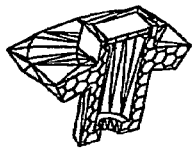
Figure 7:
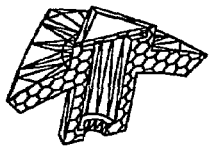
Figure 7:
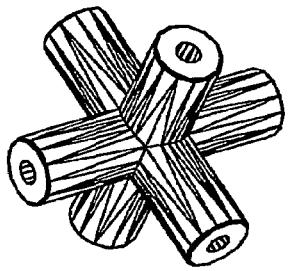
Figure 7:
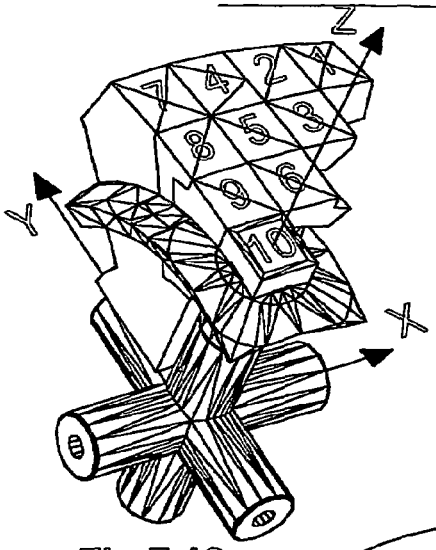
Figure 7:
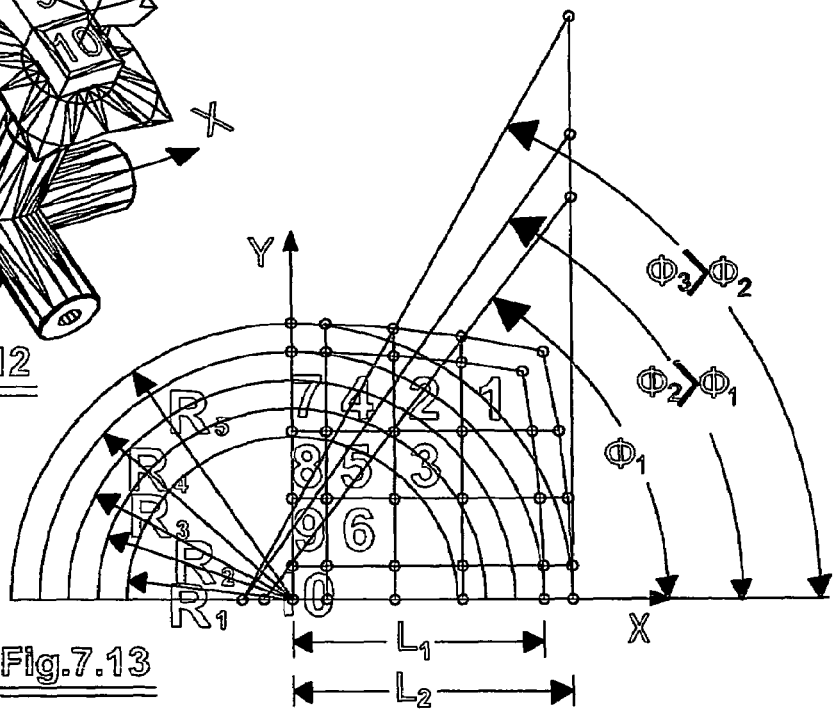
Figure 7:
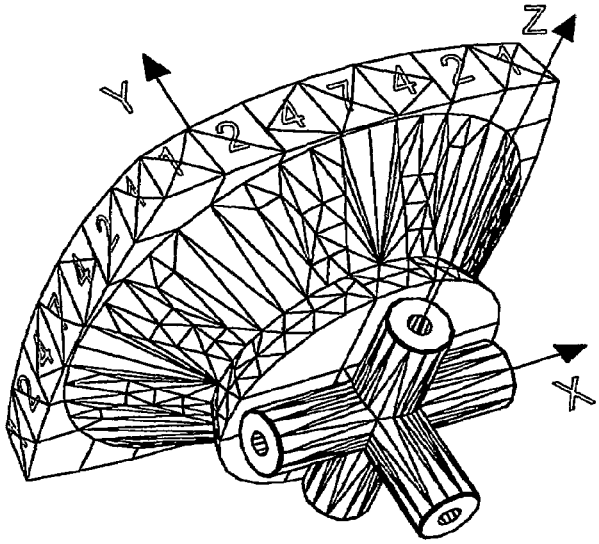
Figure 7:
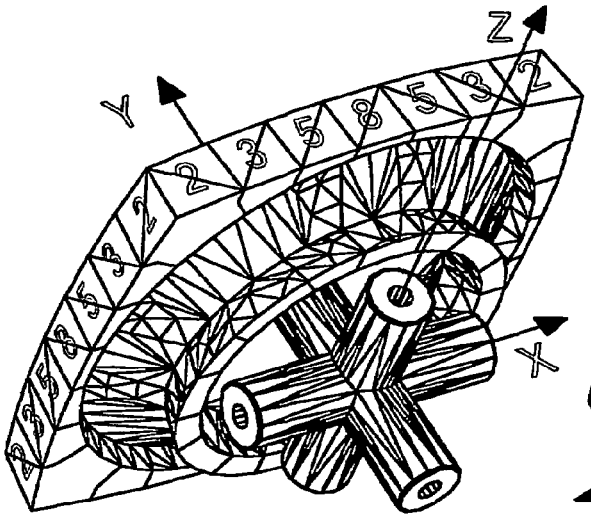
Figure 7:
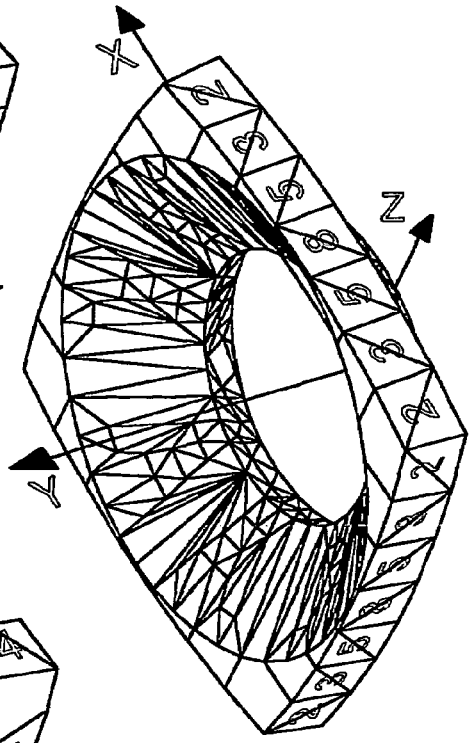
Figure 7:
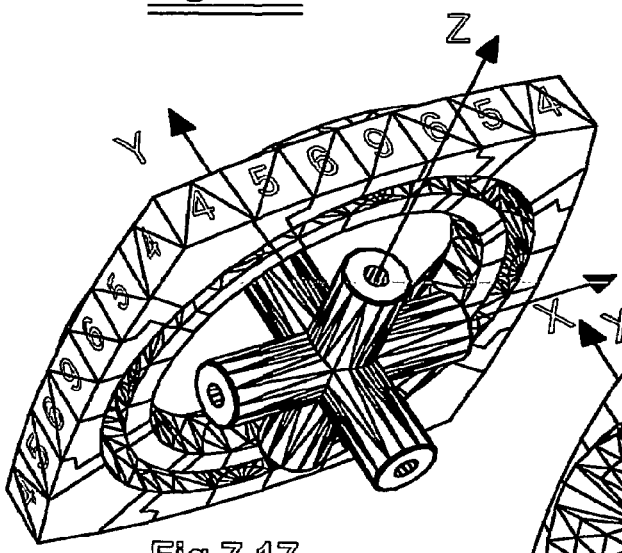
Figure 7:
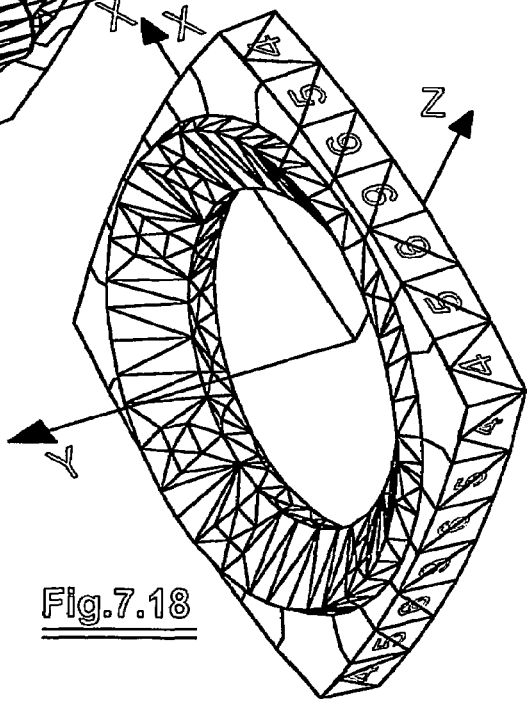
Figure 7:
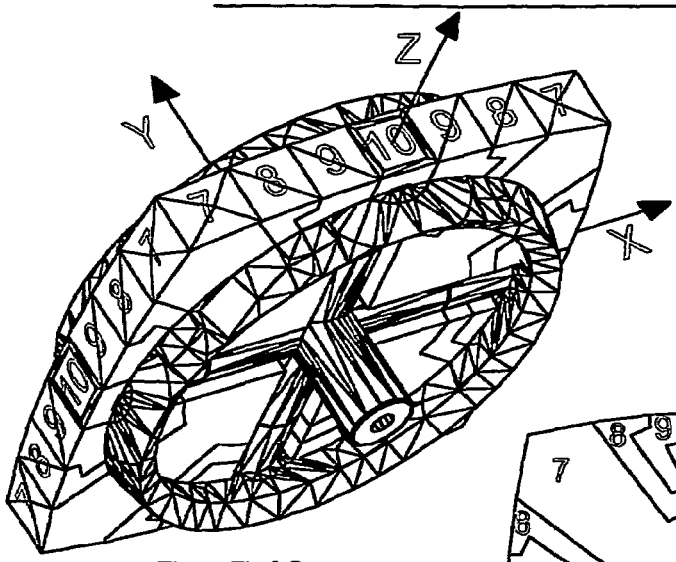
Figure 7:
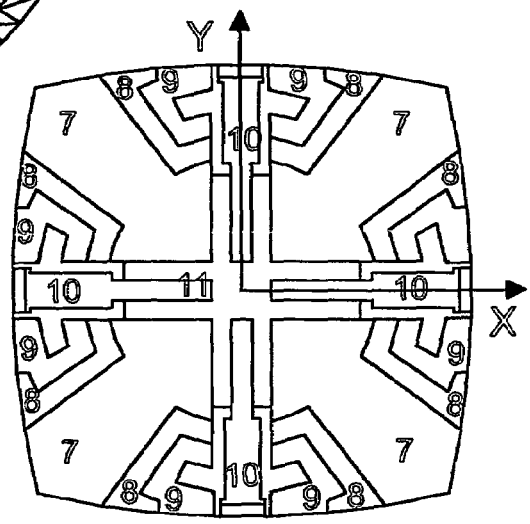
Figure 7:
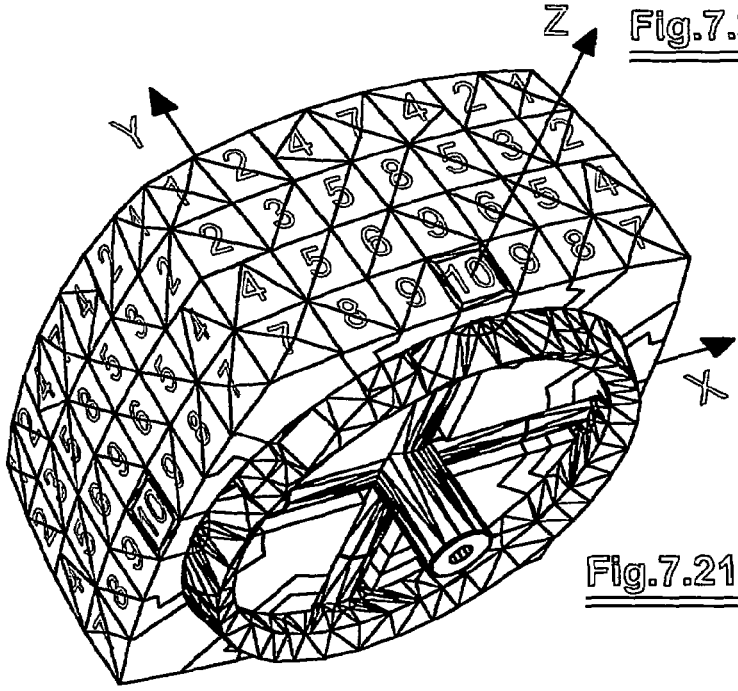
Figure 7:
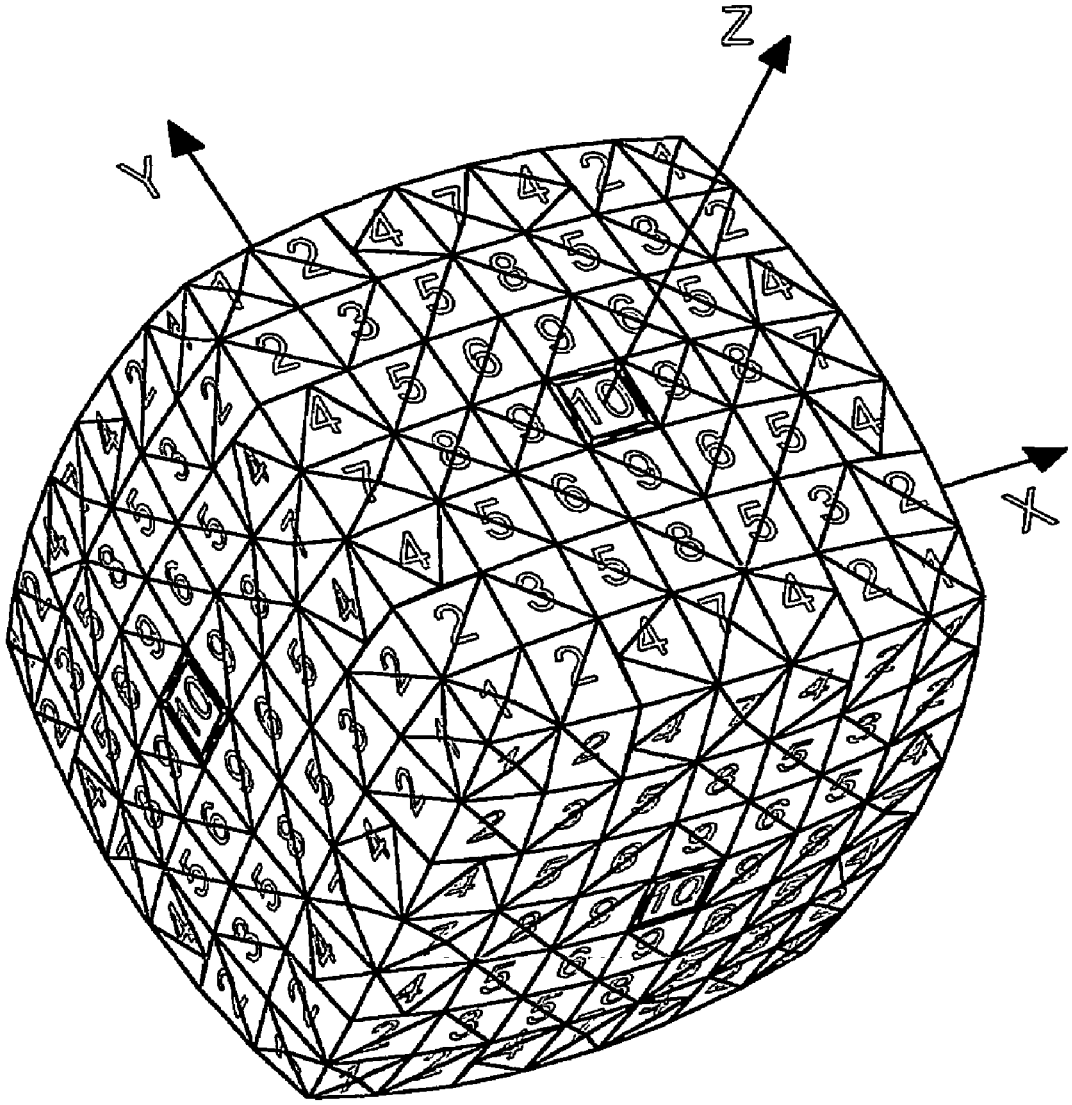

Finally, in FIG. 7.11 we can see the non-visible central three-dimensional solid cross that supports the cube No 7.

In FIGS. 7.1.1, 7.2.1, 7.3.1, 7.4.1, 7.5.1, 7.6.1, 7.7.1, 7.7.2, 7.8.1, 7.9.1, 7.10.1 and 7.10.2 we can see the cross-sections of the ten different, separate pieces of the cubic logic toy No 7.

In FIG. 7.12 we can see the ten different pieces of the cubic logic toy No 7 placed at their position along with the non-visible central three-dimensional solid cross that supports the cube.

In FIG. 7.13 we can see the geometrical characteristics of the cubic logic toy No 7, for the configuration of the internal surfaces of the separate pieces of which three conical surfaces per semi direction of the three-dimensional rectangular Cartesian coordinate system have been used.

In FIG. 7.14 we can see the internal face of the first layer per semi direction of the cubic logic toy No 7.

In FIG. 7.15 we can see the internal ace of the second layer per semi direction along with the non-visible central three-dimensional solid cross that supports the cube and in FIG. 7.16 we can see the external face of this second layer.

In FIG. 7.17 we can see the internal face of the third layer per semi direction along with the non-visible central three-dimensional solid cross that supports the cube and in FIG. 7.18 we can see the external face of this third layer.

In FIG. 7.19 we can see the face of the intermediate layer in each direction along with the central three-dimensional solid cross that supports the cube.

In FIG. 7.20 we can see the section of the separate pieces of the intermediate layer and of the non-visible central three-dimensional solid cross that supports the cube by an intermediate symmetry plane of the cube.

In FIG. 7.21 we can see at an axonometric projection the three first layers per semi direction along with the intermediate layer in each direction, all of which are visible to the user of the toy along with the non-visible central three-dimensional solid cross, which supports the cube.

Finally, in FIG. 7.22 we can see the final shape of the cubic logic toy No 7.

The cubic logic toy No 7 consists of two hundred and nineteen (219) separate pieces in total along with the non-visible central three-dimensional solid cross that supports the cube, i.e. the same number of pieces as in the cubic logic toy No 6.

VIII. When $\kappa=4$, that is when we use four conical surfaces per semi axis of the three-dimensional rectangular Cartesian coordinate system and $N=2\kappa=2\times4=8$, that is for the cubic logic toy No 8 whose final shape is substantially cubic, its faces consisting of spherical surfaces of long radius, we have (15) fifteen different kinds of separate smaller pieces, of which only the first ten are visible to the user of the toy whereas the next five are non visible. Piece 1 (FIG. 8.1) and in total eight similar pieces, piece 2 (FIG. 8.2) and in total twenty-four similar pieces, piece 3 (FIG. 8.3) and in total twenty-four similar pieces, piece 4 (FIG. 8.4) and in total twenty-four similar pieces, piece 5 (FIG. 8.5) and in total forty-eight similar pieces, piece 6 (FIG. 8.6) and in total twenty-four similar pieces, piece 7 (FIG. 8.7) and in total twenty-four similar pieces, piece 8 (FIG. 8.8) and in total forty-eight similar pieces, piece 9 (FIG. 8.9) and in total forty-eight similar pieces and piece 10 (FIG. 8.10) and in total twenty-four similar pieces, all of which are visible to the user of the toy.

The non visible different pieces that form the intermediate non visible layer in each direction of the cubic logic toy No 8 are: piece 11 (FIG. 8.11) and in total twelve similar pieces, piece 12 (FIG. (8.12) and in total twenty-four similar pieces, piece 13 (FIG. 8.13) and in total twenty-four similar pieces, piece 14 (FIG. 8.14) and in total twenty-four similar pieces and piece 15 (FIG. 8.15) and in total six similar pieces, the caps of the cubic logic toy No 8. Finally, in FIG. 8.16 we can see the non-visible central three-dimensional solid cross that supports the cube No 8.

Figure 8:
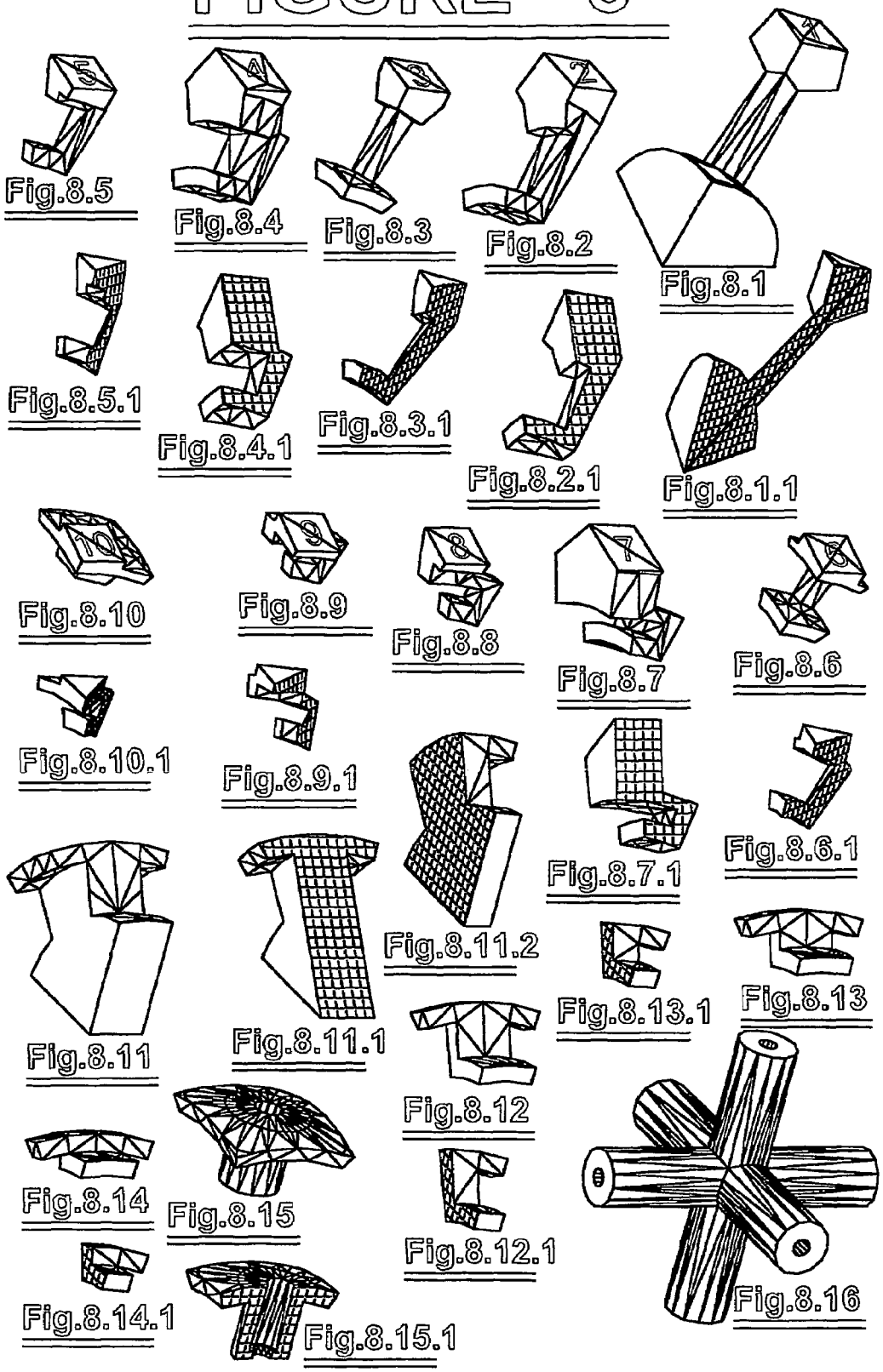
FIGS. 8.1 to 8.26 show views of a cubic logic toy according to another exemplary embodiment of the present invention.
Figure 8:
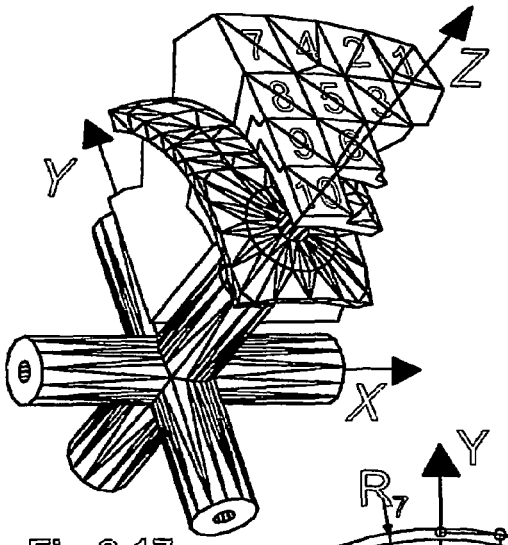
Figure 8:
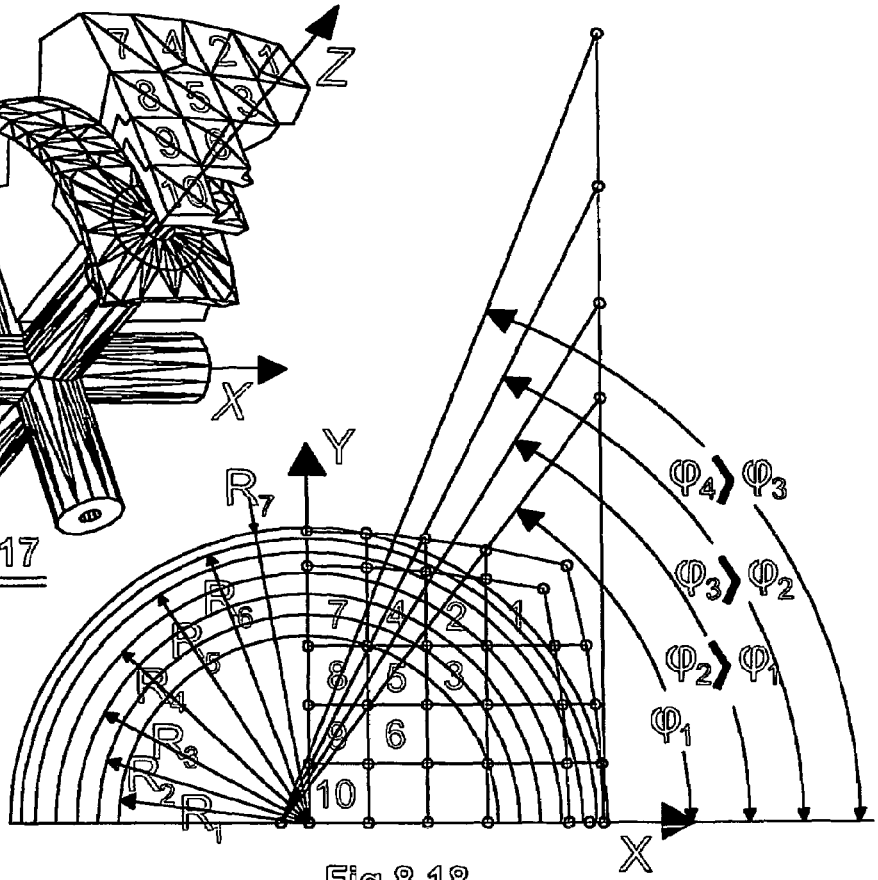
Figure 8:
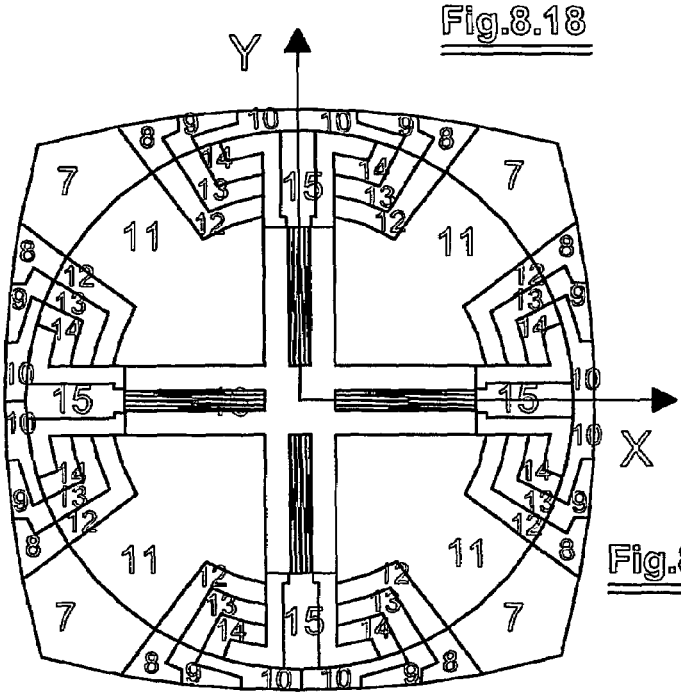
Figure 8:
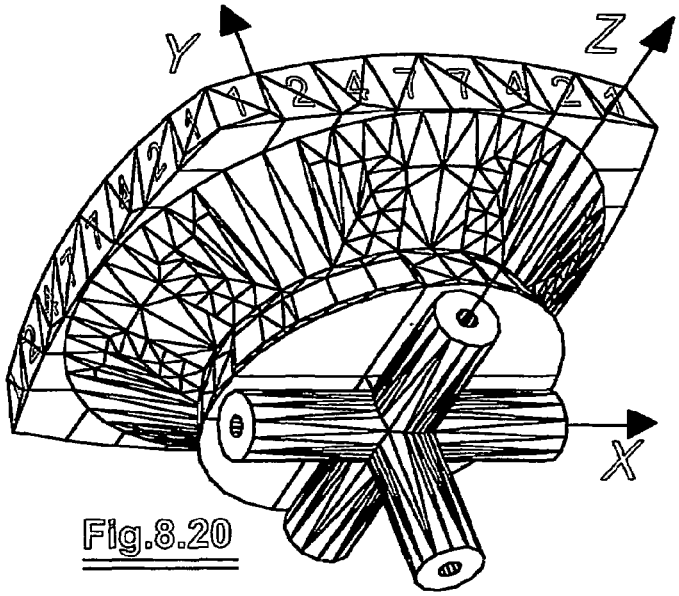
Figure 8:
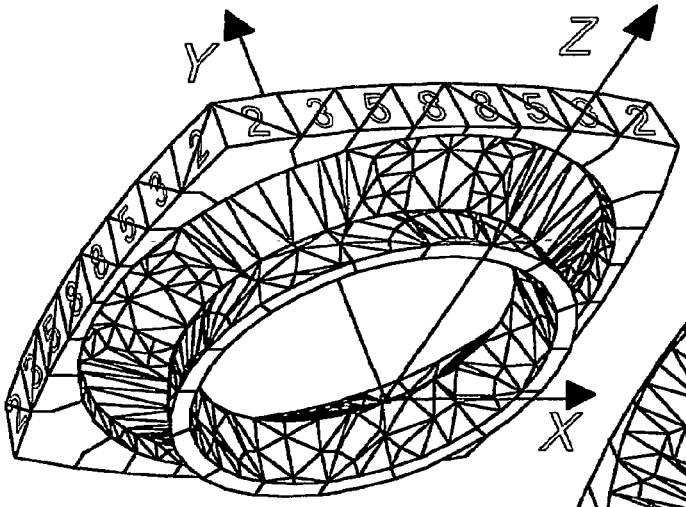
Figure 8:
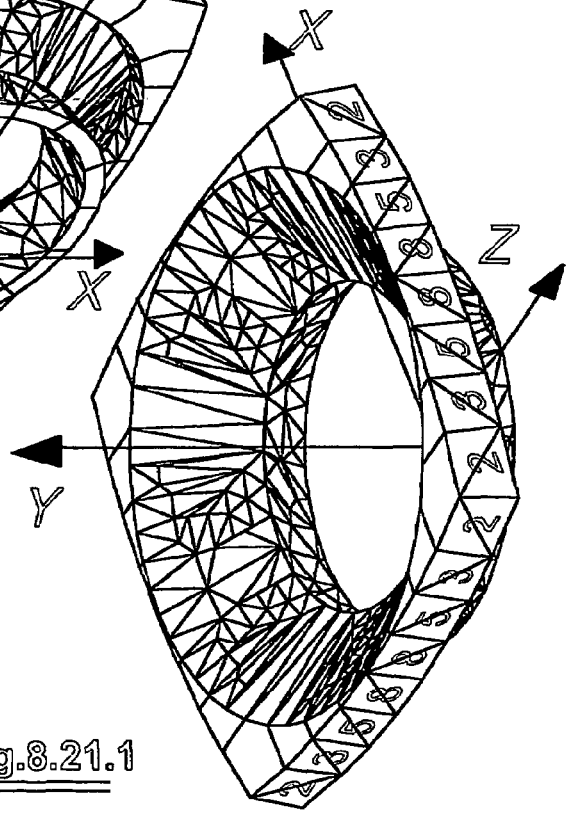
Figure 8:
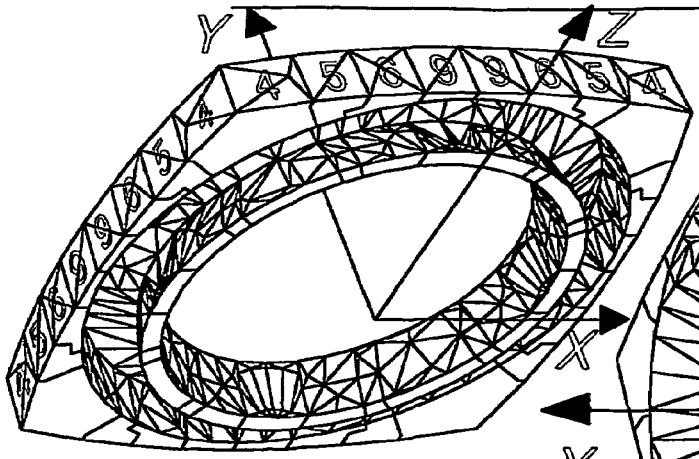
Figure 8:
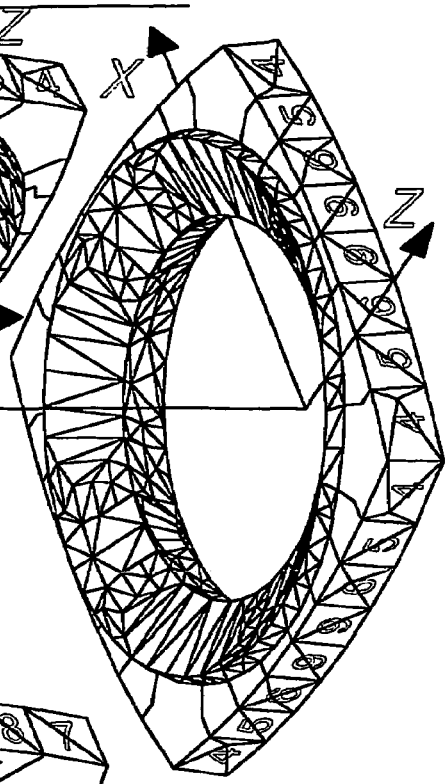
Figure 8:
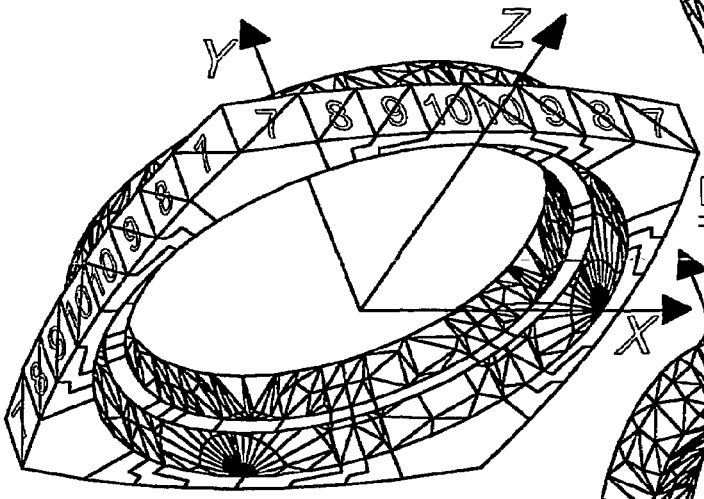
Figure 8:
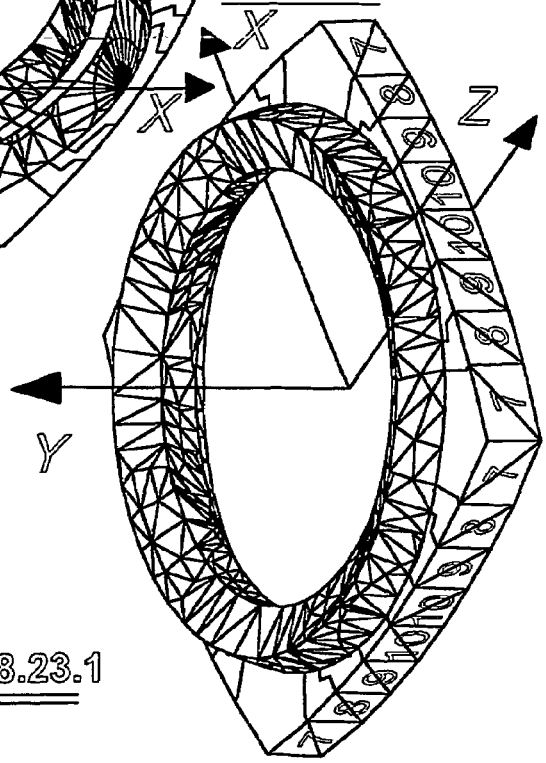
Figure 8:
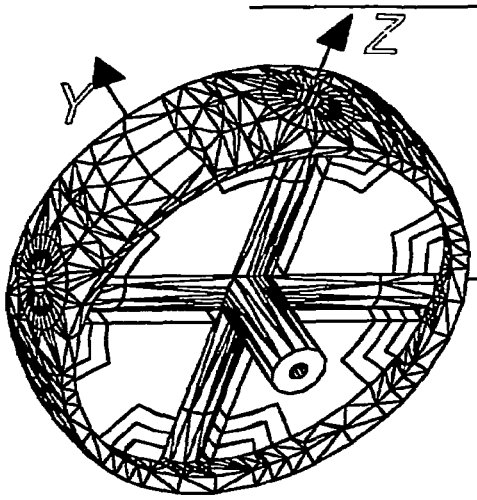
Figure 8:
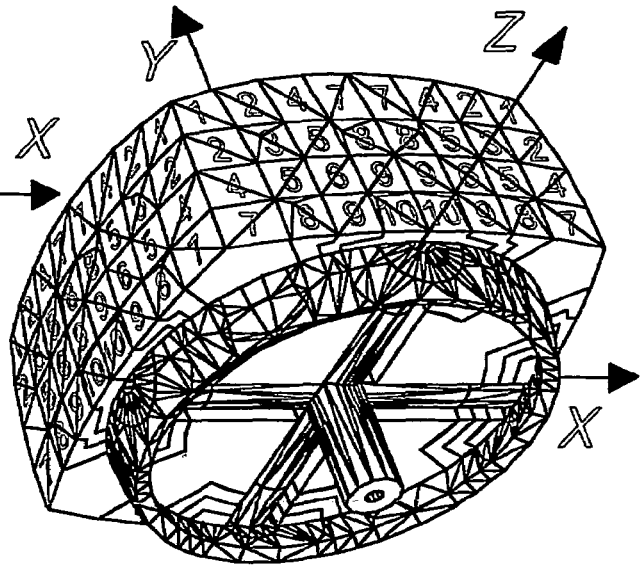
Figure 8:
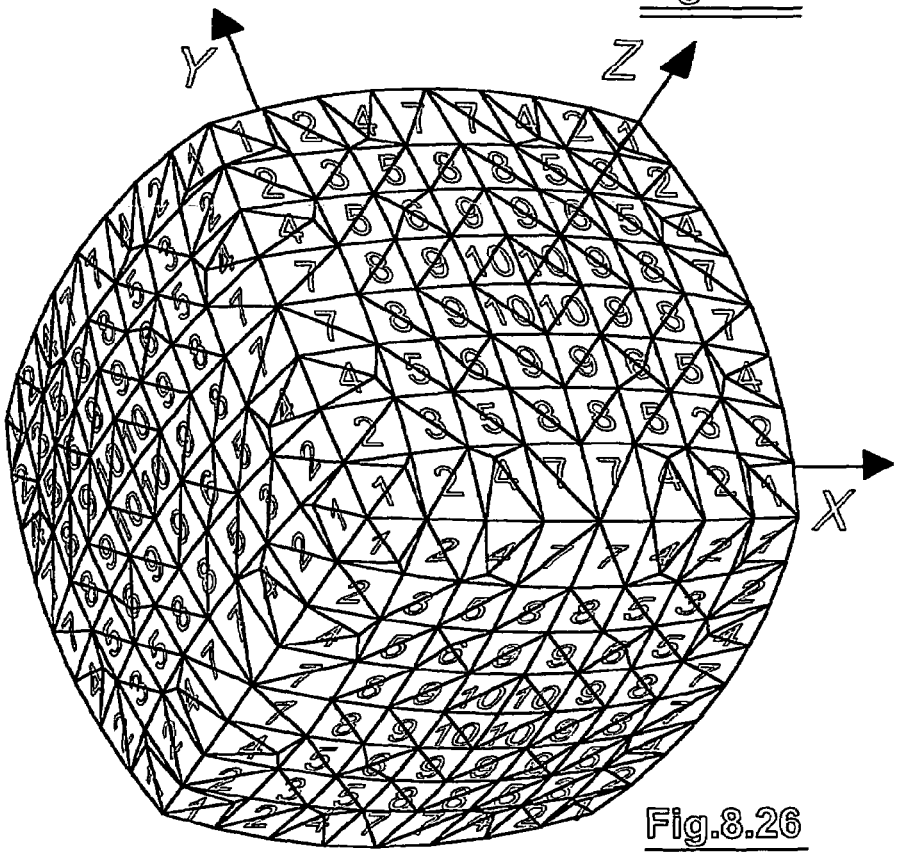

In FIGS. 8.1.1, 8.2.1, 8.3.1, 8.4.1, 8.5.1, 8.6.1, 8.7.1, 8.9.1, 8.10.1, 8.11.1, 8.11.2, 8.12.1, 8.13.1, 8.14.1 and 8.15.1 we can see the cross-sections of the fifteen different, separate pieces of the cubic logic toy No 8.

In FIG. 8.17 we can see these fifteen separate pieces of the cubic logic toy No 8 placed at their position along with the non-visible central three-dimensional solid cross that supports the cube.

In FIG. 8.18 we can see the geometrical characteristics of the cubic logic toy No 8 for the configuration of the internal surfaces of the separate pieces of which four conical surfaces per semi direction of the three-dimensional rectangular Cartesian coordinate system have been used.

In FIG. 8.19 we can see the section of the separate pieces of the intermediate non visible layer per semi direction and of the central three-dimensional solid cross by an intermediate symmetry plane of the cube as well as the projection of the separate pieces of the fourth layer of each semi direction on this plane, said fourth layer being supported on the intermediate layer of this direction of the cubic logic toy No 8.

In FIG. 8.20 we can see the internal face of the first layer per semi direction of the cubic logic toy No 8 along with the non-visible central three-dimensional solid cross that supports the cube.

In FIG. 8.21 we can see the internal face and in FIG. 8.21.1 we can see the external face of the second layer per semi direction of the cubic logic toy No 8.

In FIG. 8.22 we can see the internal face and in FIG. 8.22.1 we can see the external face of the third layer per semi direction of the cubic logic toy No 8.

In FIG. 8.23 we can see the internal face and in FIG. 8.23.1 we can see the external face of the fourth layer per semi direction of the cubic logic toy No 8.

In FIG. 8.24 we can see the face of the non-visible intermediate layer in each direction along with the non-visible central three-dimensional solid cross that supports the cube.

In FIG. 8.25 we can see at an axonometric projection the four visible layers of each semi direction along with the non-visible intermediate layer of that direction and along with the non-visible central three-dimensional solid cross that supports the cube.

Finally, in FIG. 8.26 we can see the final shape of the cubic logic toy No 8.

The cubic logic toy No 8 consists of three hundred and eighty eight (387) pieces in total along with the non-visible central three-dimensional solid cross that supports the cube.

IX. When $\kappa=4$, that is when we use four conical surfaces per semi axis of the three-dimensional rectangular Cartesian coordinate system and $N=2\kappa+1=2\times4+1=9$, that is for the cubic logic toy No 9 whose final shape is substantially cubic, its faces consisting of spherical surfaces of long radius, we have again (15) fifteen different and separate kinds of smaller pieces, all visible to the user of the toy. Piece 1 (FIG. 9.1) and in total eight similar pieces, piece 2 (FIG. 9.2) and in total twenty-four similar pieces, piece 3 (FIG. 9.3) and in total twenty-four similar pieces, piece 4 (FIG. 9.4) and in total twenty-four similar pieces, piece 5 (FIG. 9.5) and in total forty eight similar pieces, piece 6 (FIG. 9.6) and in total twenty-four similar pieces, piece 7 (FIG. 9.7) and in total twenty-four similar pieces, piece 8 (FIG. 9.8) and in total forty eight similar pieces, piece 9 (FIG. 9.9) and in total forty eight similar pieces and piece 10 (FIG. (9.10) and in total twenty-four similar pieces, piece 11 (FIG. 9.11) and in total twelve similar pieces, piece 12 (FIG. 9.12) and in total twenty-four similar pieces, piece 13 (FIG. 9.13) and in total twenty-four similar pieces, piece 14 (FIG. 9.14) and in total twenty-four similar pieces and finally, piece 15 (FIG. 9.15) and in total six similar pieces, the caps of the cubic logic toy No 9. Finally, in FIG. 9.16 we can see the non-visible central three-dimensional solid cross that supports the cube No 9.

Figure 9:
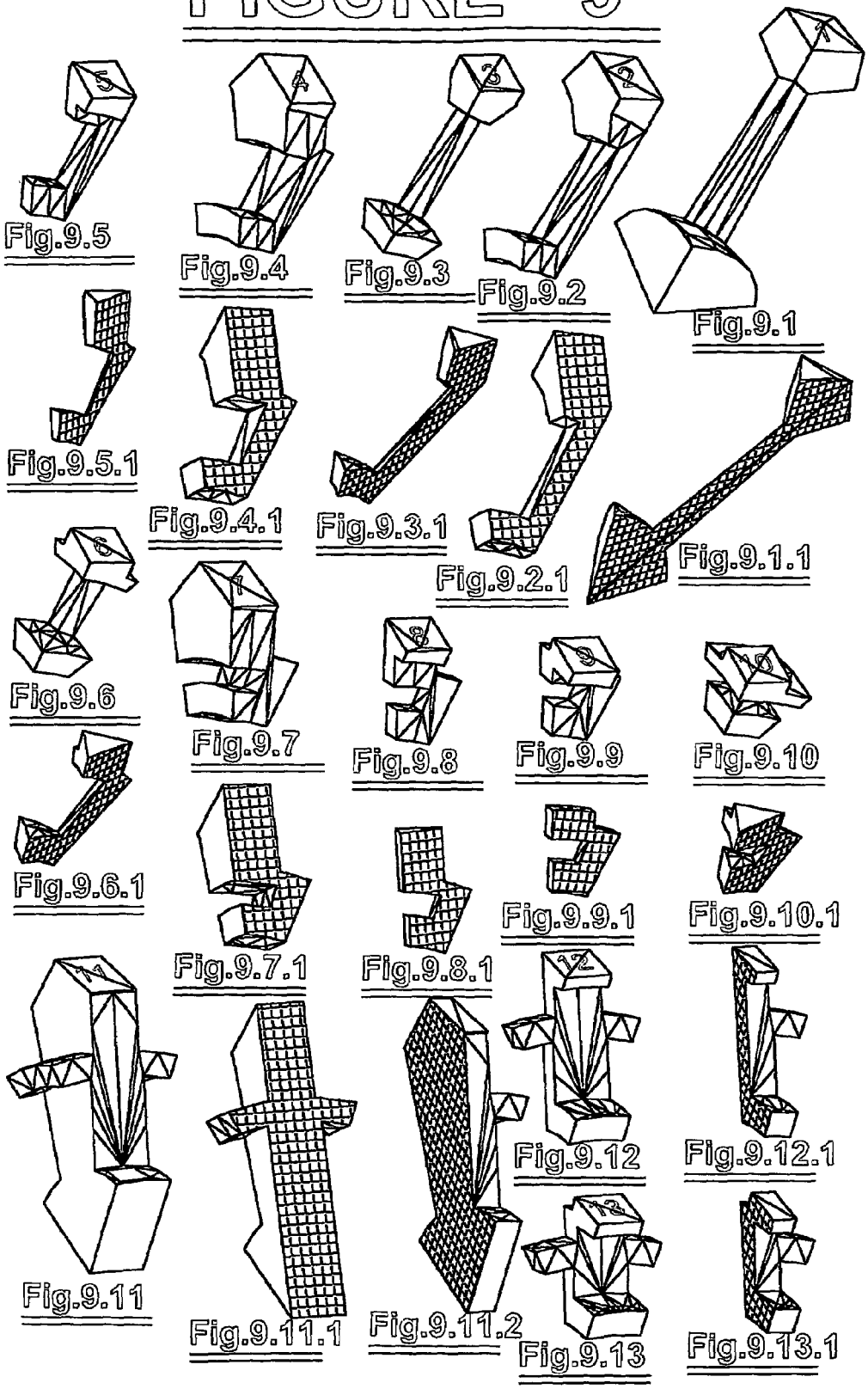
FIGS. 9.1 to 9.26 show views of a cubic logic toy according to another exemplary embodiment of the present invention.
Figure 9:
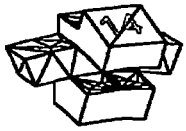
Figure 9:
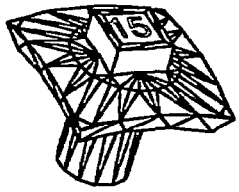
Figure 9:
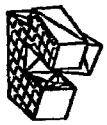
Figure 9:
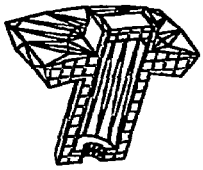
Figure 9:
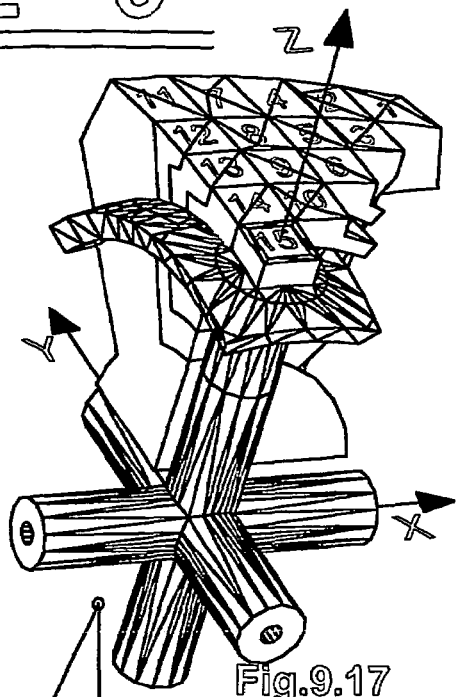
Figure 9:
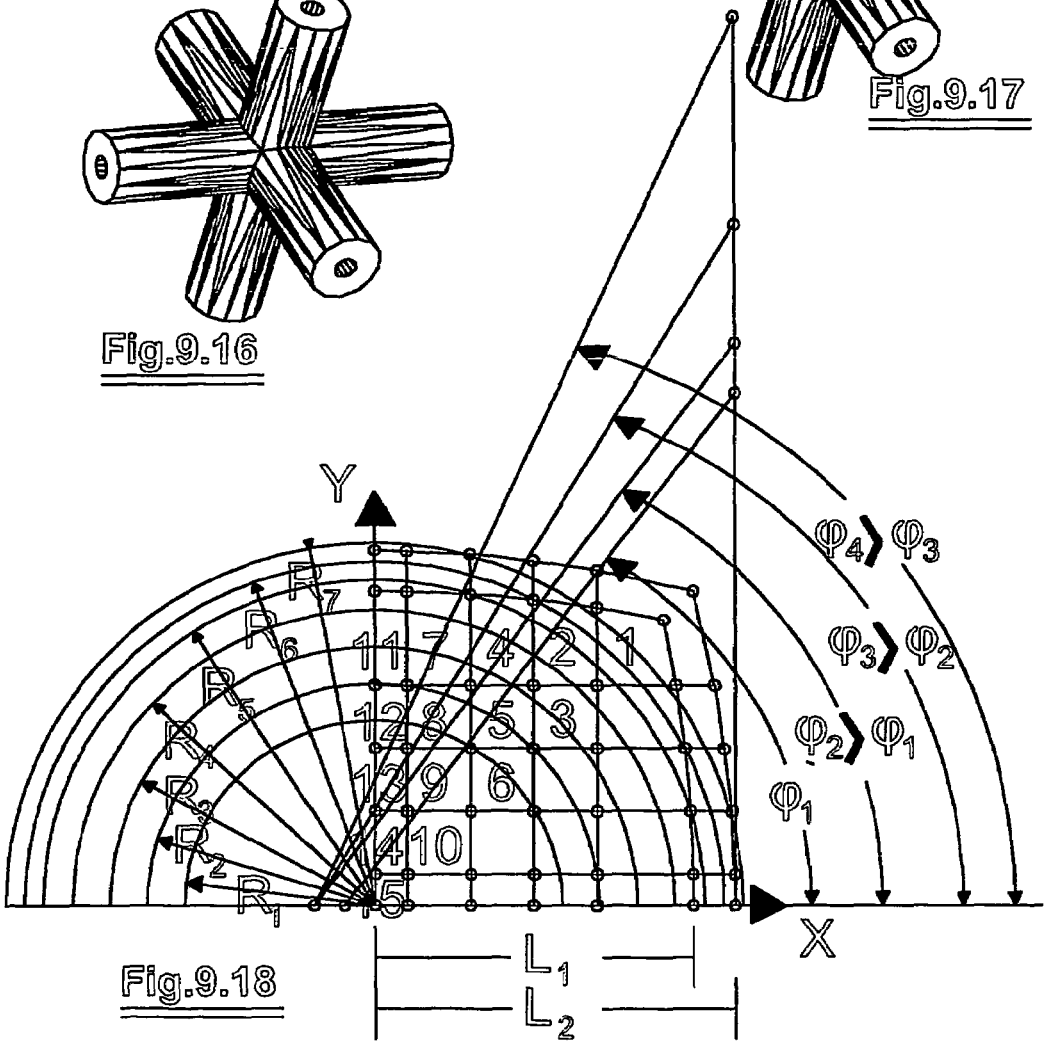
Figure 9:
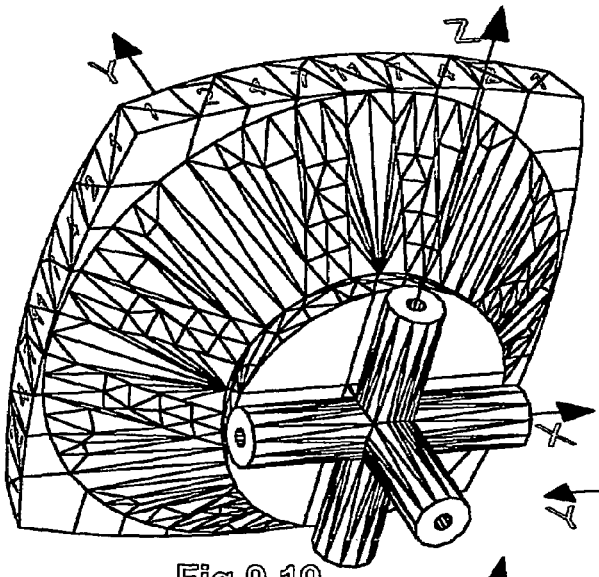
Figure 9:
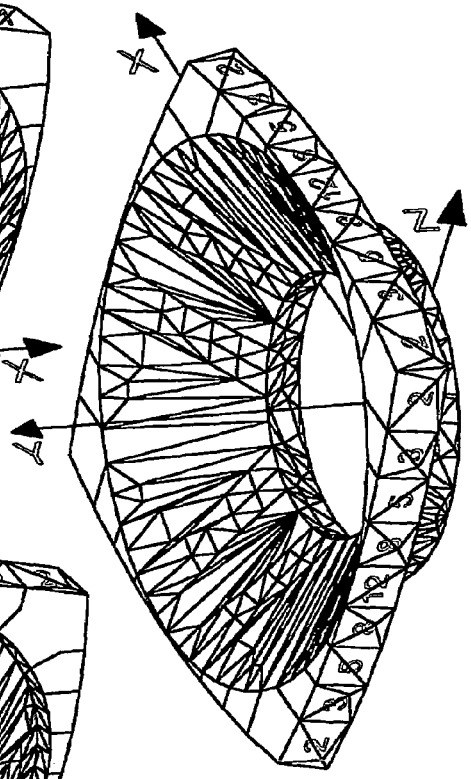
Figure 9:
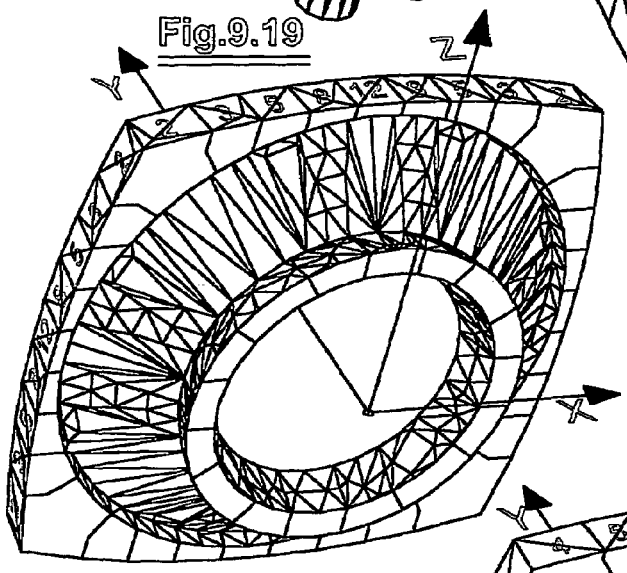
Figure 9:
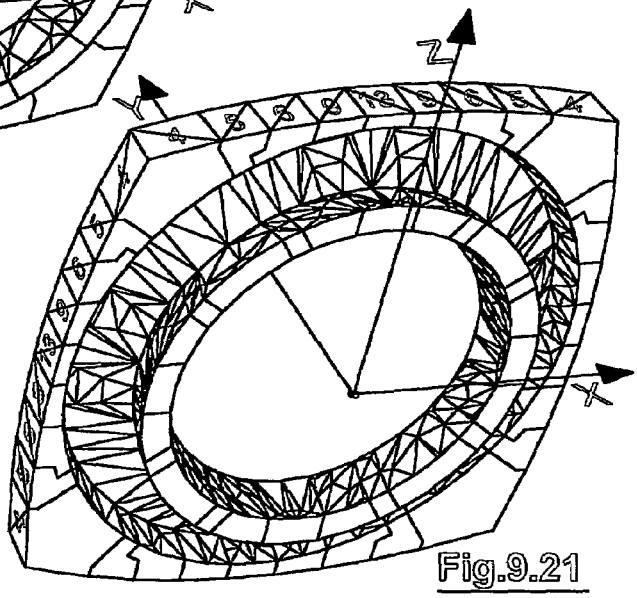
Figure 9:
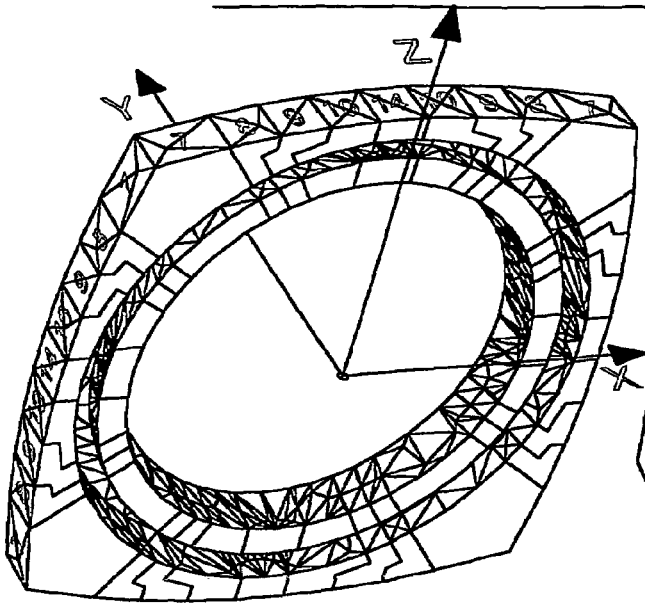
Figure 9:
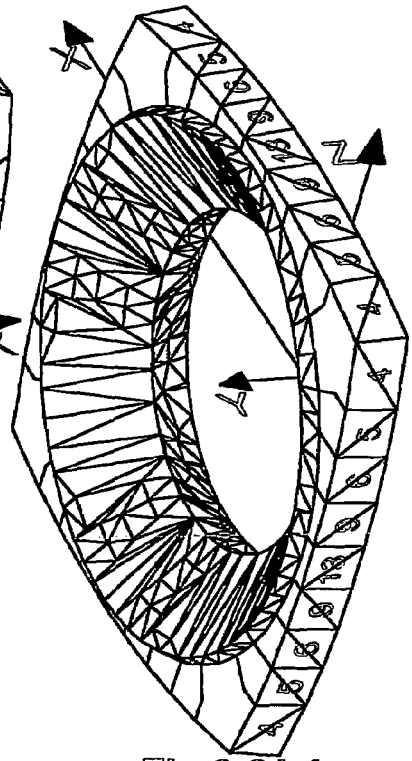
Figure 9:
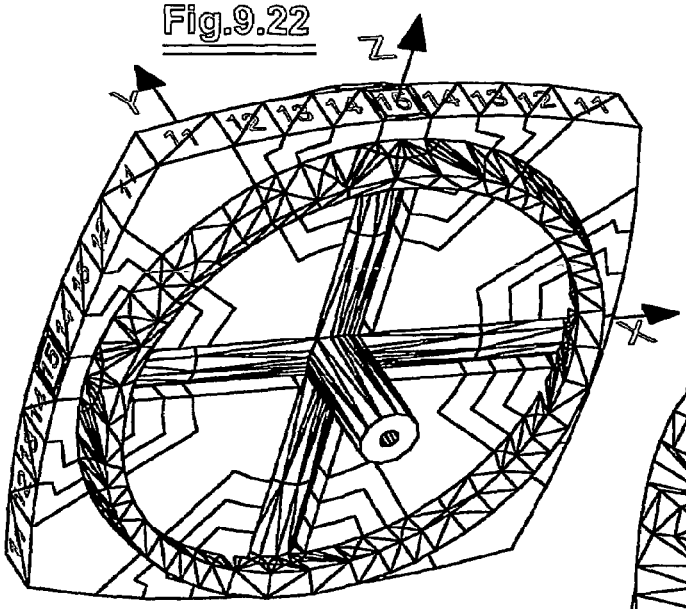
Figure 9:
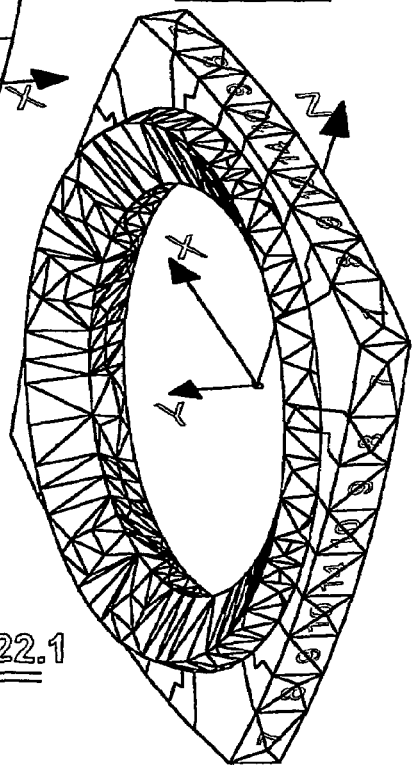
Figure 9:
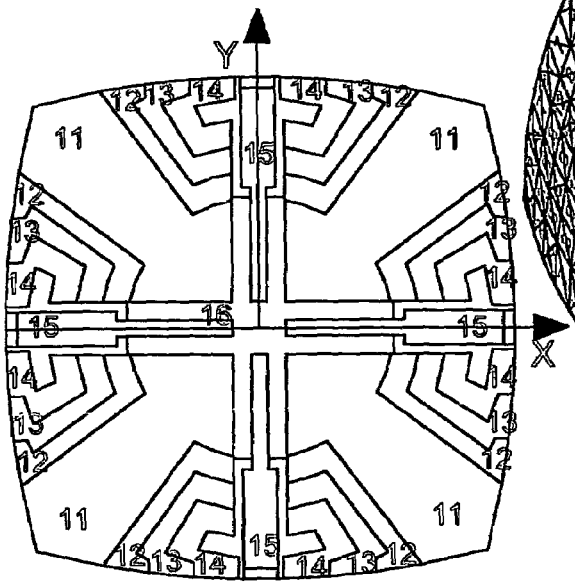
Figure 9:
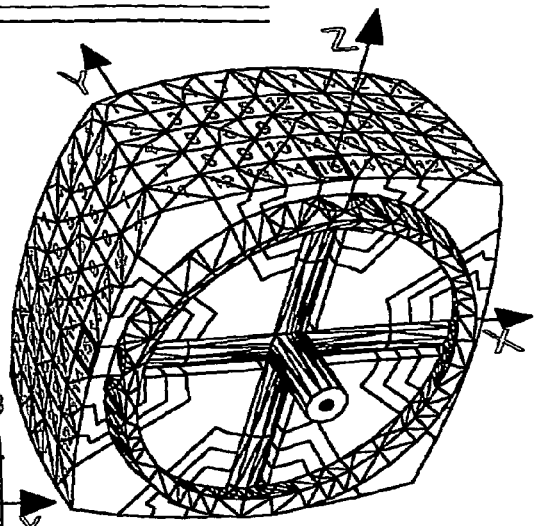
Figure 9:
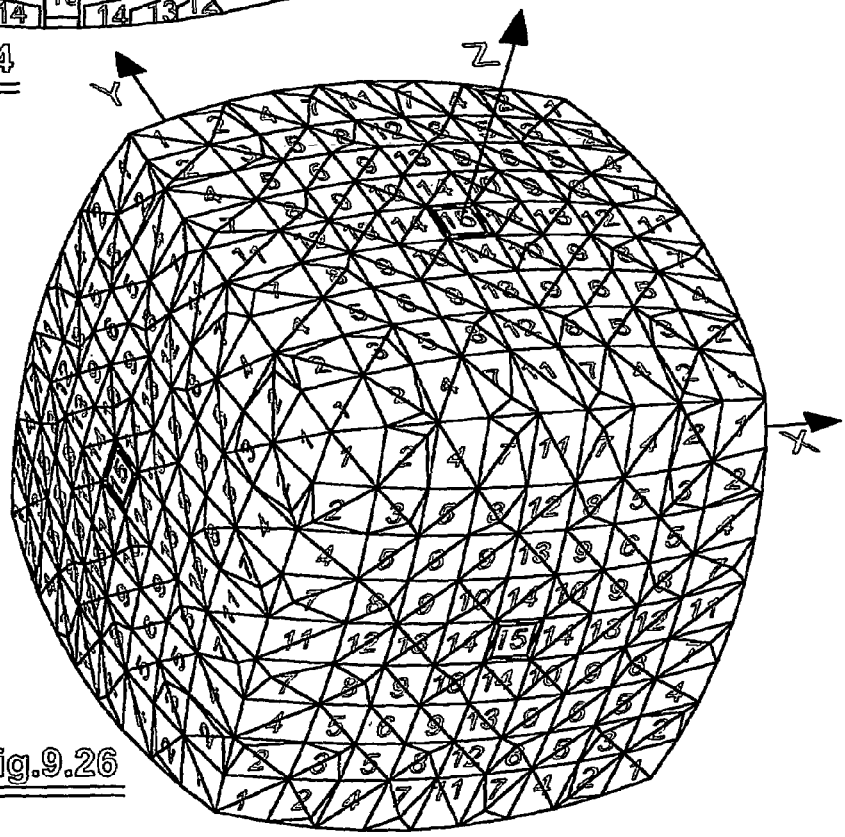

In FIGS. 9.1.1, 9.2.1, 9.3.1, 9.4.1, 9.5.1, 9.6.1, 9.7.1, 9.8.1, 9.9.1, 9.10.1, 9.11.1, 9.11.2, 9.12.1, 9.13.1, 9.14.1 and 9.15.1 we can see the cross-sections of the fifteen different, separate pieces of the cubic logic toy No 9.

In FIG. 9.17 we can see these separate fifteen pieces of the cubic logic toy No 9, placed at their position along with the non-visible central three-dimensional solid cross that supports the cube.

In FIG. 9.18 we can see the geometrical characteristics of the cubic logic toy No 9 for the configuration of the internal surfaces of the separate pieces of which four conical surfaces per semi direction of the three-dimensional rectangular Cartesian coordinate system have been used.

In FIG. 9.19 we can see the internal face of the first layer per semi direction of the cubic logic toy No 9 along with the non-visible central three-orthogonal solid cross that supports the cube.

In FIG. 9.20 we can see the internal face and in FIG. 9.20.1 the external face of the second layer per semi direction of the cubic logic toy No 9.

In FIG. 9.21 we can see the internal face and in FIG. 9.21.1 the external face of the third layer per semi direction of the cubic logic toy No 9.

In FIG. 9.22 we can see the internal face and in FIG. 9.22.1 the external face of the fourth layer per semi direction of the cubic logic toy No 9.

In FIG. 9.23 we can see the internal face of the intermediate layer in each direction of the cubic logic toy No 9 along with the non-visible central three dimensional solid cross that supports the cube.

In FIG. 9.24 we can see the section of the separate pieces of the intermediate layer in each direction as well as of the non-visible central three-dimensional solid cross that supports the cube by an intermediate symmetry plane of the cubic logic toy No 9.

In FIG. 9.25 we can see at an axonometric projection the four layers in each semi direction along with the fifth intermediate layer of this direction and the non visible central three-dimensional solid cross that supports the cube.

Finally, in FIG. 9.26 we can see the final shape of the cubic logic toy No 9.

The cubic logic toy No 9 consists of three hundred and eighty eight (387) separate pieces in total along with the non-visible central three-dimensional solid cross that supports the cube, the same number of pieces as in the cubic logic toy No 8.

X. When $\kappa=5$, that is when we use five conical surfaces per semi axis of the three-dimensional rectangular Cartesian coordinate system and $N=2\kappa=2\times5=10$, that is for the cubic logic toy No 10 whose final shape is substantially cubic, its faces consisting of spherical surfaces of long radius, we have (21) twenty one different kinds of smaller pieces, of which only the first fifteen are visible to the user of the toy, whereas the next six are non visible.

Piece 1 (FIG. 10.1) and in total eight similar pieces, piece 2 (FIG. 10.2) and in total twenty-four similar pieces, piece 3 (FIG. 10.3) and in total twenty-four similar pieces, piece 4 (FIG. 10.4) and in total twenty-four similar pieces, piece 5 (FIG. 10.5) and in total forty eight similar pieces, piece 6 (FIG. 10.6) and in total twenty-four similar pieces, piece 7 (FIG. 10.7) and in total twenty-four similar pieces, piece 8 (FIG. 10.8) and in total forty eight similar pieces, piece 9 (FIG. 10.9) and in total forty eight similar pieces and piece 10 (FIG. 10.10) and in total twenty-four similar pieces, piece 11

(FIG. 10.11) and in total twenty-four similar pieces, piece 12 (FIG. 10.12) and in total forty eight similar pieces, piece 13 (FIG. 10.13) and in total forty eight similar pieces, piece 14 (FIG. 10.14) and in total forty eight similar pieces, piece 15 (FIG. 10.15) and in total twenty-four similar pieces, up to this point all visible to the user of the toy. The non visible different pieces that form the intermediate non visible layer in each direction of the cubic logic toy No 10 are: piece 16 (FIG. 10.16) and in total twelve similar pieces, piece 17 (FIG. 10.17) and in total twenty-four similar pieces, piece 18 (FIG. 10.18) and in total twenty-four similar pieces, piece 19 (FIG. 10.19) and in total twenty-four similar pieces, piece 20 (FIG. 10.20) and in total twenty-four similar pieces, and, piece 21 (FIG. 10.21) and in total six similar pieces, the caps that of the cubic logic toy No 10.

Figure 10:
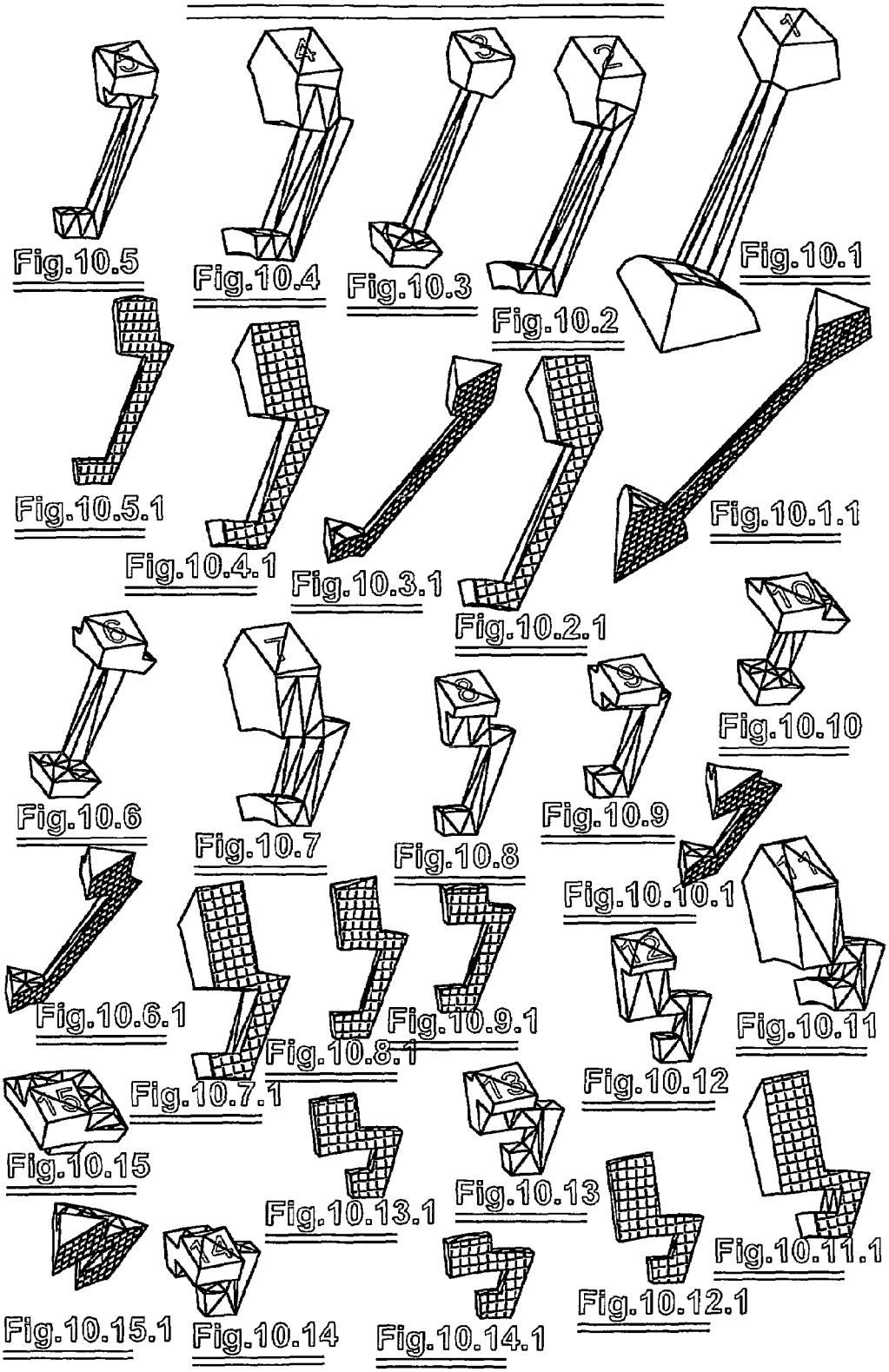
FIGS. 10.1 to 10.34 show views of a cubic logic toy according to another exemplary embodiment of the present invention.
Figure 10:
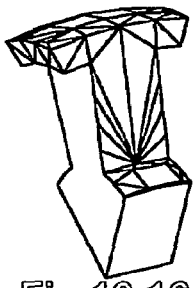
Figure 10:
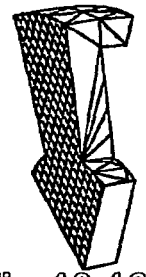
Figure 10:
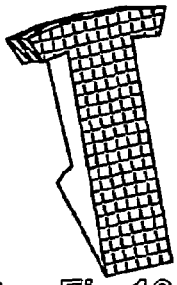
Figure 10:
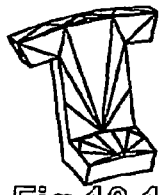
Figure 10:
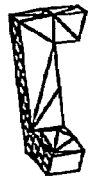
Figure 10:
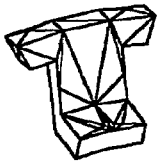
Figure 10:
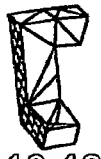
Figure 10:
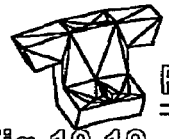
Figure 10:
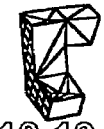
Figure 10:
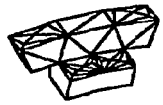
Figure 10:
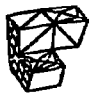
Figure 10:
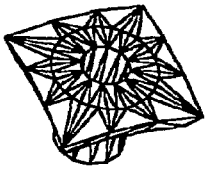
Figure 10:
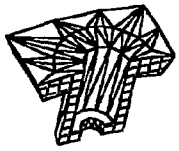
Figure 10:
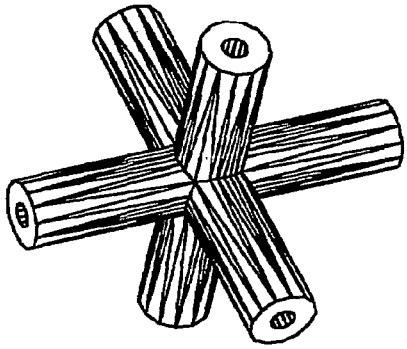
Figure 10:
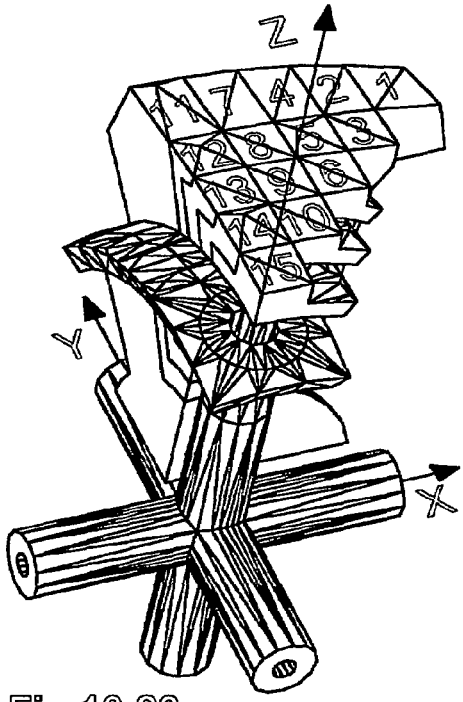
Figure 10:
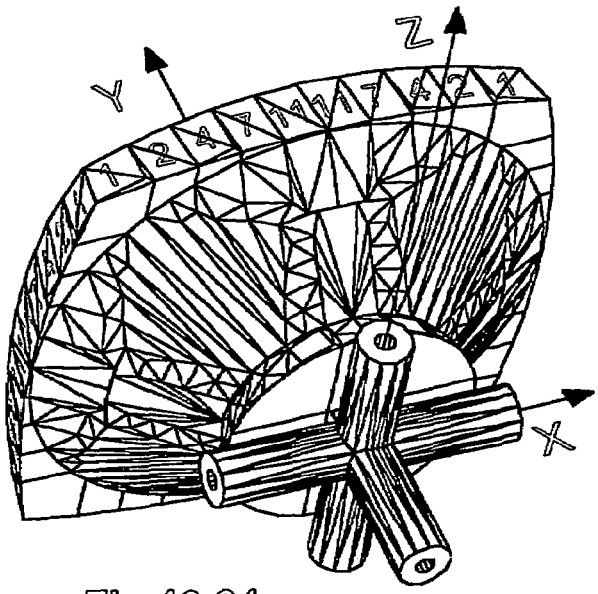
Figure 10:
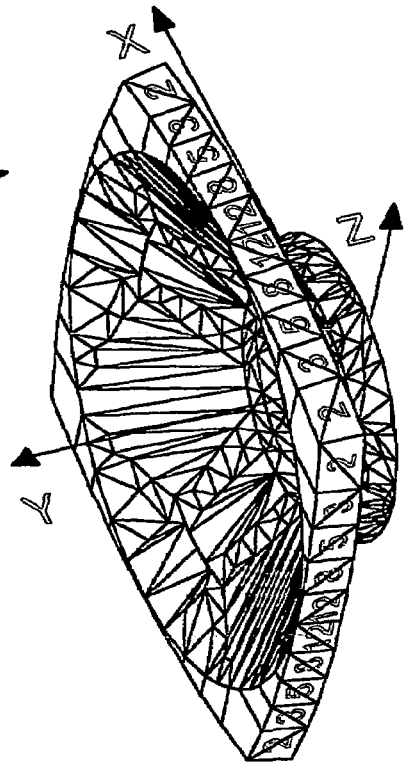
Figure 10:
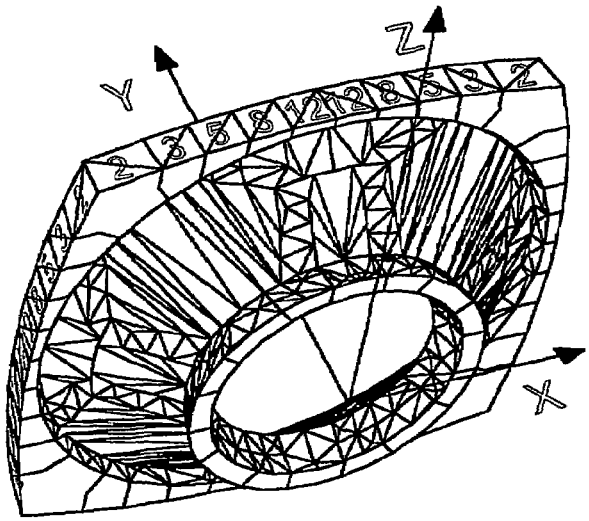
Figure 10:
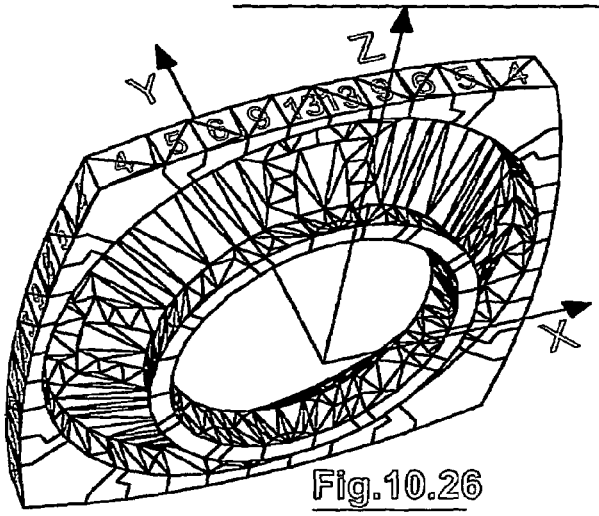
Figure 10:
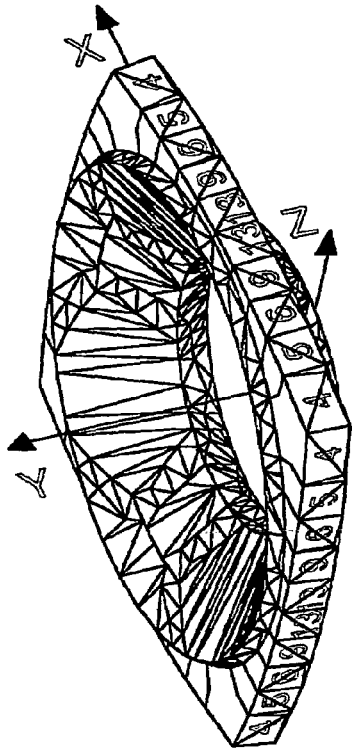
Figure 10:
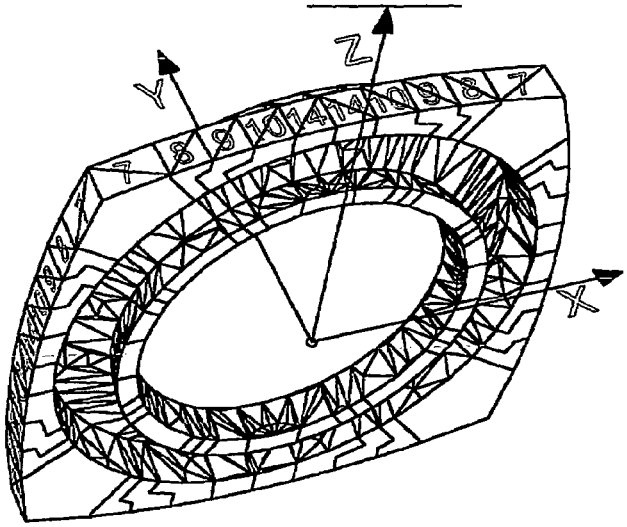
Figure 10:
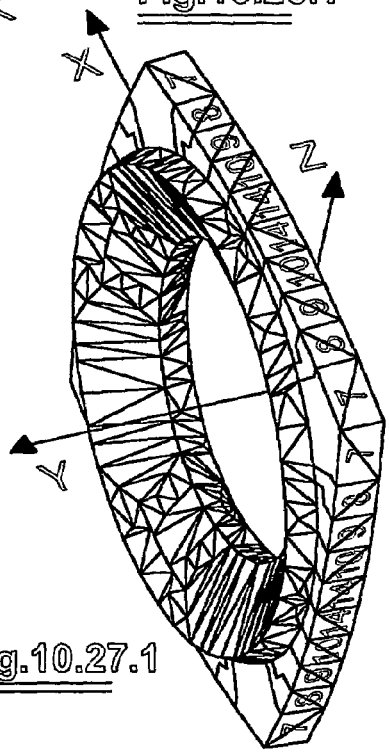
Figure 10:
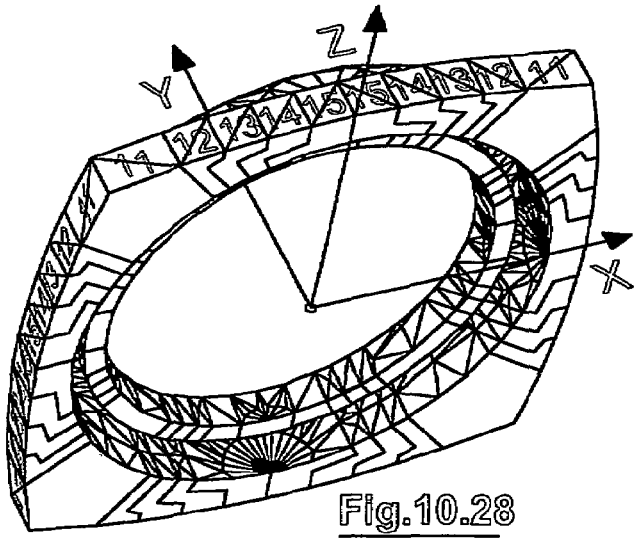
Figure 10:
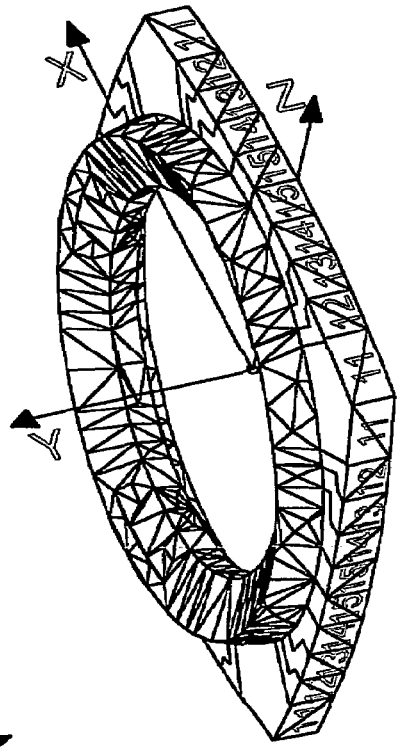
Figure 10:
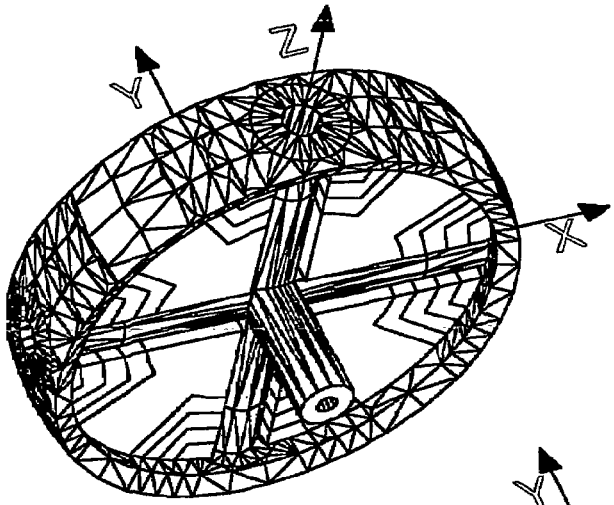
Figure 10:
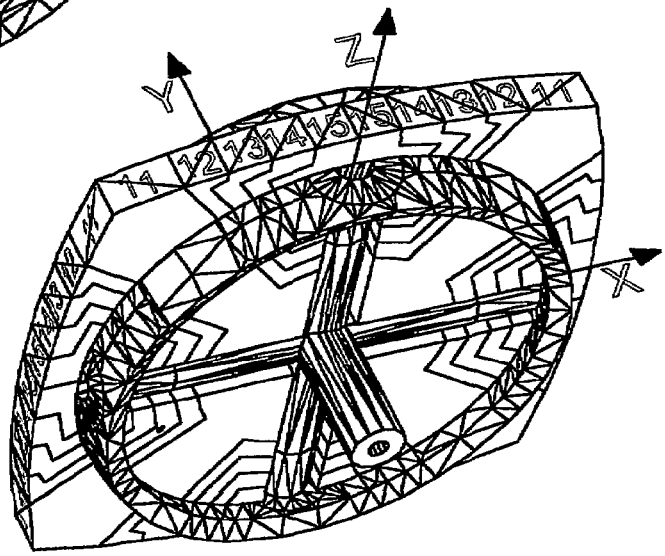
Figure 10:
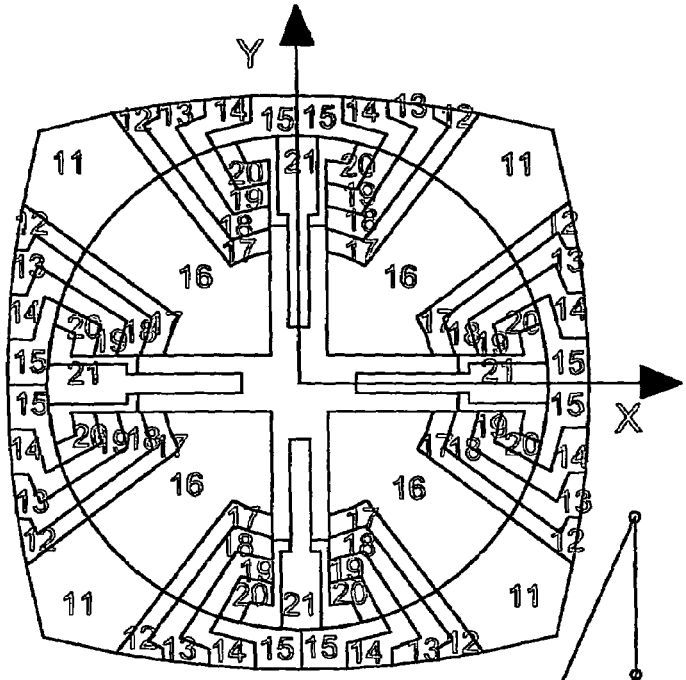
Figure 10:
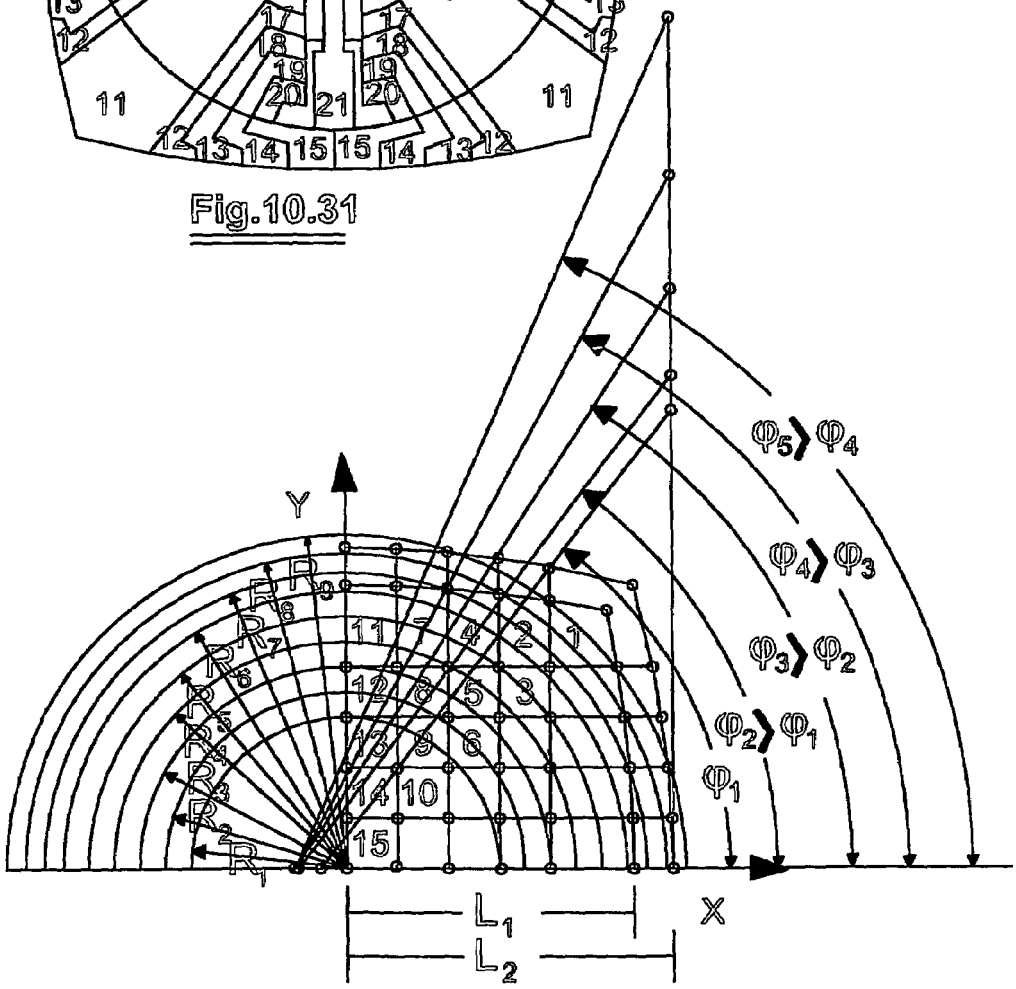
Figure 10:
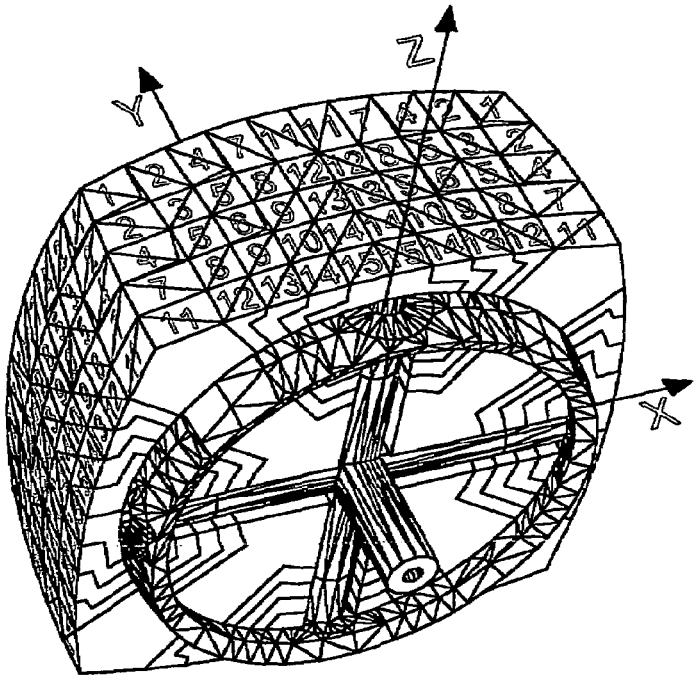
Figure 10:
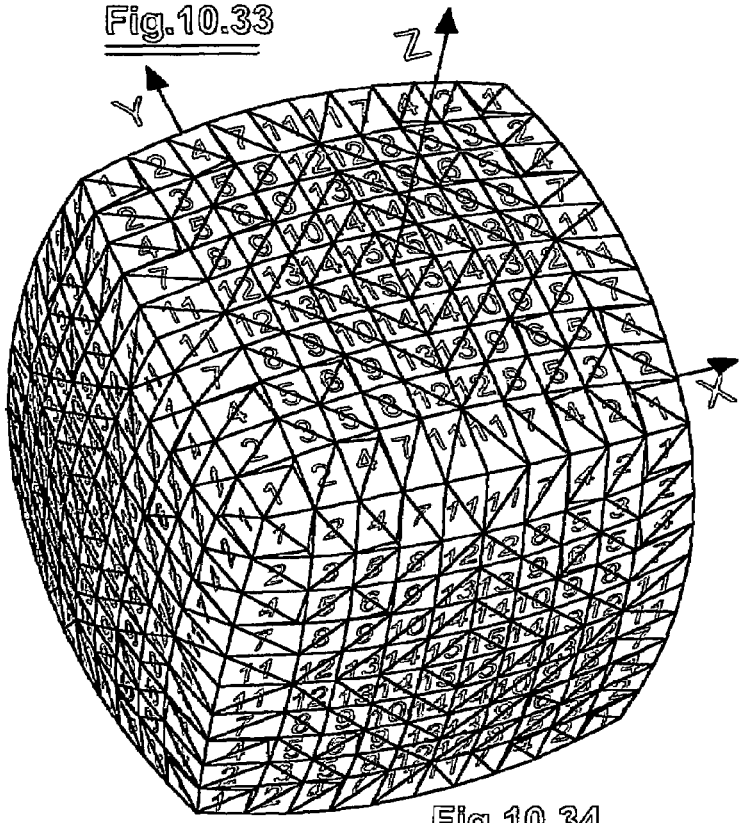

Finally, in FIG. 10.22 we can see the non-visible central three-orthogonal solid cross that supports the cube No 10.

In FIGS. 10.1.1, 10.2.1, 10.3.1, 10.4.1, 10.5.1, 10.6.1, 10.7.1, 10.8.1, 10.9.1, 10.10.1, 10.11.1, 10.12.1, 10.13.1, 10.14.1, 10.15.1, 10.16.1, 10.16.2, 10.17.1, 10.18.1, 10.19.1, 10.20.1 and 10.21.1 we can see the cross-sections of the twenty-one different separate pieces of the cubic logic toy No 10.

In FIG. 10.23 we can see these twenty-one separate pieces of the cubic logic toy No 10 placed at their position along with the non-visible central three-dimensional solid cross that supports the cube.

In FIG. 10.24 we can see the internal face of the first layer in each semi direction of the cubic logic toy No 10 along with the non-visible central three-dimensional solid cross that supports the cube.

In FIG. 10.25 we can see the internal face and in FIG. 10.25.1 we can see the external face of the second layer per semi direction of the cubic logic toy No 10.

In FIG. 10.26 we can see the internal face and in FIG. 10.26.1 we can see the external face of the third layer per semi direction of the cubic logic toy No 10.

In FIG. 10.27 we can see the internal face and in FIG. 10.27.1 we can see the external face of the fourth layer per semi direction of the cubic logic toy No 10.

In FIG. 10.28 we can see the internal face and in FIG. 10.28.1 we can see the external face of the fifth layer per semi direction of the cubic logic toy No 10.

In FIG. 10.29 we can see the face of the non-visible intermediate layer in each direction along with the non-visible central three-dimensional solid cross that supports the cube.

In FIG. 10.30 we can see the internal face of the intermediate layer in each direction and the internal face of the fifth layer per semi direction said fifth layer being supported on the intermediate layer, along with the non visible central three-dimensional solid cross that supports the cube.

In FIG. 10.31 we can see the section of the separate pieces of the intermediate layer in each direction and of the central non visible three-dimensional solid cross by an intermediate symmetry plane of the cube as well as the projection on it of the separate pieces of the fifth layer of this semi direction.

In FIG. 10.32 we can see the geometrical characteristics of the cubic logic toy No 10 for the configuration of the internal surfaces of the separate pieces of which, five conical surfaces per semi direction of the three-dimensional rectangular Cartesian coordinate system have been used.

In FIG. 10.33 we can see at an axonometric projection, the five visible layers per semi direction along with the non-visible central three-dimensional solid cross that supports the cube.

Finally, in FIG. 10.34 we can see the final shape of the cubic logic toy No 10.

The cubic logic toy No 10 consists of six hundred and three (603) separate pieces in total along with the non-visible central three-dimensional solid cross that supports the cube.

XI. When $\kappa=5$, that is when we use five conical surface per semi axis of the three-dimensional rectangular Cartesian coordinate system and $N=2\kappa+1=2\times5+1=11$, that is for the cubic logic toy No 11 whose final shape is substantially cubic its faces consisting of spherical surfaces of long radius, we have again (21) twenty-one different kinds of smaller pieces, all visible to the user of the toy.

Piece 1 (FIG. 11.1) and in total eight similar pieces, piece 2 (FIG. 11.2) and in total twenty-four similar pieces, piece 3 (FIG. 11.3) and in total twenty-four similar pieces, piece 4 (FIG. 11.4) and in total twenty-four similar pieces, piece 5 (FIG. 11.5) and in total forty eight similar pieces, piece 6 (FIG. 11.6) and in total twenty-four similar pieces, piece 7 (FIG. 11.7) and in total twenty-four similar pieces, piece 8 (FIG. 11.8) and in total forty eight similar pieces, piece 9 (FIG. 11.9) and in total forty eight similar pieces, piece 10 (FIG. (11.10) and in total twenty-four similar pieces, piece 11 (FIG. 11.11) and in total twenty-four similar pieces, piece 12 (FIG. (11.12) and in total forty eight similar pieces, piece 13 (FIG. 11.13) and in total forty eight similar pieces, piece 14 (FIG. 11.14) and in total forty eight similar pieces, piece 15 (FIG. 11.15) and in total twenty-four similar pieces, piece 16 (FIG. 11.16) and in total twelve similar pieces, piece 17 (FIG. 11.17) and in total twenty-four similar pieces, piece 18 (FIG. 11.18) and in total twenty-four similar pieces, piece 19 (FIG. 11.19) and in total twenty-four similar pieces, piece 20 (FIG. 11.20) and in total twenty-four similar pieces, and piece 21 (FIG. 11.21) and in total six similar pieces, the caps of the cubic logic toy No 11. Finally, in FIG. 11.22 we can see the non-visible central three-dimensional solid cross that supports the cube No 11.

Figure 11:
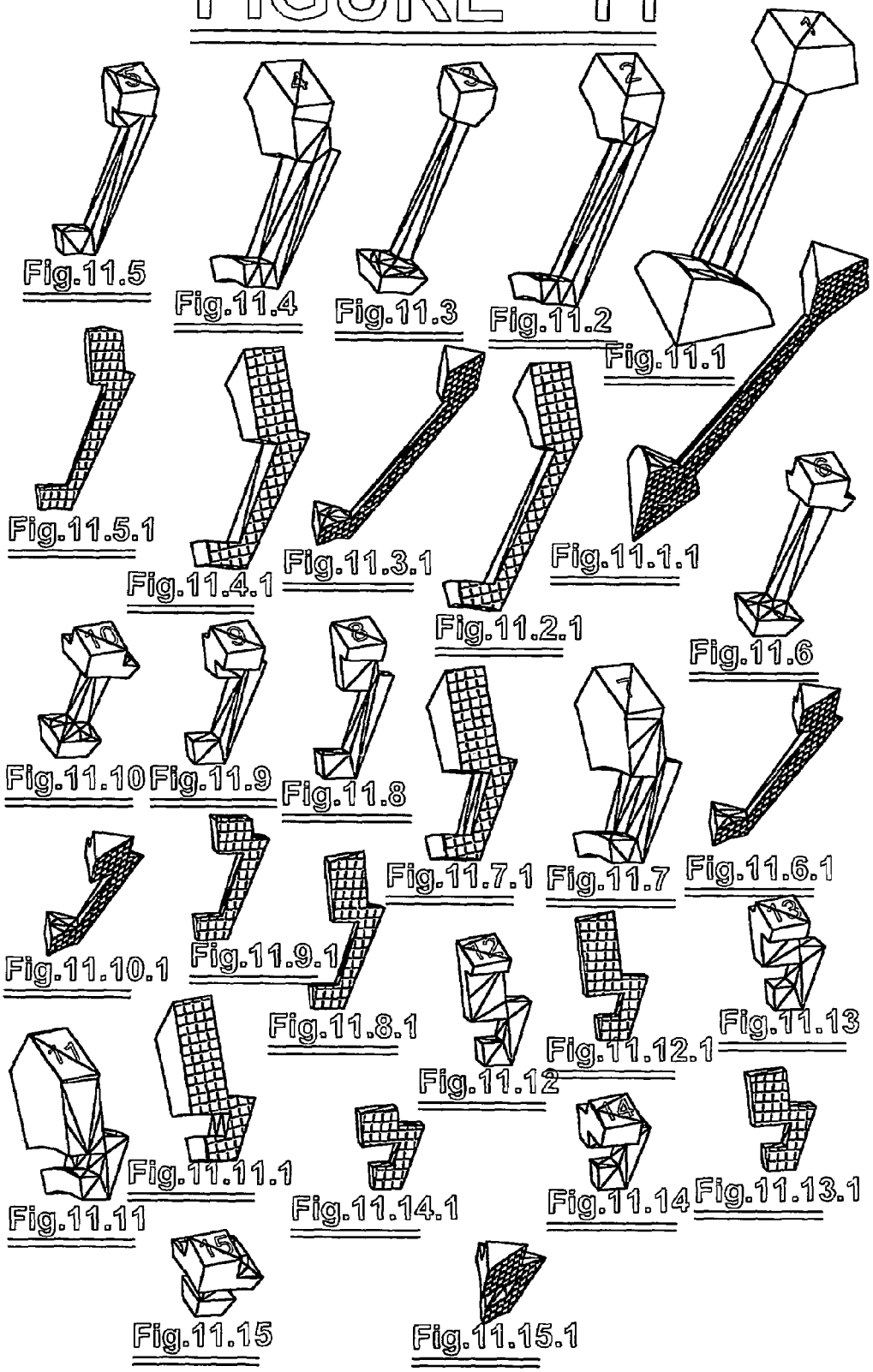
FIGS. 11.1 to 11.33 show views of a cubic logic toy according to another exemplary embodiment of the present invention.
Figure 11:
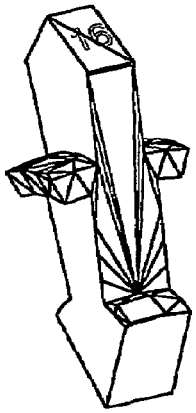
Figure 11:
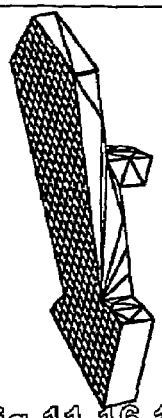
Figure 11:
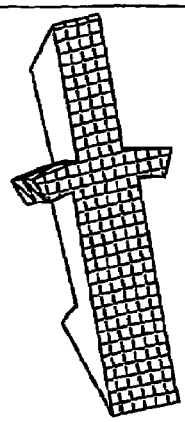
Figure 11:
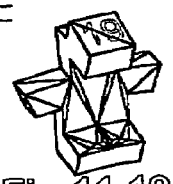
Figure 11:
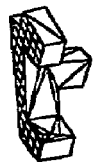
Figure 11:
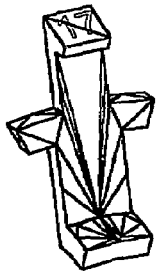
Figure 11:
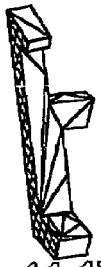
Figure 11:
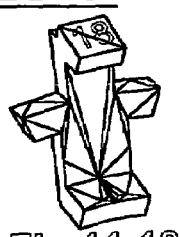
Figure 11:
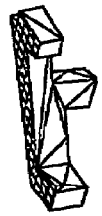
Figure 11:
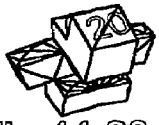
Figure 11:
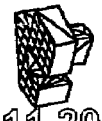
Figure 11:
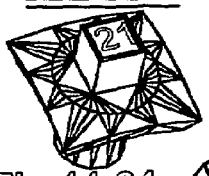
Figure 11:
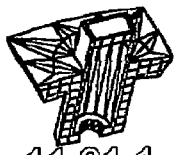
Figure 11:
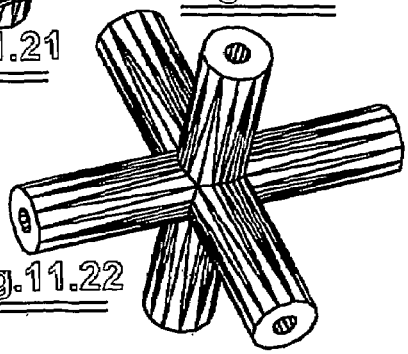
Figure 11:
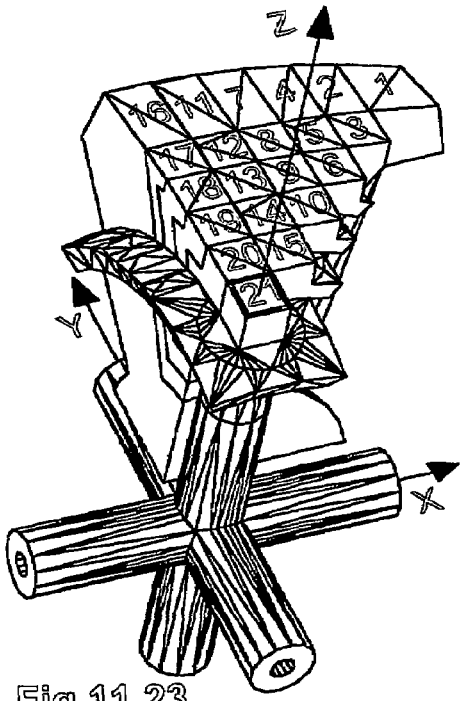
Figure 11:
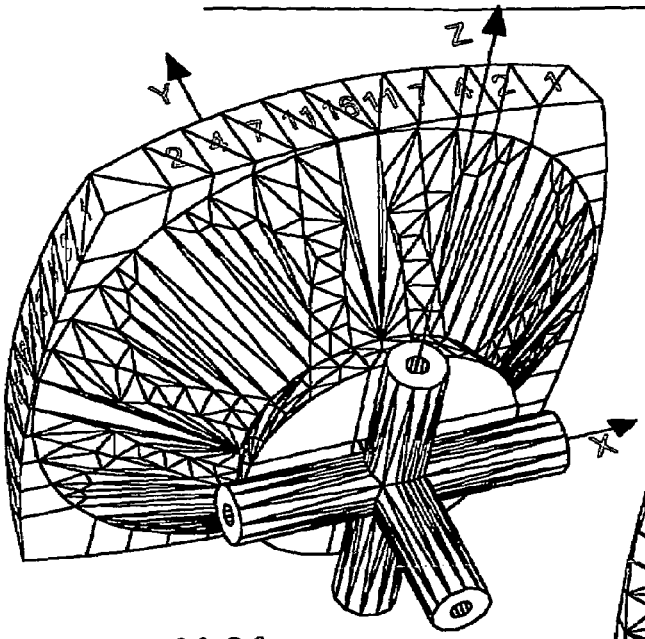
Figure 11:
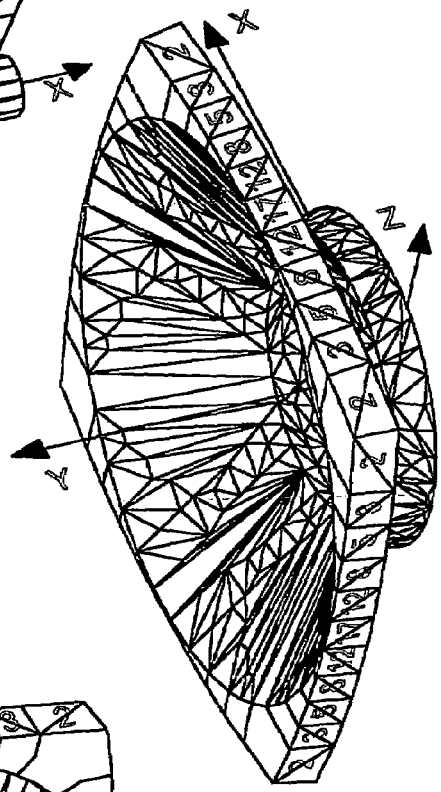
Figure 11:
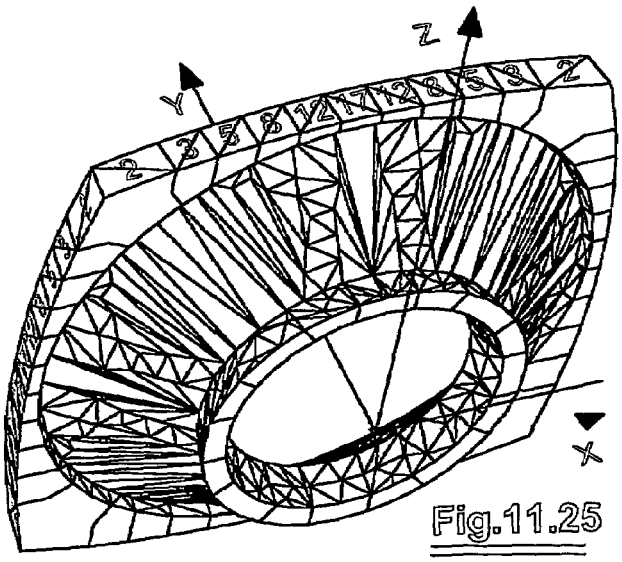
Figure 11:
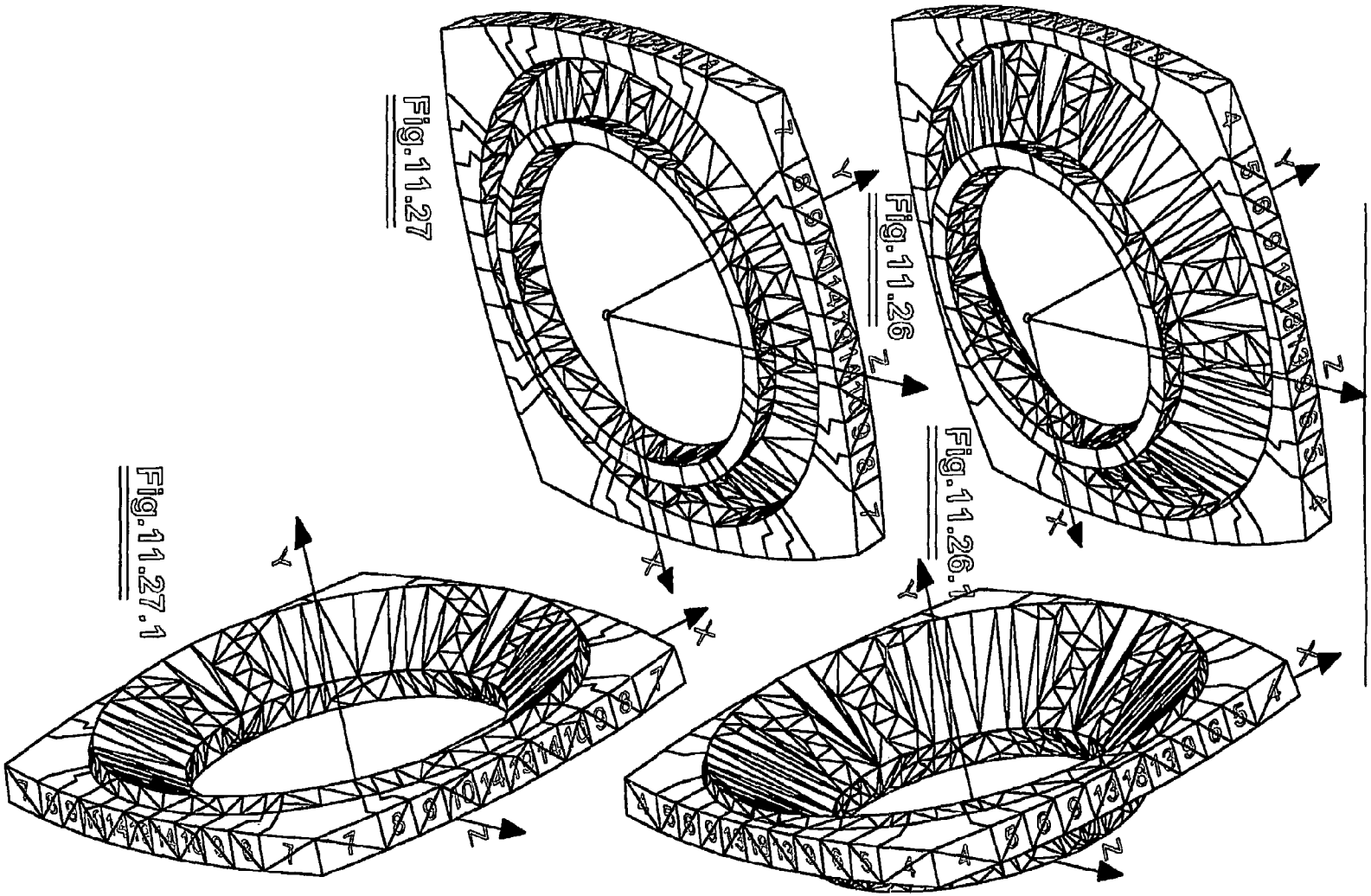
Figure 11:
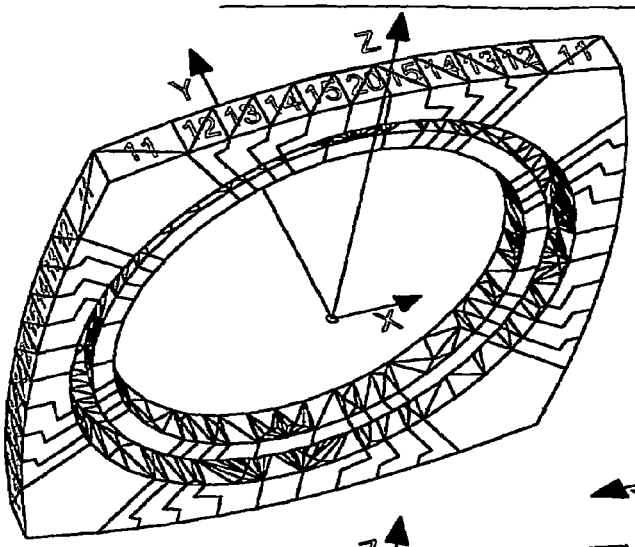
Figure 11:
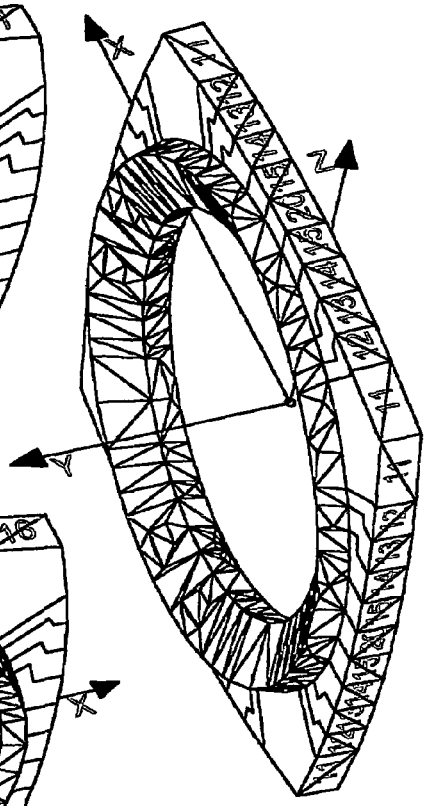
Figure 11:
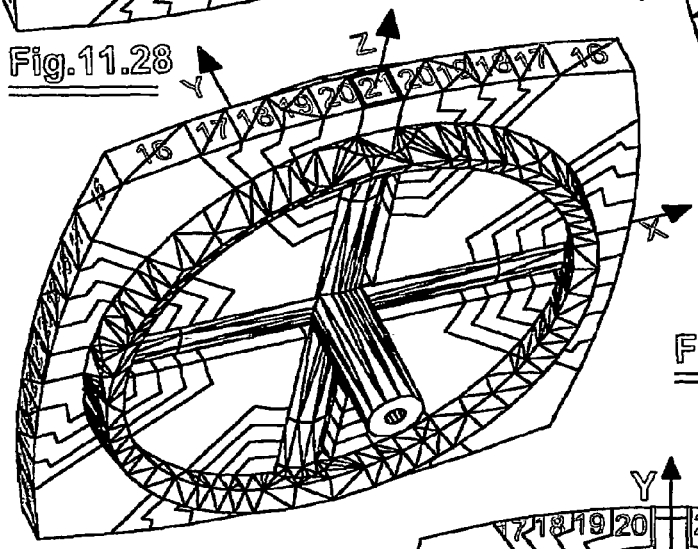
Figure 11:
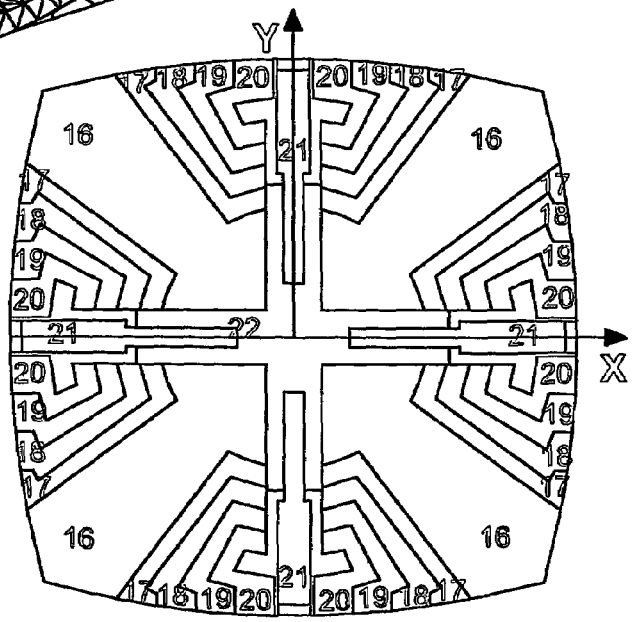
Figure 11:
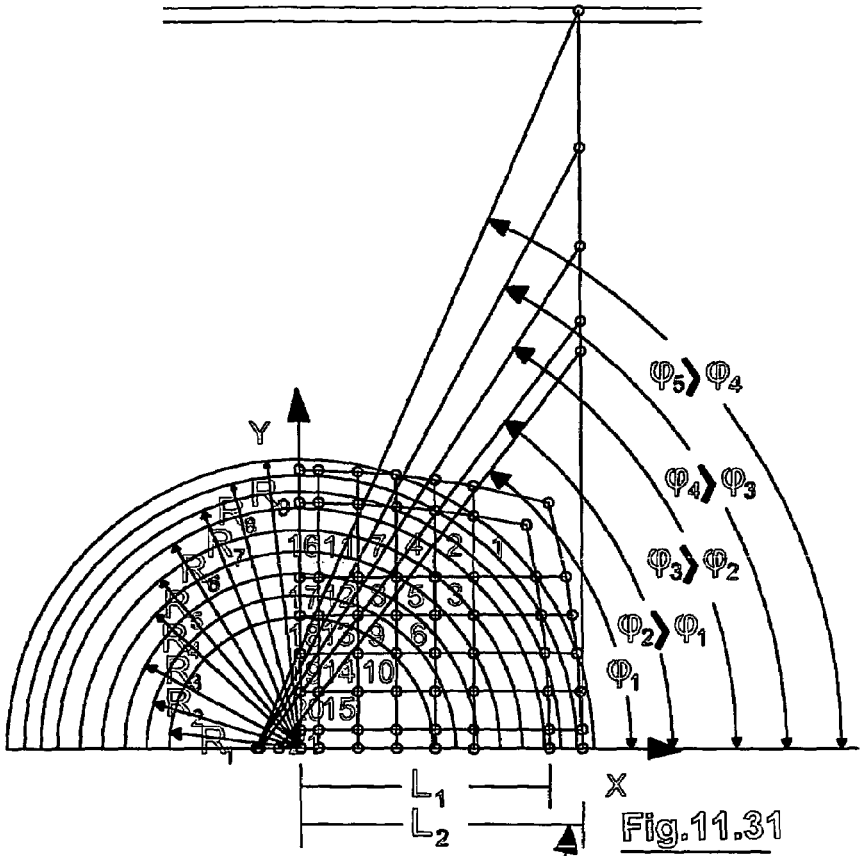
Figure 11:
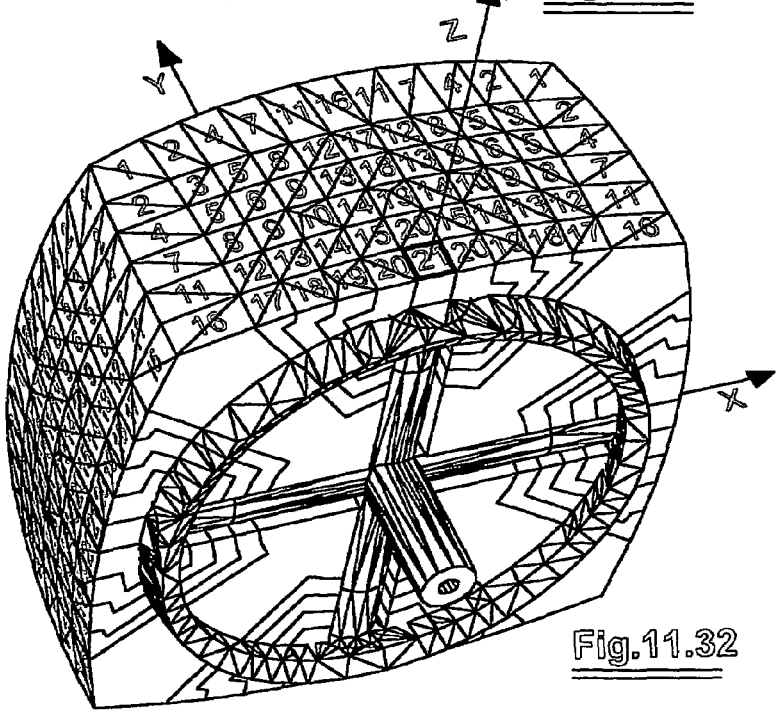
Figure 11:
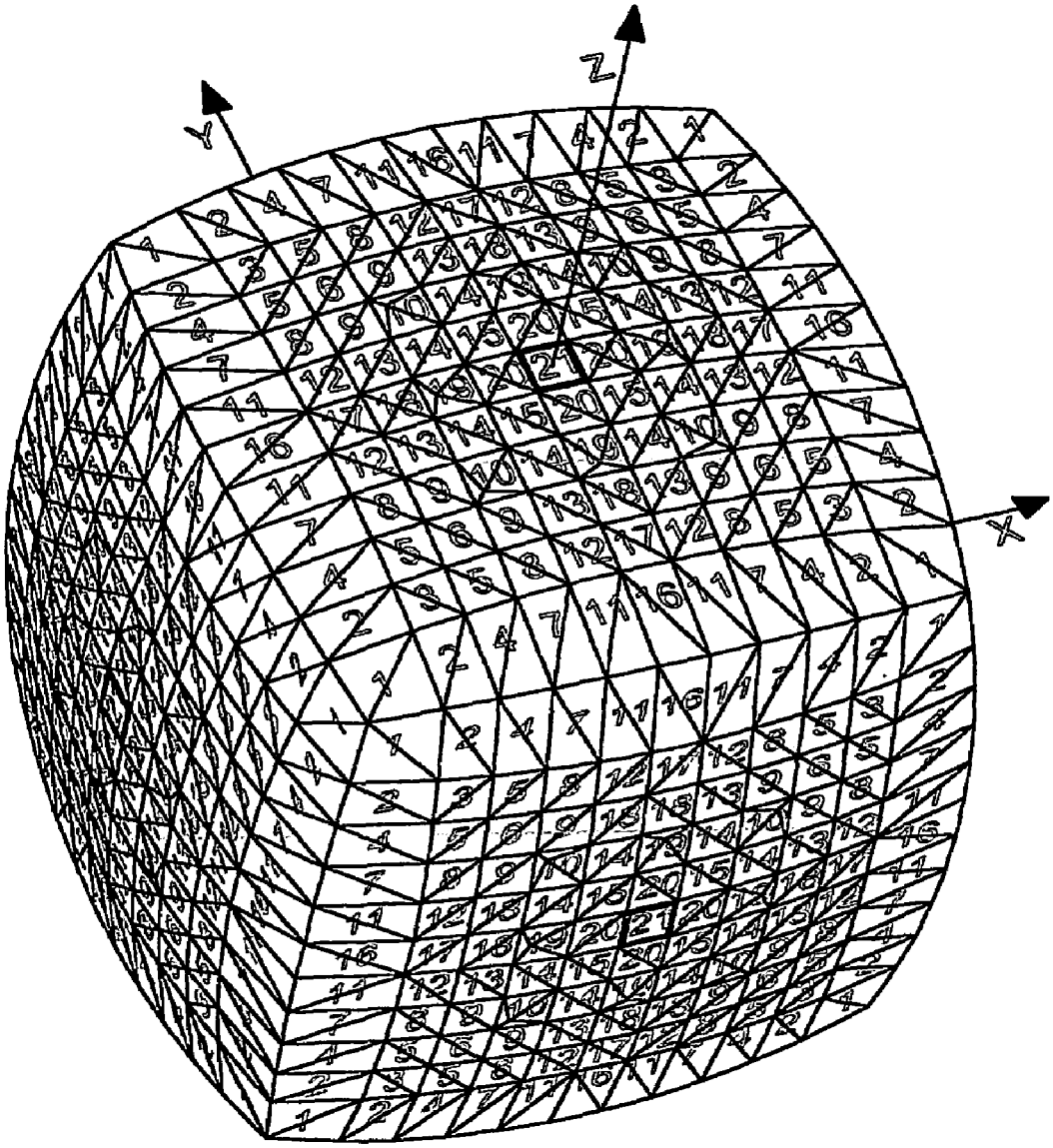

In FIGS. 11.1.1, 11.2.1, 11.3.1, 11.4.1, 11.5.1, 11.6.1, 11.7.1, 11.8.1, 11.9.1, 11.10.1, 11.11.1, 11.12.1, 11.13.1, 11.14.1, 11.15.1, 11.16.1, 11.16.2, 11.17.1, 11.18.1, 11.19.1, 11.20.1 and 11.21.1 we can see the cross-sections of the twenty-one different separate pieces of the cubic logic toy No 11.

In FIG. 11.23 we can see these twenty-one separate pieces of the cubic logic toy No 11 placed at their position along with the non-visible central three-dimensional solid cross that supports the cube.

In FIG. 11.24 we can see the internal face of the first layer per semi direction of the cubic logic toy No 11 along with the non-visible central three-dimensional solid cross that supports the cube.

In FIG. 11.25 we can see the internal face and in FIG. 11.25.1 we can see the external face of the second layer per semi direction of the three-dimensional rectangular Cartesian coordinate system of the cubic logic toy No 11.

In FIG. 11.26 we can see the internal face and in FIG. 11.26.1 we can see the external face of the third layer per semi direction of the three-dimensional rectangular Cartesian coordinate system of the cubic logic toy No 11.

In FIG. 11.27 we can see the internal face and in FIG. 11.27.1 we can see the external face of the fourth layer per semi direction of the three-dimensional rectangular Cartesian coordinate system of the cubic logic toy No 11.

In FIG. 11.28 we can see the internal face and in FIG. 11.28.1 we can see the external face of the fifth layer per semi direction of the three-dimensional rectangular Cartesian coordinate system of the cubic logic toy No 11.

In FIG. 11.29 we can see the intermediate layer per direction along with the non-visible central three-dimensional solid cross that supports the cube.

In FIG. 11.30 we can see the section of the separate pieces of the intermediate layer per direction along with the non-visible central three-dimensional solid cross that supports the cube by an intermediate symmetry plane of the cube No 11.

In FIG. 11.31 we can see the geometrical characteristics of the cubic logic toy No 11 for the configuration of the internal surfaces of the separate pieces of which five conical surfaces per semi direction of the three-dimensional rectangular Cartesian coordinate system have been used.

In FIG. 11.32 we can see at an axonometric projection, the five layers in each semi direction and the sixth layer in each direction, as well as the intermediate layer along with the non-visible central three-dimensional solid cross that supports the cube.

Finally, in FIG. 11.33 we can see the final shape of the cubic logic toy No 11.

The cubic logic toy No 11 consists of six hundred and three (603) separate pieces in total along with the non-visible central three-dimensional solid cross that supports the cube, the same number of pieces as in the cubic logic toy 10.

It is suggested that the construction material for the solid parts can be mainly plastic of good quality, while for N=10 and N=11 it could be replaced by aluminum.

Finally, we should mention that up to cubic logic toy No 7 we do not expect to face problems of wear of the separate pieces due to speed cubing.

The possible wear problems of the corner pieces, which are mainly worn out the most during speed cubing, for the cubes No 8 to No 11, can be dealt with, if during the construction of the corner pieces, their conical sphenoid parts are reinforced with a suitable metal bar, which will follow the direction of the cube's diagonal. This bar will start from the lower spherical part, along the diagonal of the cube and it will stop at the highest cubic part of the corner pieces.

Additionally, possible problems due to speed cubing for the cubes No 8 to No 11 may arise only because of the large number of the separate parts that these cubes are consisting of, said parts being 387 for the cubes No 8 and No 9, and 603 for the cubes No 10. These problems can only be dealt with by constructing the cubes in a very cautious way.

The invention claimed is:

1. A cubic logic having the shape of a normal geometric solid, substantially cubic, comprising:

N layers visible to the user of the toy per each direction of a three-dimensional, rectangular Cartesian coordinate system whose centre coincides with the geometric centre of the solid and whose axes pass through the centre of the solid's external surfaces and are vertical to the corresponding external surfaces, each axis of the three dimensional, rectangular Cartesian coordinate system is defined by two semi-axes extending in opposite directions from the geometric center of the solid, said layers including a plurality of separate pieces, the sides of said pieces that form part of the solid's external surface being substantially planar, said pieces being able to rotate in layers around the axes of said rectangular Cartesian coordinate system, the surfaces of said pieces that are visible to the user of the toy being colored or bearing shapes or letters or numbers, each of said pieces including three distinct parts, the distinct parts being:

a first part that is outermost with regard to the geometric centre of the solid, the outer surfaces of said first part being either substantially planar, when they form part of the solid's external surface and are visible to the user or spherically cut, when they are not visible to the user, a second intermediate part, and a third part that is innermost with regard to the geometric centre of the solid, the third part forming part of a sphere or of a spherical shell, each of said pieces having recesses and/or protrusions, such that each piece is inter-coupled with and supported by one or more neighboring pieces, and one or two spherical recesses and/or protrusions between adjacent layers are provided, the edges of each of said pieces being rounded, the assembly of said pieces being held together to form said solid on a central three-dimensional supporting cross located at the centre of the solid, the cross having six cylindrical legs, the axes of symmetry of said legs coincide with the semi-axes of said three-dimensional, rectangular Cartesian coordinate system, the assembly of said pieces being held on said central three-dimensional supporting cross by six caps, each of the caps being a central piece of a corresponding face of said solid, each of said caps having a cylindrical hole coaxial with the corresponding semi-axis of said three-dimensional, rectangular Cartesian coordinate system, each of said six caps being screwed to a corresponding leg of said central three-dimensional supporting cross via a supporting screw passing through said cylindrical hole, said caps either being visible to the user and having a flat plastic piece covering said cylindrical hole or being non-visible to the user, the internal surfaces of each of said pieces not forming the external surfaces of said solid being formed by a combination of:

planar surfaces, concentric spherical surfaces whose centre coincides with the geometric centre of the solid, and cylindrical surfaces, the cylindrical surfaces being provided on only the third innermost part of the six caps, wherein for the configuration of the internal surfaces of each of said pieces, apart from said planar surfaces, said concentric spherical surfaces and said cylindrical surfaces, a minimum number of $\kappa$ right conical surfaces per semi-axis of said three-dimensional, rectangular Cartesian coordinate system are used, the axis of said right conical surfaces coinciding with the corresponding semi-axis of said three-dimensional, rectangular Cartesian coordinate system, the generating angle $\phi_1$ of the first and innermost of said right conical surfaces either being greater than 54.73561032° when the apex of said first conical surface coincides with the geometric centre of the solid, or starting from a value less than 54.73561032°, when the apex of said first conical surface coincides with the geometrical centre of the solid and lies on the semi-axis opposite to the semi-axis which points to the direction in which said first conical surface widens, the generating angle of the subsequent conical surfaces gradually increasing, the number of layers N correlate with the number of right conical surfaces $\kappa$, so that:

either $N=2\kappa$ and said solid has an even number of N layers visible to the user per direction, plus one additional layer in each direction, the intermediate layer not being visible to the user, or $N=2\kappa+1$ and said solid has, an odd number of N layers per direction that are all visible to the user, and the second intermediate part of each of said pieces having thereby a conical sphenoid shape pointing substantially towards the geometric centre of the solid, the cross-section, when the second intermediate part is sectioned by spherical surfaces concentric with the geometric centre of the solid, having the shape of any triangle or trapezium or quadrilateral on a sphere, said cross-section being either similar or differentiated in shape along the length of said second intermediate part.

2. The cubic logic toy according to claim 1, wherein, for values of N between 2 and 5, the external surfaces of said solid are planar.

3. The cubic logic toy according to claim 1, wherein, for values of N between 7 and 11, the external surfaces of said solid are substantially planar.

4. The cubic logic toy according to claim 1, wherein, when N=6, the external surfaces of the geometric solid are planar.

5. The cubic logic toy according to claim 1, wherein, when N=6, the external surfaces of said solid are substantially planar.

6. The cubic logic toy according to claim 1, wherein, when the number of right conical surfaces $\kappa=1, 2, 3, 4$ or 5 and the number of layers N per each direction of said three-dimensional, rectangular Cartesian coordinate system which are visible to the user of the toy is $N=2\kappa$, the total number of the pieces that are able to rotate in layers around the axes of said three-dimensional, rectangular Cartesian coordinate system, with the addition of the central three-dimensional supporting cross, being equal to: $T=6(2\kappa)^2+3$.

7. The cubic logic toy according to claim 1, wherein, when the number of right cortical surfaces k=1, 2, 3, 4 or 5 and the number of layers N per each direction of said three-dimensional, rectangular Cartesian coordinate system which are visible to the user of the toy is $N=2\kappa+1$, the total number of the pieces that are able to rotate in layers around the axes of said three-dimensional, rectangular Cartesian coordinate system, with the addition of the central three-dimensional supporting cross, being equal to: $T=6(2\kappa)^2+3$.

8. The cubic logic toy according to claim 2, wherein each of the supporting screws is surrounded by a spring.

9. The cubic logic toy according to claim 3, wherein each of the supporting screws is surrounded by a spring.

10. The cubic logic toy according to claim 4, wherein each of the supporting screws is surrounded by a spring.

11. The cubic logic toy according to claim 5, wherein each of the supporting screws is surrounded by a spring.

* * * * *

UNITED STATES PATENT AND TRADEMARK OFFICE

CERTIFICATE OF CORRECTION

PATENT NO. : 7,600,756 B2
APPLICATION NO. : 10/555013
DATED : October 13, 2009
INVENTOR(S) : Panayotis Verdes It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 542 days.

Signed and Sealed this

Fifth Day of October, 2010

David J. Kappos

David J. Kappos
*Director of the United States Patent and Trademark Office*